US009980878B2

(12) United States Patent
Marici et al.

(10) Patent No.: US 9,980,878 B2
(45) Date of Patent: May 29, 2018

(54) SYSTEM WITH ADAPTER FOR CLOSED TRANSFER OF FLUIDS

(71) Applicant: Becton Dickinson and Company Limited, Dun Laoghaire (IE)

(72) Inventors: Paul Paia Marici, Piscataway, NJ (US); Girum Yemane-Tekeste, Hackensack, NJ (US)

(73) Assignee: Becton Dickinson and Company Limited, Dun Laoghaire (IE)

( * ) Notice: Subject to any disclaimer, the term of this patent is extended or adjusted under 35 U.S.C. 154(b) by 508 days.

(21) Appl. No.: 14/691,898

(22) Filed: Apr. 21, 2015

(65) Prior Publication Data

US 2015/0297456 A1 Oct. 22, 2015

Related U.S. Application Data

(60) Provisional application No. 61/982,039, filed on Apr. 21, 2014.

(51) Int. Cl.
*A61J 1/20* (2006.01)
*A61J 1/14* (2006.01)

(52) U.S. Cl.
CPC ..... *A61J 1/2079* (2015.05); *A61J 1/201* (2015.05); *A61J 1/2055* (2015.05); *A61J 1/2068* (2015.05); *A61J 1/2072* (2015.05); *A61J 1/2086* (2015.05); *A61J 1/2096* (2013.01); *A61J 1/1406* (2013.01)

(58) Field of Classification Search
CPC ..... A61J 1/1406; A61J 1/201; A61J 1/2055; A61J 1/2068; A61J 1/2072; A61J 1/2079; A61J 1/2082; A61J 1/2086; A61J 1/2096
See application file for complete search history.

(56) References Cited

U.S. PATENT DOCUMENTS

| | | | |
|---|---|---|---|
| 4,436,125 | A | 3/1984 | Blenkush |
| 4,564,054 | A | 1/1986 | Gustavsson |
| 4,673,404 | A | 6/1987 | Gustavsson |
| 4,932,937 | A | 6/1990 | Gustavsson et al. |
| 5,052,725 | A | 10/1991 | Meyer et al. |

(Continued)

FOREIGN PATENT DOCUMENTS

| | | | |
|---|---|---|---|
| EP | 2462971 | A1 | 6/2012 |
| WO | 8404672 | A1 | 12/1984 |

(Continued)

*Primary Examiner* — Benjamin Klein
(74) *Attorney, Agent, or Firm* — The Webb Law Firm

(57) ABSTRACT

A vial access device includes an outer housing defining an annular space and an inner space, an inner housing, and a connector configured to engage a mating connector with the connector having a body defining a central passageway and a flange that extends radially outward from the body. The flange and the housing defining a filter space that is in fluid communication with the annular space. A pressure equalization system is positioned within the annular space of the outer housing. The device also includes a vial connection element configured to be secured to a vial and having a body and a spike member extending from the body. The spike member defining a fluid passageway and a vent passageway with the fluid passageway in fluid communication with the central passageway of the connector and the vent passageway in fluid communication with the filter space and the annular space.

12 Claims, 51 Drawing Sheets

(56) References Cited

U.S. PATENT DOCUMENTS 5,104,158 A 4/1992 Meyer et al.
5,122,129 A 6/1992 Olson et al.
5,280,876 A 1/1994 Atkins
5,290,254 A 3/1994 Vaillancourt
5,322,518 A 6/1994 Schneider et al.
5,334,188 A 8/1994 Inoue et al.
5,360,011 A 11/1994 McCallister
5,395,348 A 3/1995 Ryan
5,437,650 A 8/1995 Larkin et al.
5,464,123 A 11/1995 Scarrow
5,472,430 A 12/1995 Vaillancourt et al.
5,478,328 A 12/1995 Silverman et al.
5,487,728 A 1/1996 Vaillancourt
5,507,733 A 4/1996 Larkin et al.
5,509,911 A 4/1996 Cottone, Sr. et al.
5,545,152 A 8/1996 Funderburk et al.
5,607,392 A 3/1997 Kanner
5,609,584 A 3/1997 Gettig et al.
5,611,792 A 3/1997 Gustafsson
5,647,845 A 7/1997 Haber et al.
5,685,866 A 11/1997 Lopez
5,807,347 A 9/1998 Bonaldo
5,897,526 A 4/1999 Vaillancourt
6,063,068 A 5/2000 Fowles et al.
6,089,541 A 7/2000 Weinheimer et al.
6,113,583 A 9/2000 Fowles et al.
6,132,404 A 10/2000 Lopez
6,139,534 A 10/2000 Niedospial, Jr. et al.
6,221,041 B1 4/2001 Russo
6,221,056 B1 4/2001 Silverman
6,343,629 B1 2/2002 Wessman et al.
6,358,236 B1 3/2002 DeFoggi et al.
6,409,708 B1 6/2002 Wessman
6,474,375 B2 11/2002 Spero et al.
6,478,788 B1 11/2002 Aneas
6,544,246 B1 4/2003 Niedospial, Jr.
6,551,299 B2 4/2003 Miyoshi et al.
6,585,695 B1 7/2003 Adair et al.
6,599,273 B1 7/2003 Lopez
6,610,040 B1 8/2003 Fowles et al.
6,629,958 B1 10/2003 Spinello
6,656,433 B2 12/2003 Sasso
6,715,520 B2 4/2004 Andreasson et al.
6,814,726 B1 11/2004 Lauer
6,852,103 B2 2/2005 Fowles et al.
6,875,203 B1 4/2005 Fowles et al.
6,875,205 B2 4/2005 Leinsing
6,911,025 B2 6/2005 Miyahara
6,997,917 B2 2/2006 Niedospial, Jr. et al.
7,040,598 B2 5/2006 Raybuck
7,083,605 B2 8/2006 Miyahara
7,097,209 B2 8/2006 Unger et al.
7,261,707 B2 8/2007 Frezza et al.
7,306,584 B2 12/2007 Wessman et al.
7,326,194 B2 2/2008 Zinger et al.
7,350,535 B2 4/2008 Liepold et al.
7,354,427 B2 4/2008 Fangrow
7,452,349 B2 11/2008 Miyahara
7,547,300 B2 6/2009 Fangrow
7,628,772 B2 12/2009 McConnell et al.
7,648,491 B2 1/2010 Rogers
7,658,734 B2 2/2010 Adair et al.
7,743,799 B2 6/2010 Mosler et al.
7,744,581 B2 6/2010 Wallen et al.
7,758,560 B2 7/2010 Connell et al.
7,803,140 B2 9/2010 Fangrow, Jr.
7,857,805 B2 12/2010 Raines
7,867,215 B2 1/2011 Akerlund et al.
7,879,018 B2 2/2011 Zinger et al.
7,900,659 B2 3/2011 Whitley et al.
7,927,316 B2 4/2011 Proulx et al.
7,942,860 B2 5/2011 Horppu
7,975,733 B2 7/2011 Horppu et al.
8,096,525 B2 1/2012 Ryan
8,122,923 B2 2/2012 Kraus et al.
8,123,738 B2 2/2012 Vaillancourt
8,137,332 B2 3/2012 Pipelka
8,167,863 B2 5/2012 Yaw
8,177,768 B2 5/2012 Leinsing
8,196,614 B2 6/2012 Kriheli
8,206,367 B2 6/2012 Warren et al.
8,211,069 B2 7/2012 Fangrow, Jr.
8,225,826 B2 7/2012 Horppu et al.
8,226,628 B2 7/2012 Muramatsu et al.
8,257,286 B2 9/2012 Meyer et al.
8,267,127 B2 9/2012 Kriheli
8,277,424 B2 10/2012 Pan
8,317,741 B2 11/2012 Kraushaar
8,317,743 B2 11/2012 Denenburg
8,398,607 B2 3/2013 Fangrow, Jr.
8,403,905 B2 3/2013 Yow
8,414,554 B2 4/2013 Garfield et al.
8,414,555 B2 4/2013 Garfield et al.
8,414,556 B2 4/2013 Garfield et al.
8,425,487 B2 4/2013 Beiriger et al.
8,449,521 B2 5/2013 Thorne, Jr. et al.
8,454,579 B2 6/2013 Fangrow, Jr.
8,469,940 B2 6/2013 Garfield et al.
8,894,627 B2 11/2014 Garfield et al.
9,220,661 B2 12/2015 Garfield et al.
9,351,906 B2 5/2016 Garfield et al.
9,358,182 B2 6/2016 Garfield et al.
9,364,396 B2 6/2016 Garfield et al.
9,370,466 B2 6/2016 Garfield et al.
9,381,137 B2 7/2016 Garfield et al.
2003/0070726 A1 4/2003 Andreasson et al.
2005/0065495 A1 3/2005 Zambaux
2005/0182383 A1 8/2005 Wallen
2005/0215976 A1 9/2005 Wallen
2007/0079894 A1 4/2007 Kraus et al.
2008/0045919 A1 2/2008 Jakob et al.
2008/0287914 A1 11/2008 Wyatt et al.
2009/0159485 A1 6/2009 Jakob et al.
2010/0147402 A1 6/2010 Tornqvist
2010/0179506 A1 7/2010 Shemesh et al.
2010/0217226 A1 8/2010 Shemesh
2011/0004183 A1 1/2011 Carrez et al.
2011/0062703 A1 3/2011 Lopez et al.
2011/0074148 A1 3/2011 Imai
2011/0106046 A1 5/2011 Hiranuma et al.
2011/0257621 A1 10/2011 Fangrow
2011/0291406 A1 12/2011 Kraft et al.
2012/0035580 A1 2/2012 Fangrow
2012/0046636 A1 2/2012 Kriheli
2012/0123381 A1 5/2012 Kraus et al.
2012/0179129 A1 7/2012 Imai
2012/0192968 A1 8/2012 Bonnal et al.
2012/0192976 A1 8/2012 Rahimy et al.
2012/0203193 A1 8/2012 Rogers
2012/0265163 A1 10/2012 Cheng et al.
2012/0279884 A1 11/2012 Tennican et al.
2012/0316536 A1 12/2012 Carrez et al.
2013/0006211 A1 1/2013 Takemoto
2013/0012908 A1 1/2013 Yeung
2013/0066293 A1 3/2013 Garfield et al.
2013/0072893 A1 3/2013 Takemoto
2013/0076019 A1 3/2013 Takemoto
2013/0079744 A1 3/2013 Okiyama et al.
2014/0261877 A1* 9/2014 Ivosevic ..... A61J 1/2096 141/27
2016/0081879 A1 3/2016 Garfield et al.
2016/0206511 A1 7/2016 Garfield et al.
2016/0250102 A1 9/2016 Garfield et al.

FOREIGN PATENT DOCUMENTS

WO 2005011781 A1 2/2005
WO 2006103074 A1 10/2006
WO 2009024807 A1 2/2009
WO 2009090627 A1 7/2009
WO 2011050333 A1 4/2011
WO 2012069401 A1 5/2012
WO 2012119225 A1 9/2012
WO 2012168235 A1 12/2012

(56) References Cited

FOREIGN PATENT DOCUMENTS

| | | | |
|---|---|---|---|
| WO | 2013025946 | A1 | 2/2013 |
| WO | 2013054323 | A1 | 4/2013 |
| WO | 2013066779 | A1 | 5/2013 |
| WO | 2013115730 | A1 | 8/2013 |
| WO | 2013179596 | A1 | 12/2013 |
| WO | 2014122643 | A1 | 8/2014 |
| WO | 2014181320 | A1 | 11/2014 |

* cited by examiner

SYSTEM WITH ADAPTER FOR CLOSED TRANSFER OF FLUIDS

CROSS-REFERENCE TO RELATED APPLICATION

This application claims priority to U.S. Provisional Application Ser. No. 61/982,039, filed Apr. 21, 2014, which is hereby incorporated by reference in its entirety.

BACKGROUND OF THE INVENTION

1. Field of the Disclosure

The present disclosure relates generally to a system for the closed transfer of fluids. More particularly, the present disclosure relates to a system that accommodates vials having different sizes and provides leak-proof sealing and pressure equalization during engagement of a cannula with a vial, during transfer of a substance from a vial chamber to a barrel chamber via the cannula, and during disengagement of the cannula from the vial.

2. Description of the Related Art

Health care providers reconstituting, transporting, and administering hazardous drugs, such as cancer treatments, can put themselves at risk of exposure to these medications and present a major hazard in the health care environment. For example, nurses treating cancer patients risk being exposed to chemotherapy drugs and their toxic effects. Unintentional chemotherapy exposure can affect the nervous system, impair the reproductive system, and bring an increased risk of developing blood cancers in the future. In order to reduce the risk of health care providers being exposed to toxic drugs, the closed transfer of these drugs becomes important.

Some drugs must be dissolved or diluted before they are administered, which involves transferring a solvent from one container to a sealed vial containing the drug in powder or liquid form, by means of a needle. Drugs may be inadvertently released into the atmosphere in gas form or by way of aerosolization, during the withdrawal of the needle from the vial, and while the needle is inside the vial if any differential pressure exists between the interior of the vial and the surrounding atmosphere.

SUMMARY OF THE INVENTION

In one aspect of the present invention, a vial access device includes an outer housing defining an annular space and an inner space, an inner housing having a body defining a central opening with at least a portion of the inner housing positioned within the inner space of the outer housing, and a connector configured to engage a mating connector with the connector having a body defining a central passageway and a flange that extends radially outward from the body. The flange and the housing define a filter space that is in fluid communication with the annular space. A pressure equalization system is positioned within the annular space of the outer housing with the pressure equalization system configured to change a volume of space defined by the annular space and the pressure equalization system. The device also includes a vial connection element configured to be secured to a vial with the vial connection element having a body and a spike member extending from the body. The spike member defines a fluid passageway and a vent passageway with the fluid passageway in fluid communication with the central passageway of the connector and the vent passageway in fluid communication with the filter space and the annular space. A filter is positioned in the filter space.

The vial access device may further include a top cap having a body secured to the inner housing with the body of the top cap defining a recessed portion that receives a portion of the connector. The top cap may include a gripping surface configured to allow a user to remove the top cap from the inner housing.

The body of the vial connection element may define a central passageway, with the body of the vial connection element received within the central passageway of the connector with the central passageway of the vial connection element aligned with the central passageway of the connector. An O-ring may be positioned between the vial connection element and the connector.

The flange of the connector may abut a ledge defined by the outer housing, with the ledge extending radially inward into the inner space of the outer housing.

The inner housing may have a top surface having a shape that conforms to an outer surface of the outer housing. The body of the inner housing may have a cylindrical portion extending axially into the inner space of the outer housing. A membrane may be positioned on the connector adjacent to the central passageway of the connector.

The pressure equalization system may include a toroidal balloon configured to expand axially outer of the annular space of the outer housing. The filter may be annular and may be a hydrophobic filter.

BRIEF DESCRIPTION OF THE DRAWINGS

The above-mentioned and other features and advantages of this disclosure, and the manner of attaining them, will become more apparent and the disclosure itself will be better understood by reference to the following descriptions of aspects of the disclosure taken in conjunction with the accompanying drawings, wherein.

Corresponding reference characters indicate corresponding parts throughout the several views. The exemplifications set out herein illustrate exemplary aspects of the disclosure, and such exemplifications are not to be construed as limiting the scope of the disclosure in any manner.

DETAILED DESCRIPTION

Figure 1:
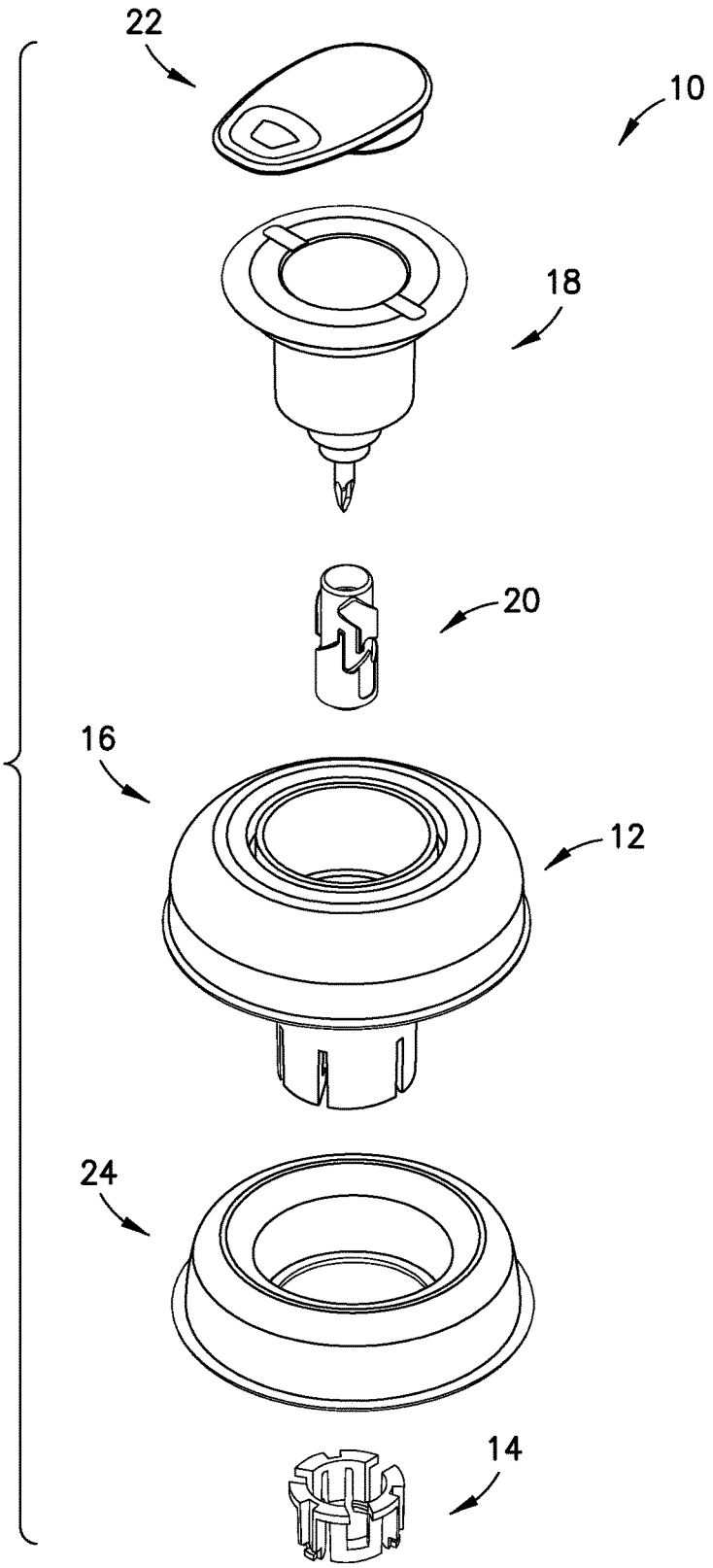
FIG. 1 is an exploded, perspective view of a system in accordance with an aspect of the present invention.

The following description is provided to enable those skilled in the art to make and use the described aspects contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary aspects of the invention. Hence, specific dimensions and other physical characteristics related to the aspects disclosed herein are not to be considered as limiting.

In the following discussion, "distal" refers to a direction generally toward an end of a vial access device adapted for contact with a container, such as a vial, and "proximal" refers to the opposite direction of distal, i.e., away from the end of a vial access device adapted for engagement with the container. For purposes of this disclosure, the above-mentioned references are used in the description of the components of a vial access device in accordance with the present disclosure.

Figure 2:
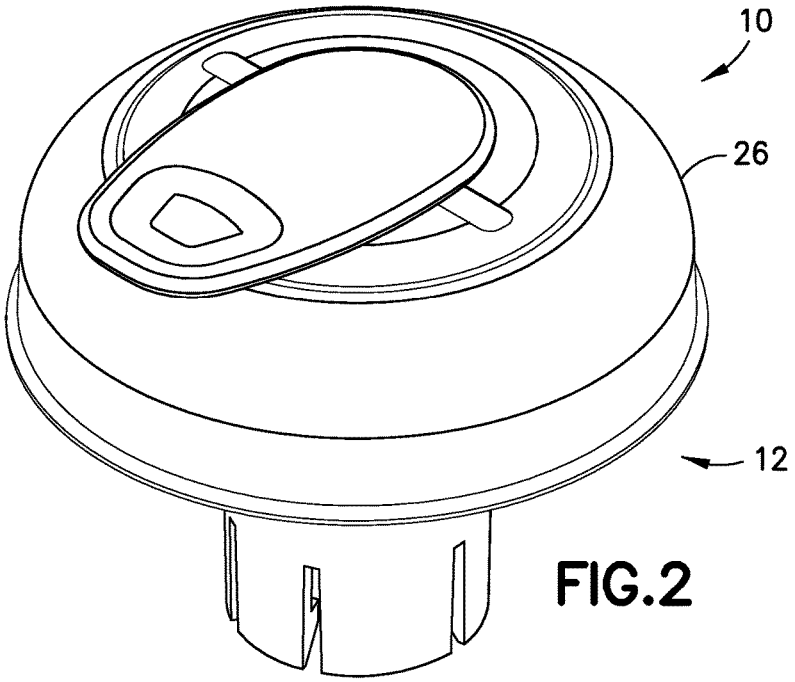
FIG. 2 is an assembled, perspective view of a system in accordance with an aspect of the present invention.
Figure 3:
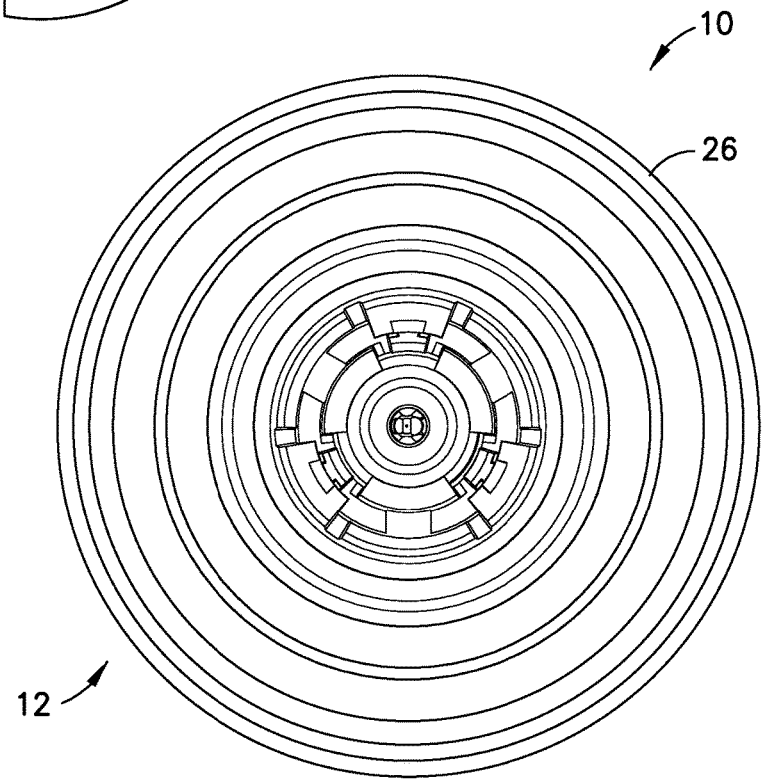
FIG. 3 is a bottom, assembled view of a system in accordance with an aspect of the present invention.

FIGS. 1-23 illustrate an exemplary aspect of the present disclosure. Referring to FIGS. 1 and 2, a system 10 for the closed transfer of fluids includes a vial access device 12 and an adapter 14 sized for movement within the vial access device 12 as described in more detail below. In one aspect, vial access device 12 includes outer housing 16, inner housing 18, connector 20, top cap housing 22, and pressure equalization system 24. System 10 provides a device capable of accommodating a plurality of vials having different sizes. System 10 also provides substantially leak-proof sealing and pressure equalization during engagement of a cannula with a vial, during transfer of a substance from a vial chamber to a barrel chamber via the cannula, and during disengagement of the cannula from the vial. The leak-proof sealing of the system 10 substantially prevents leakage of both air and liquid during use of the system 10. System 10 is compatible with a needle and syringe assembly for accessing a medication contained within a vial for administering the medication to a patient. System 10 is also compatible to be used with a drug reconstitution system.

Figure 13:
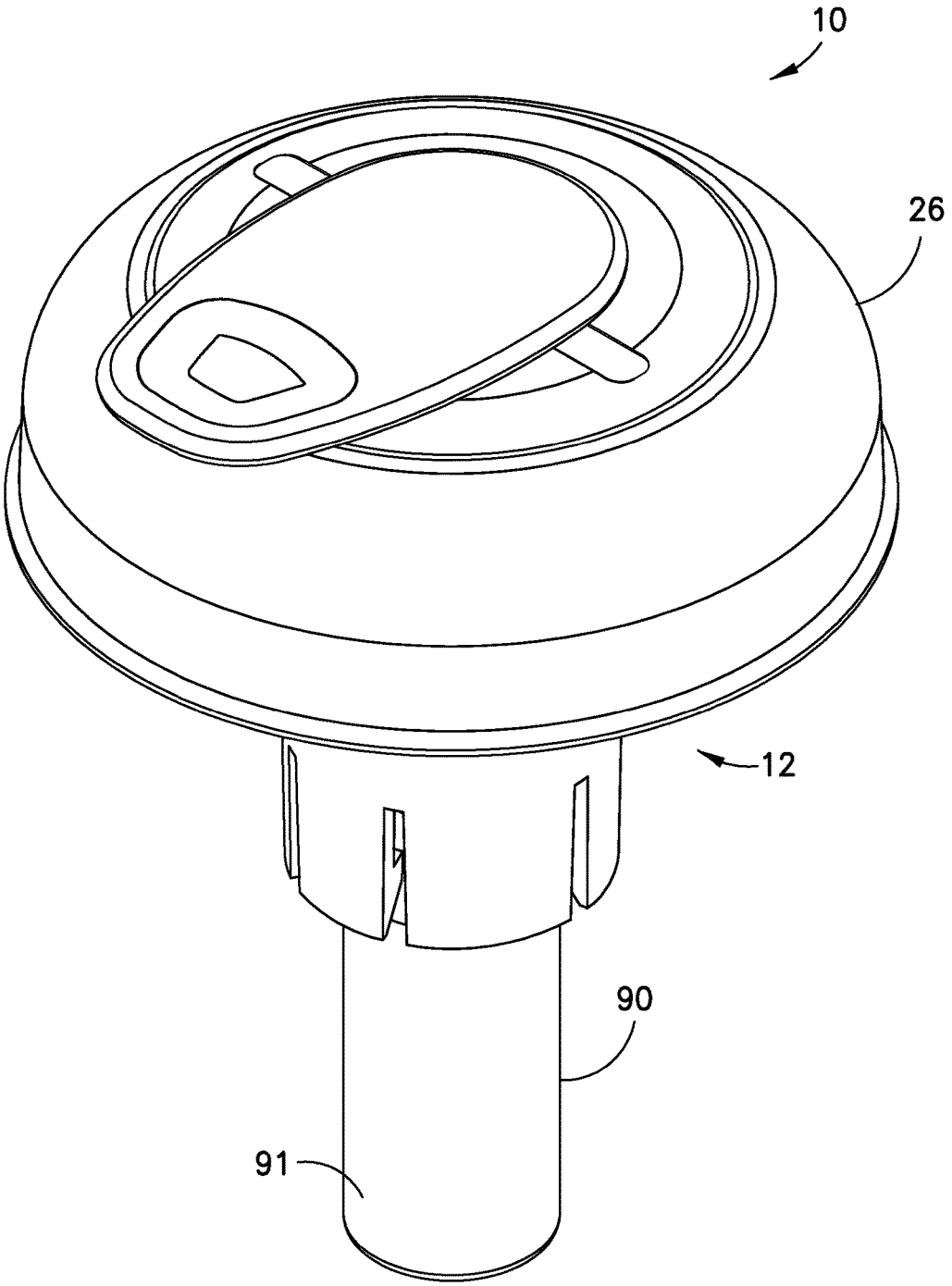
FIG. 13 is a perspective view of a system of the present disclosure connected to a first vial in accordance with an aspect of the present invention.
Figure 14:
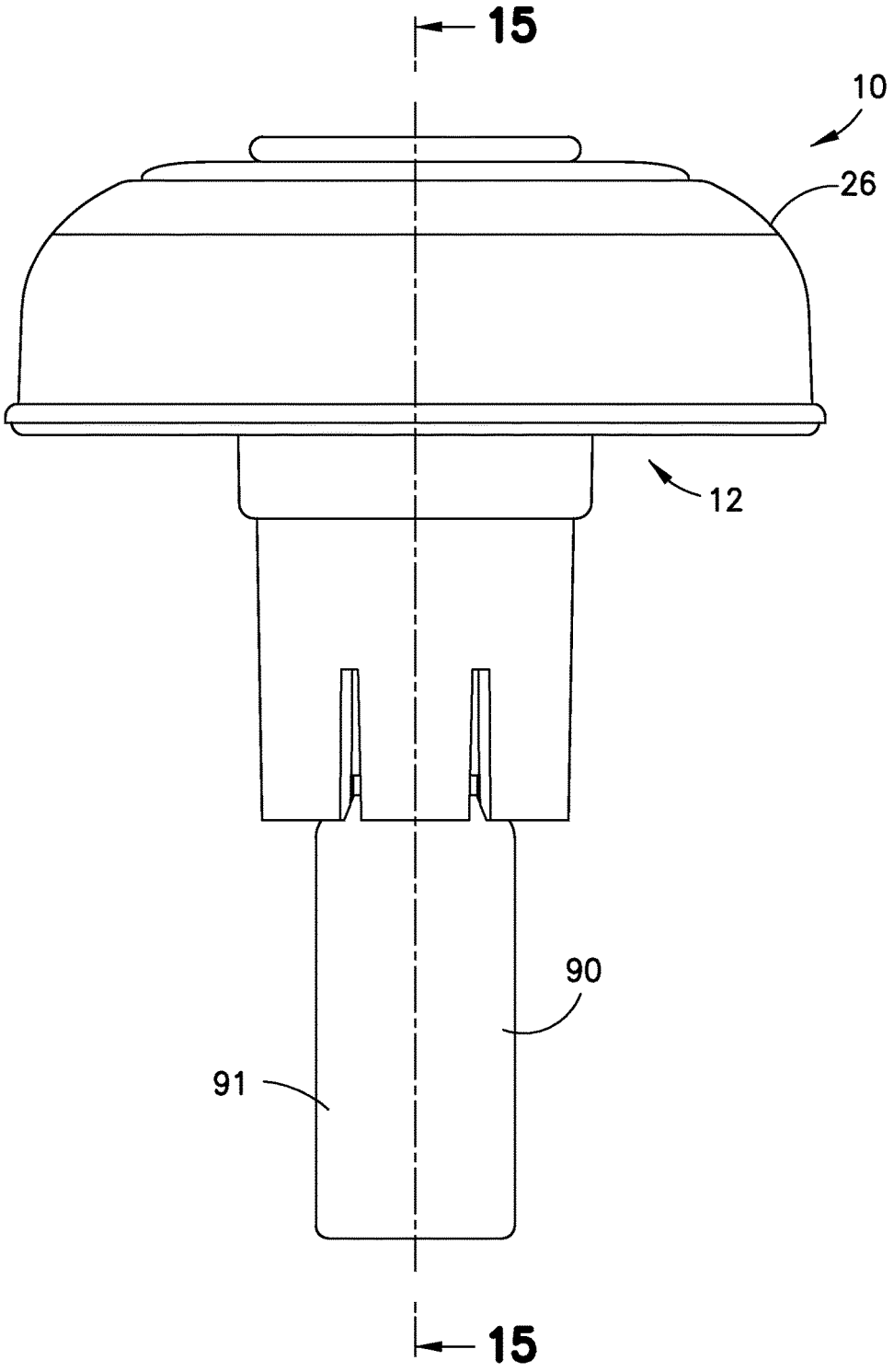
FIG. 14 is a side elevation view of a system of the present disclosure connected to a first vial in accordance with an aspect of the present invention.
Figure 15:
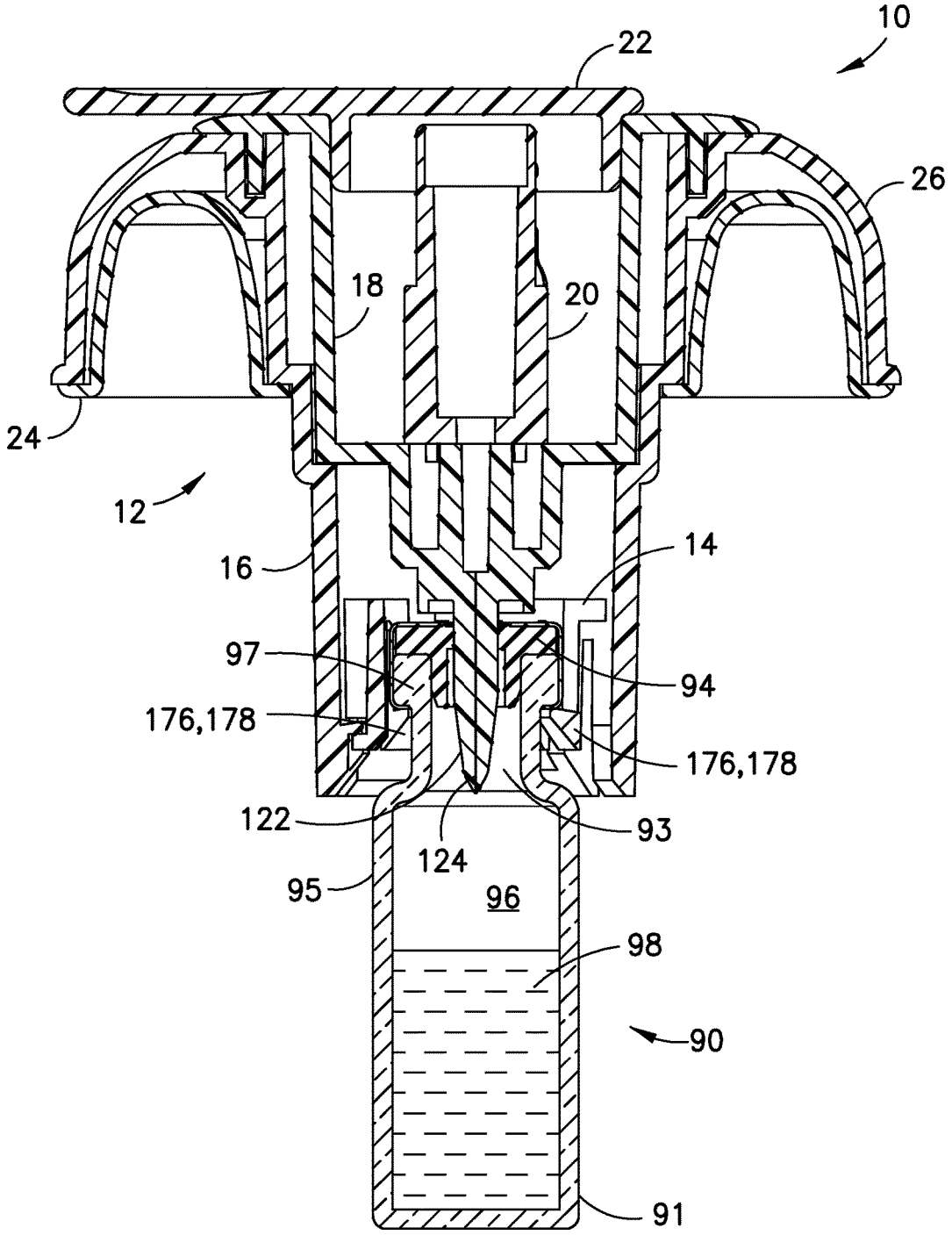
FIG. 15 is a cross-sectional view of the system connected to a first vial taken along line 15-15 of FIG. 14 in accordance with an aspect of the present invention.

Referring to FIGS. 1-4C, vial access device 12 includes a vial access housing 26 having outer housing 16 and inner housing 18. System 10 provides a device capable of accommodating a plurality of vials having different sizes. Vial access device 12 is configured to establish fluid communication between a first container, e.g., a first vial having a first vial size, and a: second container, e.g., an injector and/or syringe assembly. For example, vial access device 12 is attachable to a first vial 80 as described in more detail below. Referring to FIGS. 16-19, first vial 80 defining a first vial size 81 may be a standard drug vial of any type having an open head portion 83 covered by a pierceable septum 84 of an elastomeric material. Walls 85 of first vial 80 define a vial chamber 86 for containing a first substance 88. First vial 80 includes a flange 87 located adjacent open head portion 83. Vial septum 84 is engaged with head portion 83 of first vial 80 to seal the first substance 88 within vial chamber 86. Furthermore, adapter 14 of system 10 is configured to establish fluid communication between a first container, e.g., a second vial having a second vial size, and a second container, e.g., an injector and/or syringe assembly. For example, adapter 14 of system 10 is attachable to a second vial 90 as described in more detail below. Referring to FIGS. 13-15, second vial 90 defining a second vial size 91 may be a standard drug vial of any type having an open head portion 93 covered by a pierceable septum 94 of an elastomeric material. Walls 95 of second vial 90 define a vial chamber 96 for containing a second substance 98. Second vial 90 includes a flange 97 located adjacent open head portion 93. Vial septum 94 is engaged with head portion 93 of second vial 90 to seal the second substance 98 within vial chamber 96.

Figure 5A:
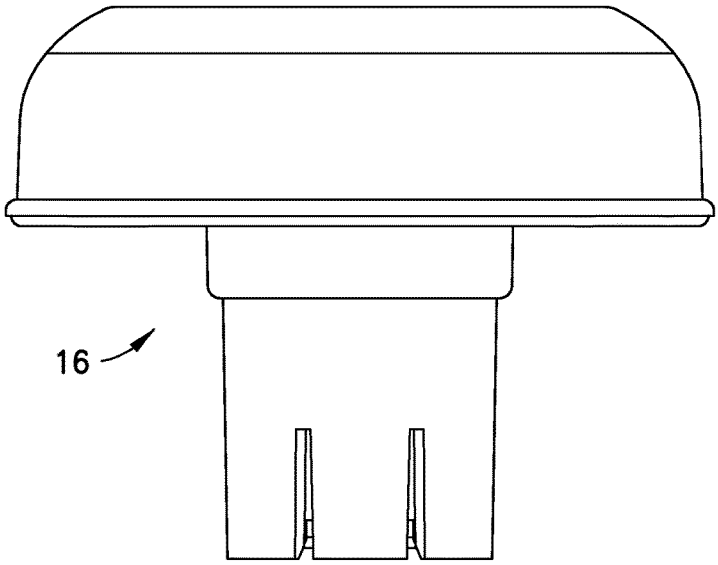
FIG. 5A is a perspective view of an outer housing in accordance with an aspect of the present invention.
Figure 5B:
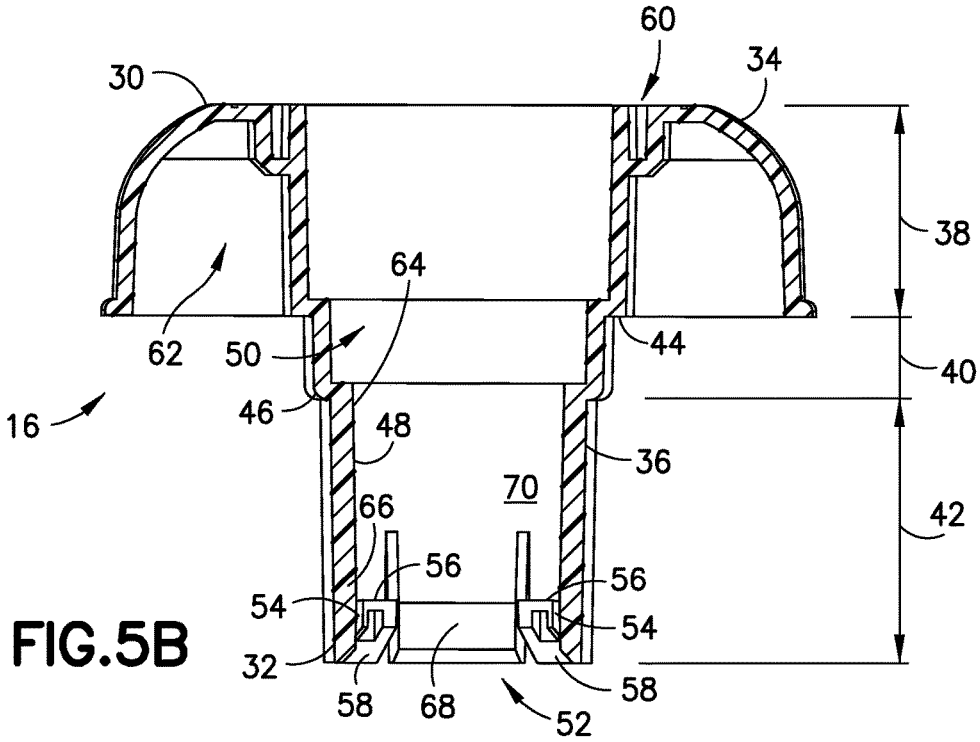
FIG. 5B is a cross-sectional view of the outer housing of FIG. 5A in accordance with an aspect of the present invention.

Referring to FIGS. 5A and 5B, outer housing 16 generally includes a first or proximal end 30; an opposing second or distal end 32; an outer annular ring portion 34; an inner neck portion 36 having a first region 38, a second region 40, and a third region 42; a first shoulder 44 disposed between first region 38 and second region 40; a second shoulder 46 disposed between second region 40 and third region 42; a wall 48 defining an elongate aperture 50; and a vial connection element 52 comprising vial grip members 54, hook protrusions 56, and angled walls 58.

Figure 6A:
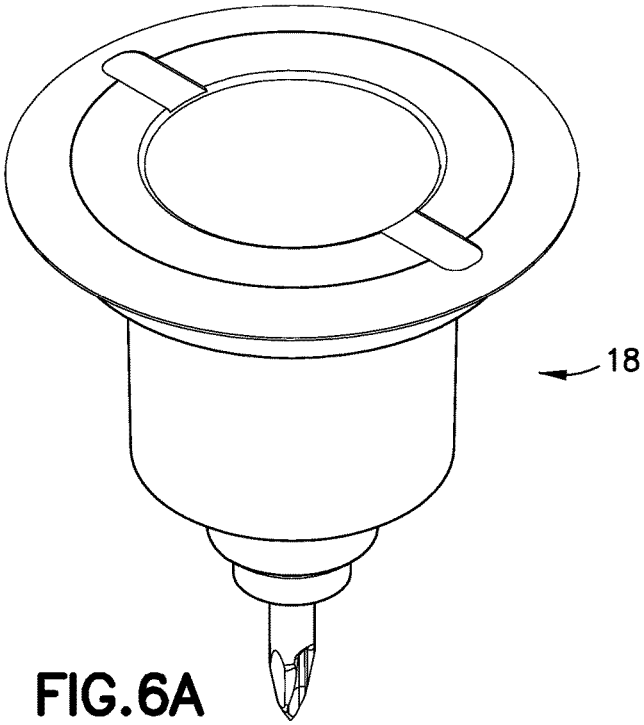
FIG. 6A is a perspective view of an inner housing in accordance with an aspect of the present invention.
Figure 6B:
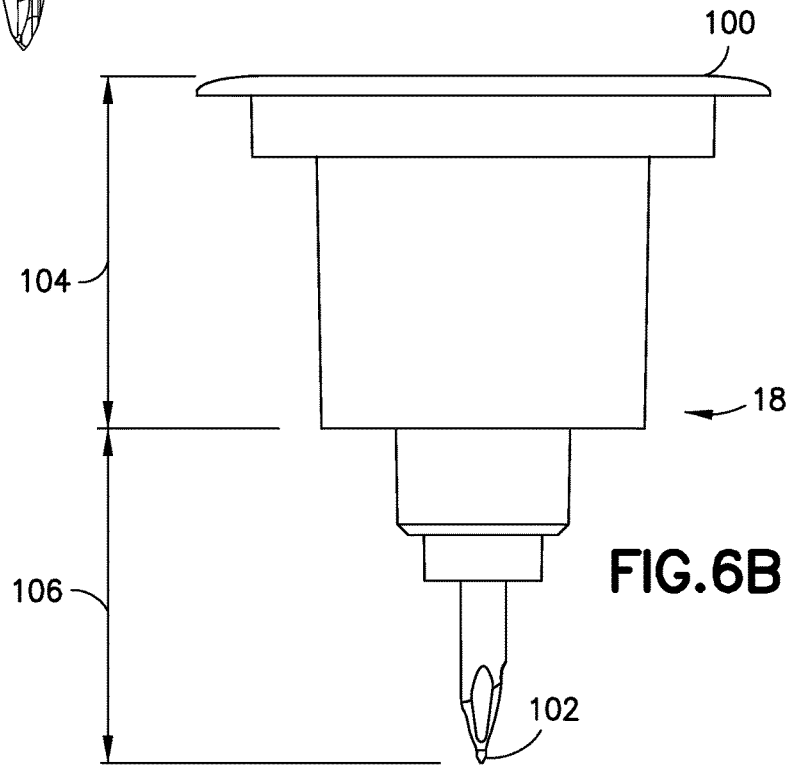
FIG. 6B is a side elevation view of an inner housing in accordance with an aspect of the present invention.
Figure 6C:
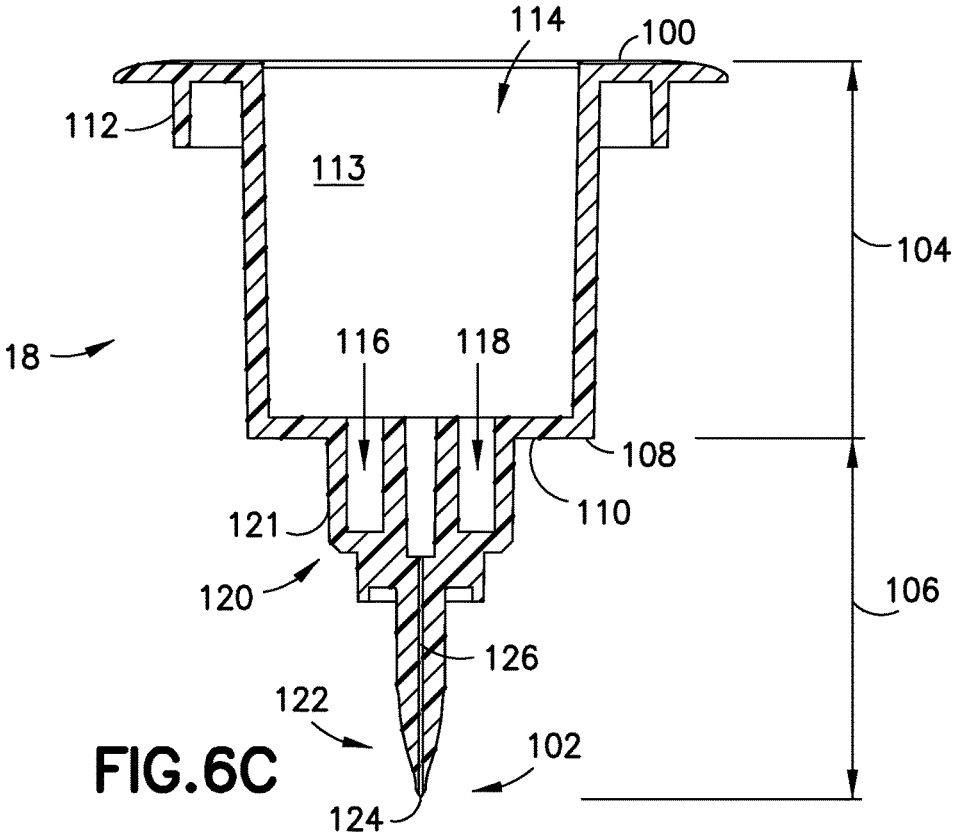
FIG. 6C is a cross-sectional view of the inner housing of FIG. 6A in accordance with an aspect of the present invention.
Figure 6D:
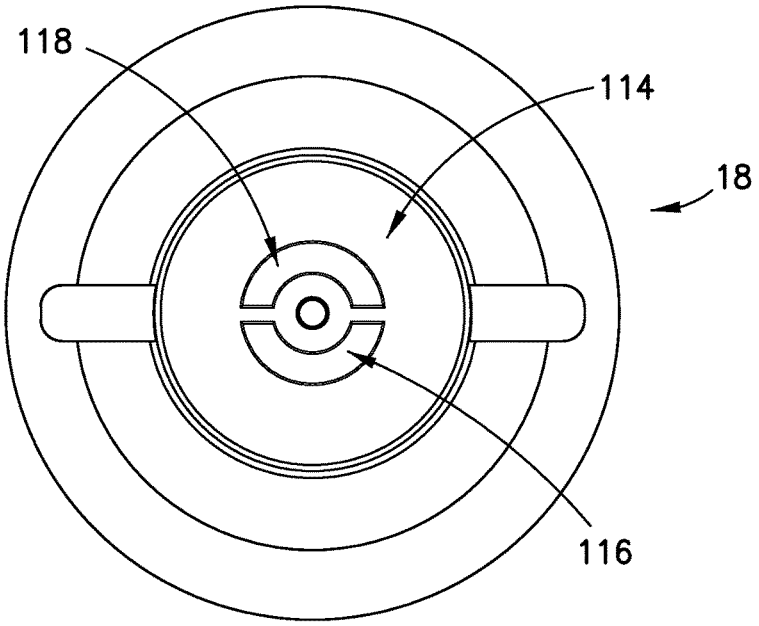
FIG. 6D is a top view of an inner housing in accordance with an aspect of the present invention.
Figure 7:
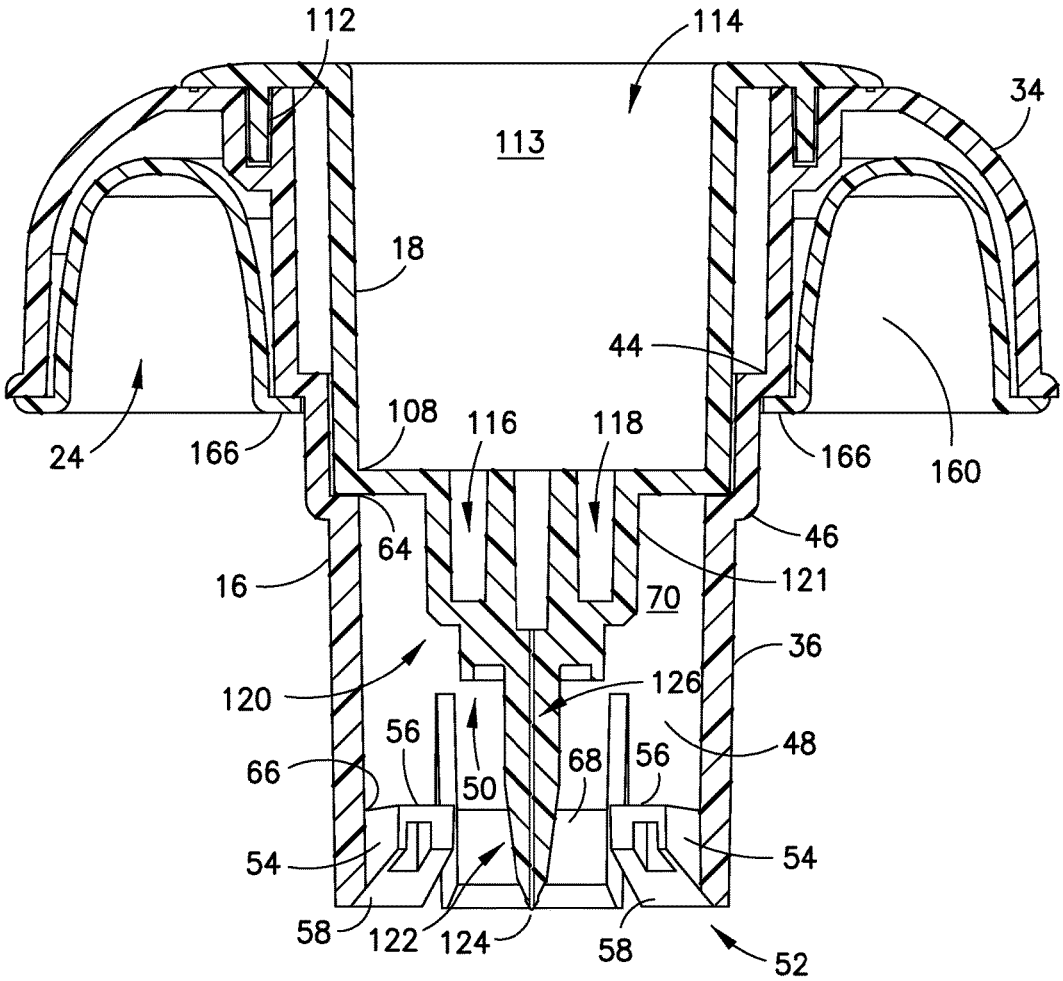
FIG. 7 is a cross-sectional view of a system in accordance with an aspect of the present invention.

Referring to FIG. 5B, inner neck portion 36 of outer housing 16 includes first region 38, second region 40, and third region 42. Outer annular ring portion 34 extends from first region 38 as shown in FIG. 5B. First shoulder 44 is disposed between first region 38 and second region 40 and is configured to provide an engagement surface with a flange portion 166 of a pressure equalization housing 160 as shown in FIG. 7. Second shoulder 46 is disposed between second region 40 and third region 42 and is configured to provide an engagement surface with a horizontal wall 110 of inner housing 18 as shown in FIG. 6C. Vertical wall 48 of third region 42 defines elongate aperture 50. Referring to FIG. 7, in one aspect, vertical wall 48 defines elongate aperture 50 between an aperture proximal end 64 and an aperture distal end 66.

Figure 18:
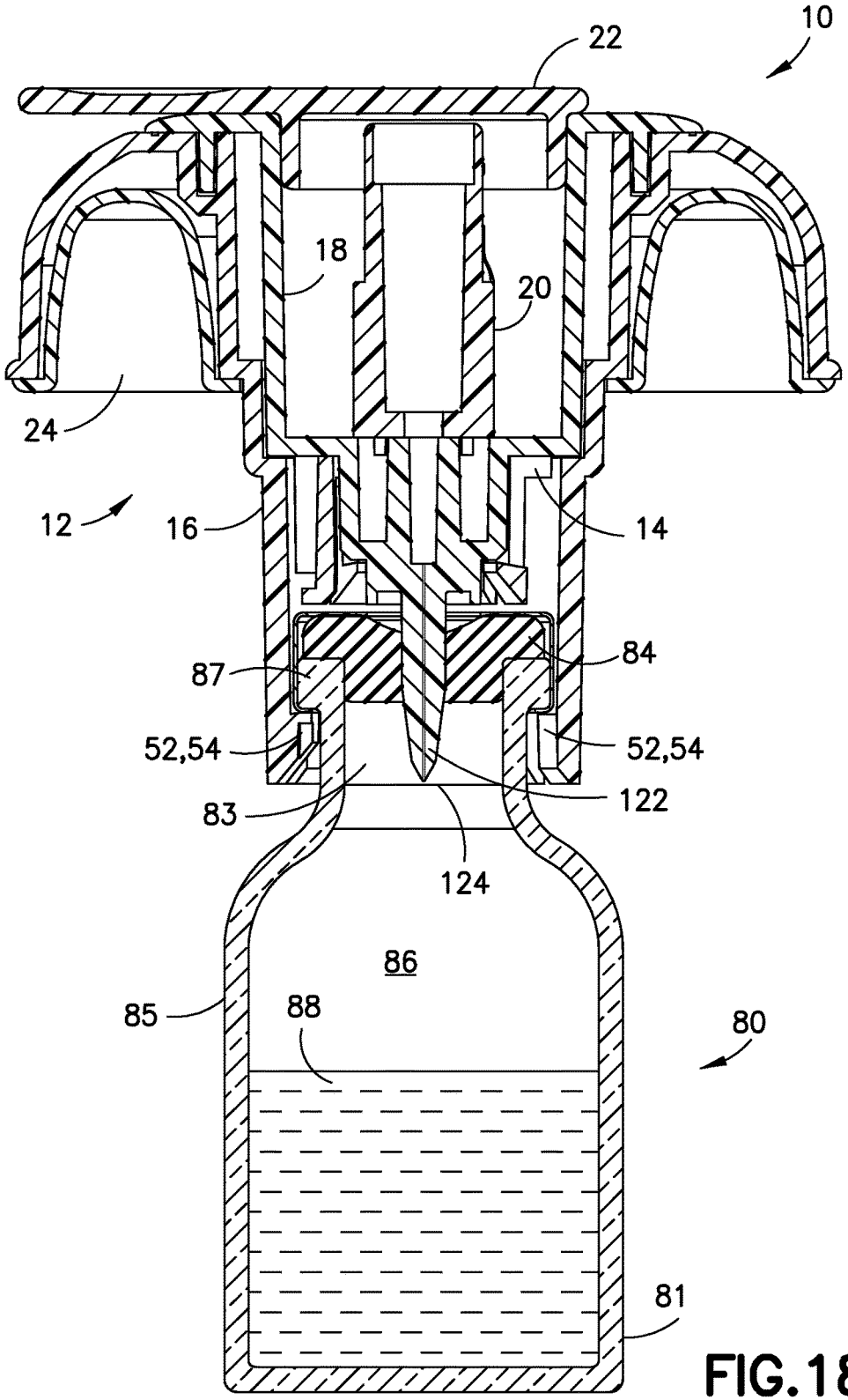
FIG. 18 is a cross-sectional view of the system connected to a second vial taken along line 18-18 of FIG. 17 in accordance with an aspect of the present invention.

Referring to FIG. 5B, a vial connection element 52 is disposed at second end 32 of outer housing 16. In one aspect, vial connection element 52 includes a plurality of vial grip members 54 having hook protrusions 56 and angled walls 58. In one aspect, vial grip members 54 are elastically deformable. Vial grip members 54 are attachable to a first vial 80 to secure vial access device 12 to the first vial 80. Each vial grip member 54 includes a hook protrusion 56 arranged to engage a corresponding flange 87 on a container such as first vial 80 as shown in FIG. 18. Vial connection element 52 of vial access device 12 may be dimensioned to be attached to containers of any size and volume. In other aspects, vial connection element 52 of vial access device 12 may include other connection mechanisms for securing vial access device 12 to first vial 80 such as a threaded portion, a snap fit mechanism, locking tabs, or other similar mechanism. Each vial grip member 54 includes an angled wall 58 arranged to provide a lead-in surface to center and align vial access device 12 on a vial.

Referring to FIG. 5B, a locking member or adapter engagement portion 68 is disposed on an interior surface 70 of wall 48 at second end 32 of outer housing 16. Adapter engagement portion 68 acts as a physical barrier to prevent adapter 14 from being removed from within elongate aperture 50. Adapter 14 is sized for movement within elongate aperture 50 of vial access housing 26 and adapter engagement portion 68 prevents adapter 14 from being removed from elongate aperture 50. In one aspect, adapter engagement portion 68 comprises a protrusion.

Referring to FIG. 5B, outer annular ring portion 34 of outer housing 16 includes an annular groove 60 for receiving an annular protrusion 112 of inner housing 18, as described in more detail below. Outer annular ring portion 34 also includes a pressure equalization receiving area 62 for receiving pressure equalization system 24 as described in more detail below.

Referring to FIGS. 6A-6D, inner housing 18 generally includes a first or proximal end 100; an opposing second or distal end 102; a first region 104 and a second region 106; a first shoulder 108 disposed between first region 104 and second region 106; horizontal wall 110 disposed between first region 104 and second region 106; annular protrusion 112 disposed at first end 100; a first region wall 113 defining a cavity 114; a first groove cavity 116 and a second groove cavity 118 within an adapter receiving portion 120; a second region wall 121; a spike member 122 including a piercing tip 124; and a fluid transfer channel 126.

Referring to FIG. 6C, inner housing 18 includes first region 104 and second region 106. First shoulder 108 is disposed between first region 104 and second region 106 and is configured to engage second shoulder 46 of outer housing 16 as shown in FIG. 7. In this manner, second shoulder 46 of outer housing 16 acts as a physical barrier to prevent inner housing 18 from significant relative movement relative to outer housing 16 as shown in FIG. 7.

Referring to FIG. 6C, annular protrusion 112 extends downward from first end 100 of inner housing 18. Referring to FIG. 7, annular protrusion 112 of inner housing 18 is received within annular groove 60 of annular ring portion 34 of outer housing 16. In this manner, the engagement of annular protrusion 112 of inner housing 18 within annular groove 60 of outer housing 16 secures inner housing 18 to outer housing 16 and prevents inner housing 18 from significant relative movement relative to outer housing 16 as shown in FIG. 7.

Referring to FIG. 6C, horizontal wall 110 is disposed between first region 104 and second region 106. Referring to FIG. 7, horizontal wall 110 together with vertical wall 48 of outer housing 16 defines elongate aperture 50 between an aperture proximal end 64 and an aperture distal end 66.

Referring to FIG. 6C, protruding out from second region wall 121 at second end 102 of inner housing 18 is a piercing member or spike member 122 which includes piercing tip 124. Referring to FIG. 6C, a fluid transfer channel 126 extends through spike member 122 and adapter receiving portion 120 such that piercing tip 124 is in fluid communication with cavity 114 of inner housing 18. The purpose of fluid transfer channel 126 is to permit a needle cannula to extend through vial access device 12 and to thereby permit fluid to be transferred through vial access device 12. In other aspects, fluid transfer channel 126 may be embodied as any other suitable fluid transfer channel arrangement.

Figure 4A:
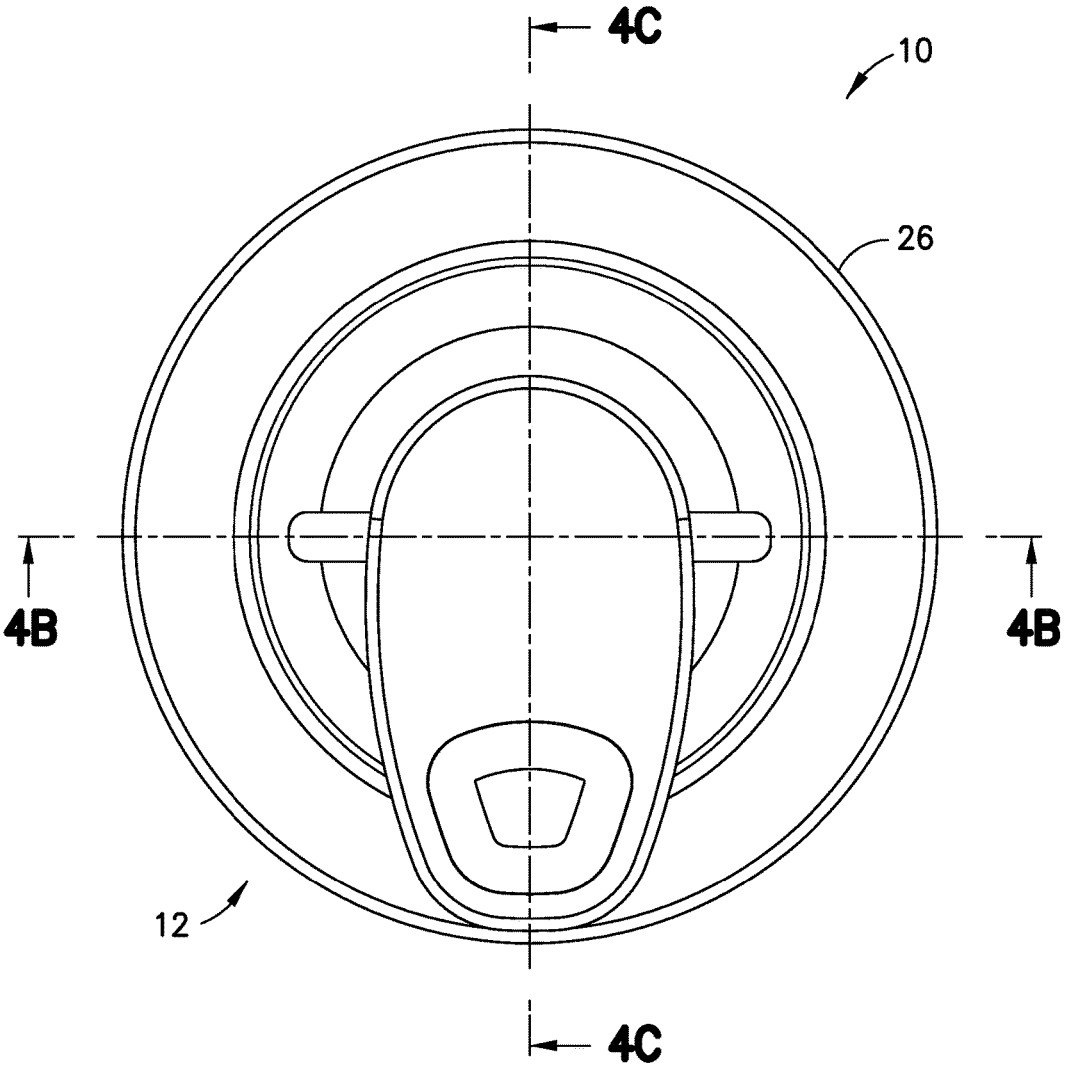
FIG. 4A is a top, assembled view of a system in accordance with an aspect of the present invention.
Figure 4B:
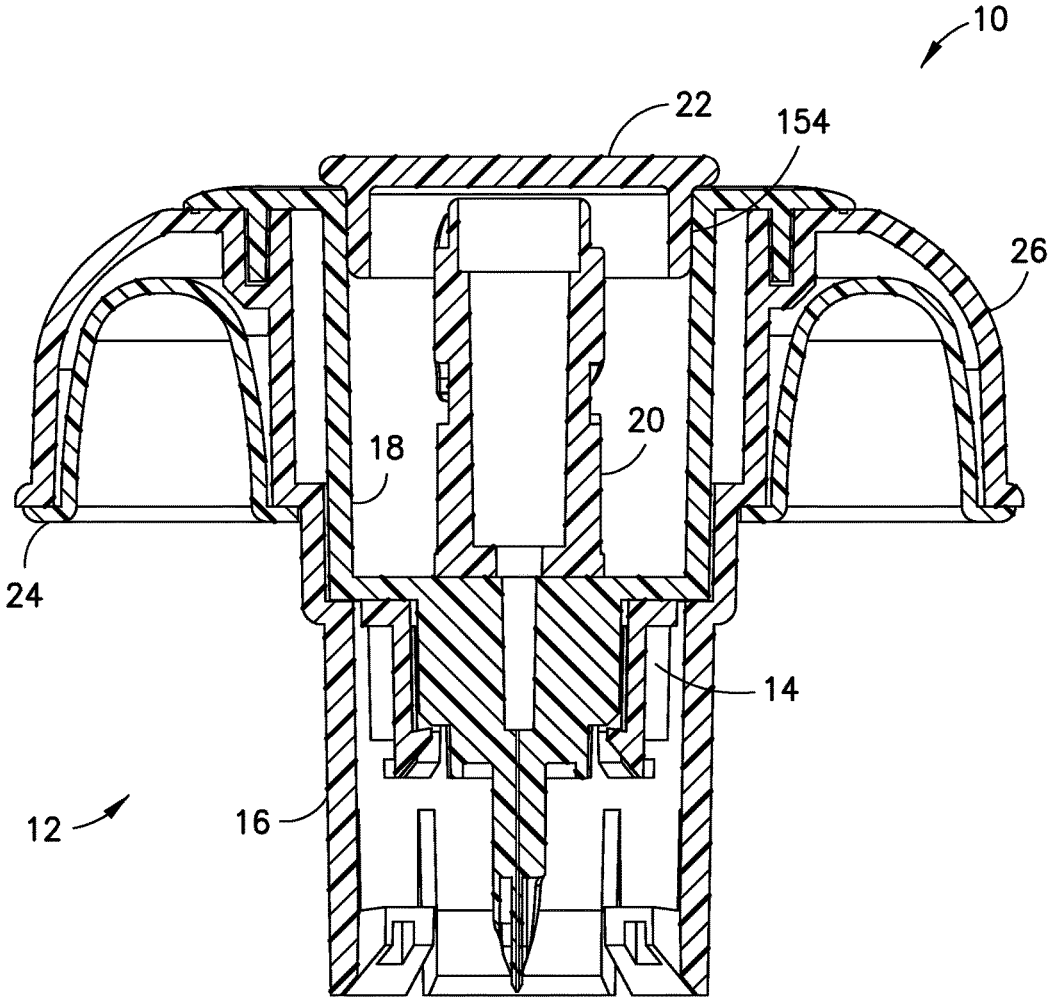
FIG. 4B is a cross-sectional view of the system taken along line 4B-4B of FIG. 4A in accordance with an aspect of the present invention.
Figure 4C:
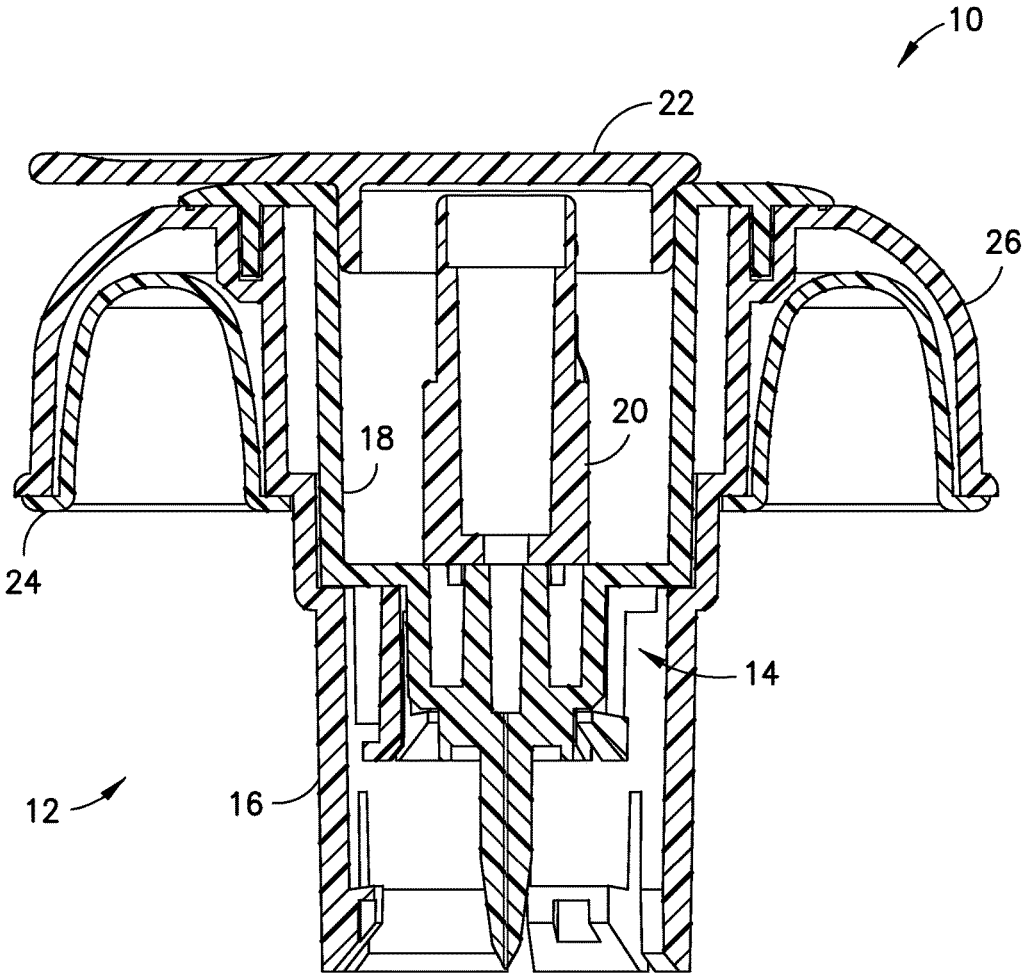
FIG. 4C is a cross-sectional view of the system taken along line 4C-4C of FIG. 4A in accordance with an aspect of the present invention.
Figure 11:
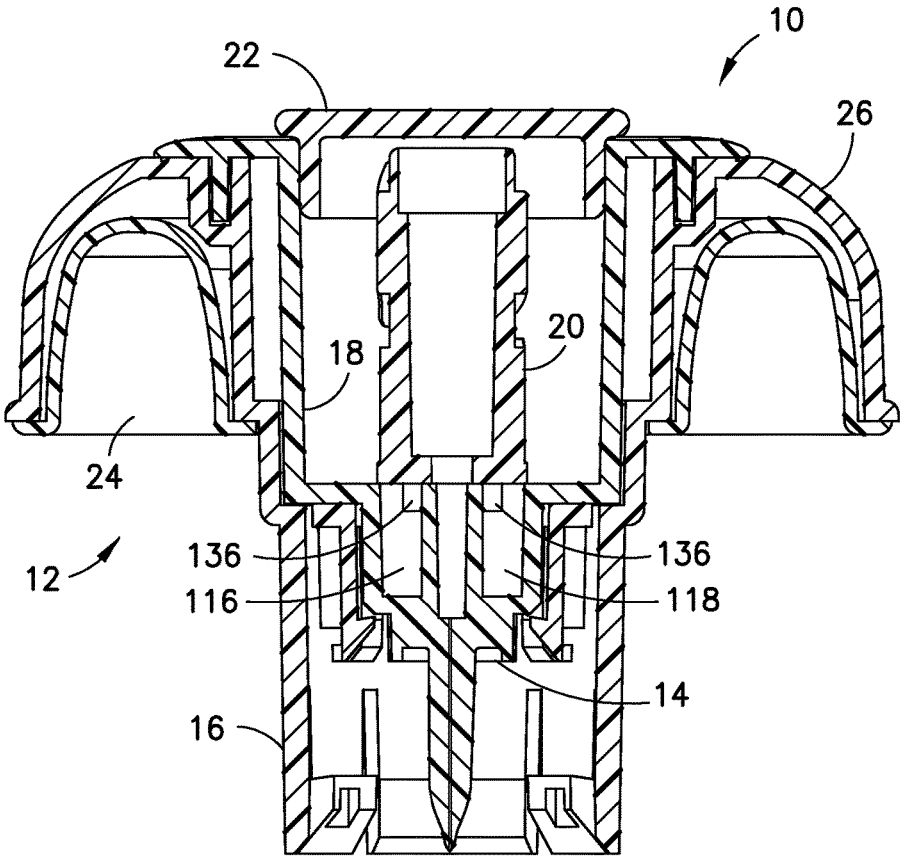
FIG. 11 is a cross-sectional view of a system in accordance with an aspect of the present invention.

Referring to FIG. 6C, first region wall 113 defines cavity 114. Cavity 114 receives connector 20 and top cap housing 22 as shown in FIG. 4B. In one aspect, cavity 114 receives top cap housing 22 by an interference fit between the exterior wall surface of a sidewall 154 of top cap housing 22 and the interior wall surface of first region wall 113 as shown in FIGS. 4B and 4C. First groove cavity 116 and second groove cavity 118 also receive respective bottom protrusions 136 of connector 20 as shown in FIGS. 4C and 11. In this manner, the engagement of bottom protrusions 136 of connector 20 within respective first groove cavity 116 and second groove cavity 118 secures connector 20 to inner housing 18 and prevents connector 20 from significant relative movement relative to inner housing 18 as shown in FIGS. 4B and 4C.

Referring to FIGS. 4B, 4C, and 7, as described above, inner housing 18 is attachable to outer housing 16 by first shoulder 108 of inner housing 18 engaging second shoulder. 46 of outer housing 16 and by annular protrusion 112 of inner housing 18 being received within annular groove 60 of outer housing 16. In this manner, inner housing 18 is secured to outer housing 16 and inner housing 18 is prevented from significant relative movement relative to outer housing 16.

In one aspect, outer housing 16 and inner housing 18 may form a single integral component. In another aspect, outer housing 16 and inner housing 18 are separate components and inner housing 18 is attachable to outer housing 16 such that significant relative movement between outer housing 16 and inner housing 18 is prevented.

Referring to FIG. 7, with inner housing 18 secured to outer housing 16, spike member 122 extends in a direction substantially parallel with the plurality of vial grip members 54. Spike member 122 serves the purpose of piercing a fluid container such as first vial 80 during assembly of vial access device 12 to first vial 80 as shown in FIG. 18 and also serves the purpose of piercing a fluid container such as second vial 90 during assembly of vial access device 12 to second vial 90 as shown in FIG. 15.

Referring to FIGS. 8A-8G, in one aspect, connector 20 generally includes a first or proximal end 130; an opposing second or distal end 132; a membrane cavity 134 located at first end 130; a bottom protrusion 136 located at second end 132; and a locking groove 138. In other aspects, connector 20 comprises other connectors which are compatible with a closed system drug transfer device.

Referring to FIGS. 4B and 4C, as described above, connector 20 is attachable to inner housing 18 by cavity 114 of inner housing 18 receiving connector 20 and first groove cavity 116 and second groove cavity 118 also receiving respective bottom protrusions 136 of connector 20. In this manner, the engagement of bottom protrusions 136 of connector 20 within respective first groove cavity 116 and second groove cavity 118 secures connector 20 to inner housing 18 and prevents connector 20 from significant relative movement relative to inner housing 18 as shown in FIGS. 4B and 4C.

Figure 8A:
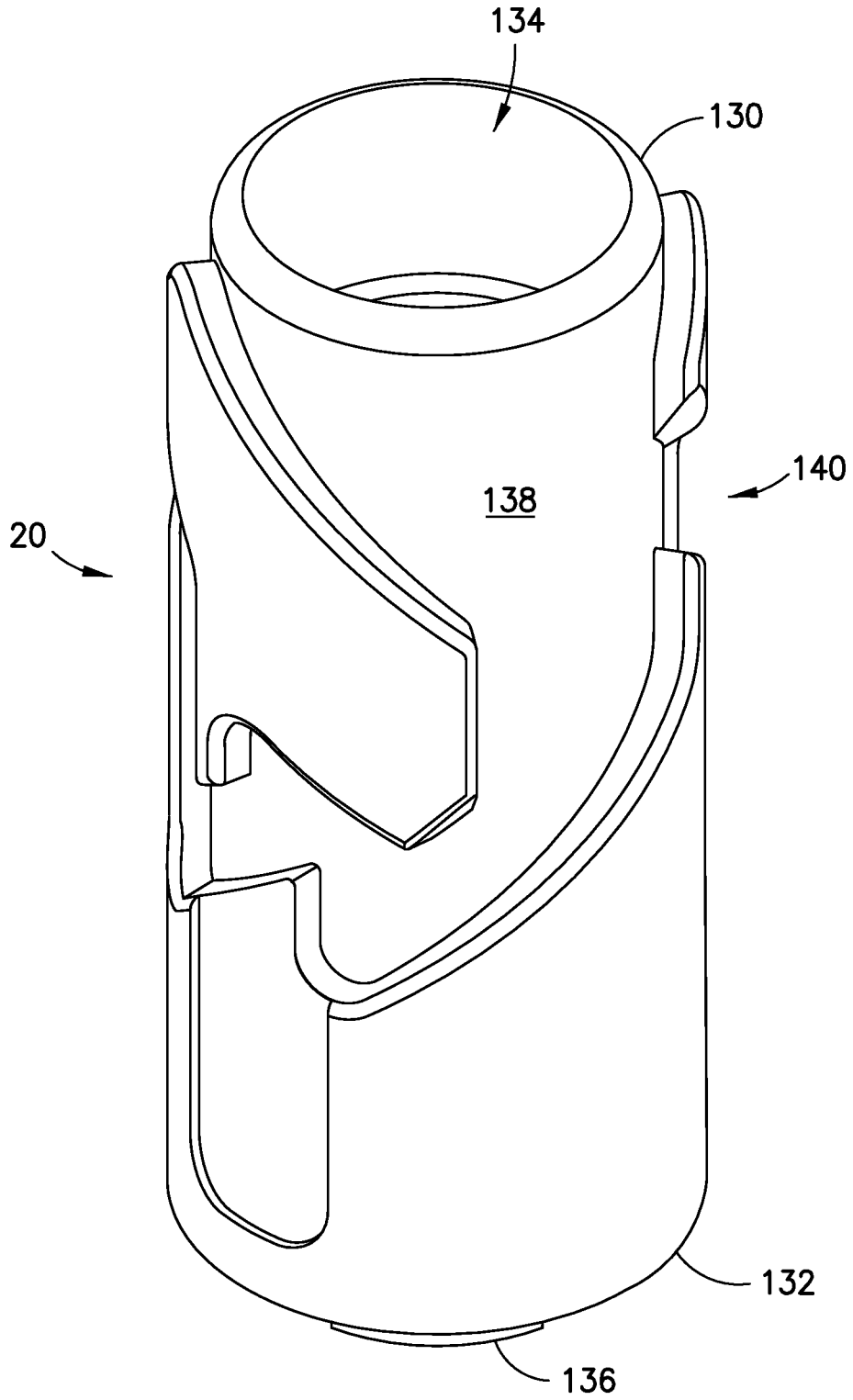
FIG. 8A is a perspective view of a connector in accordance with an aspect of the present invention.
Figure 8B:
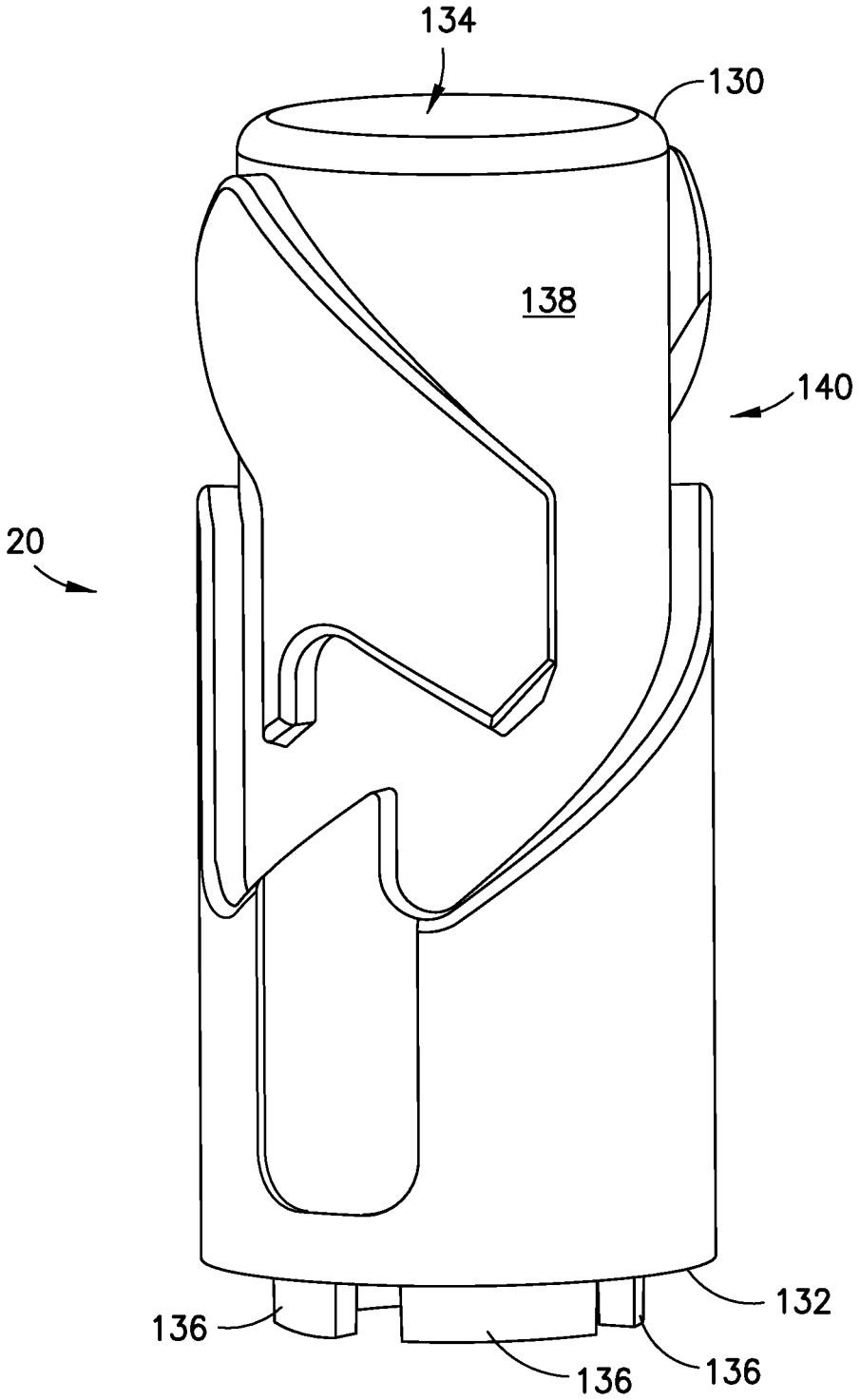
FIG. 8B is a side elevation view of a connector in accordance with an aspect of the present invention.
Figure 8C:
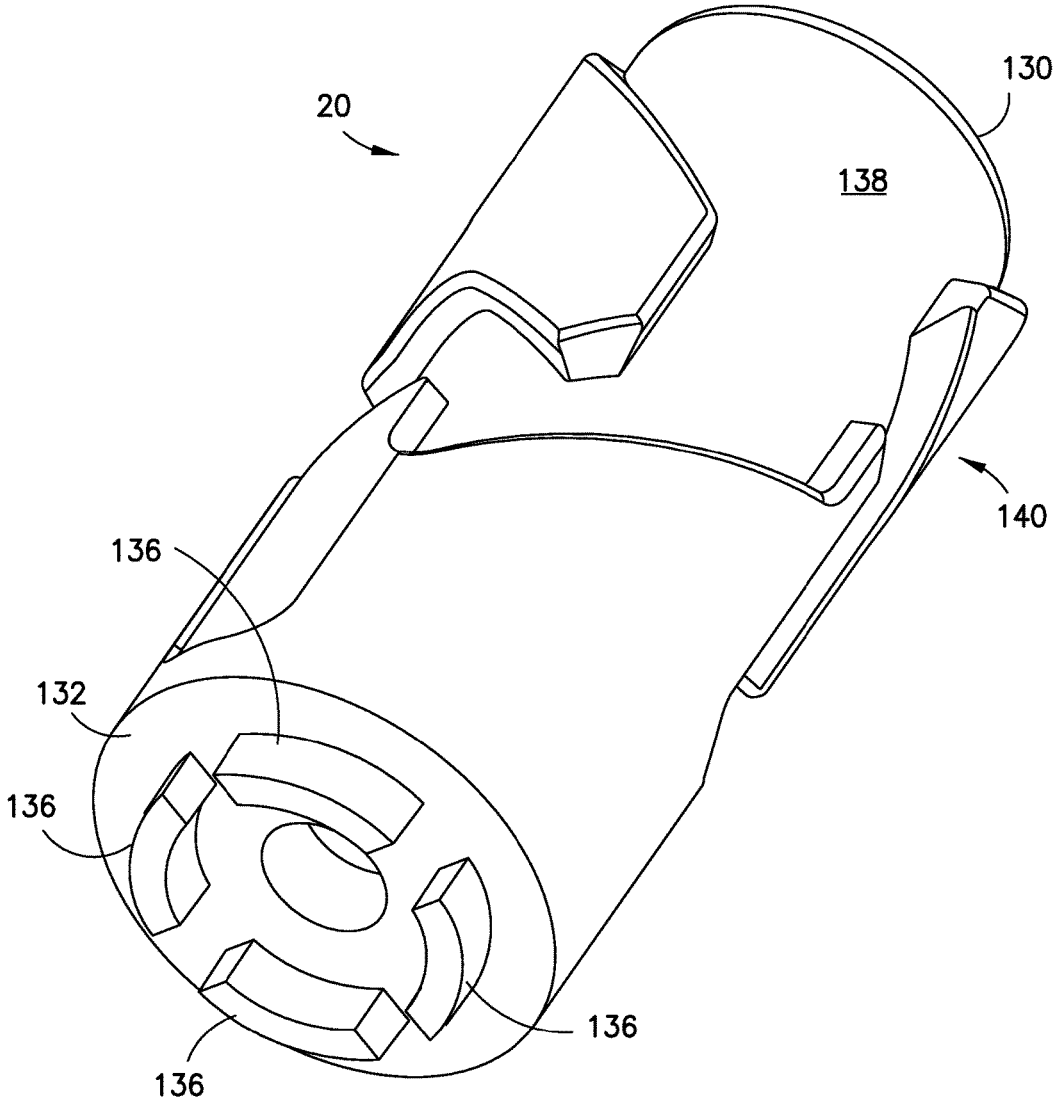
FIG. 8C is another perspective view of a connector in accordance with an aspect of the present invention.
Figure 8D:
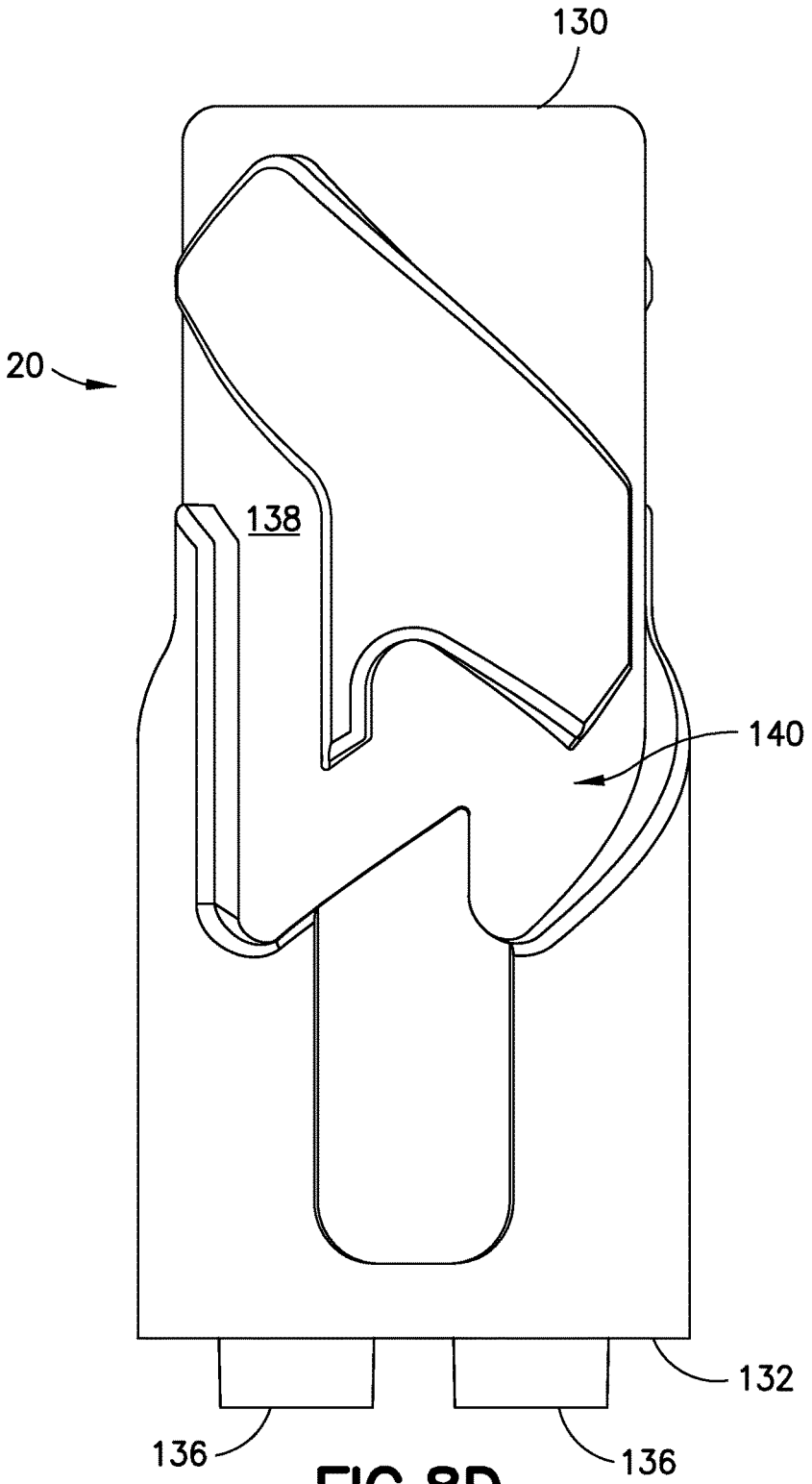
FIG. 8D is another side elevation view of a connector in accordance with an aspect of the present invention.
Figure 8E:
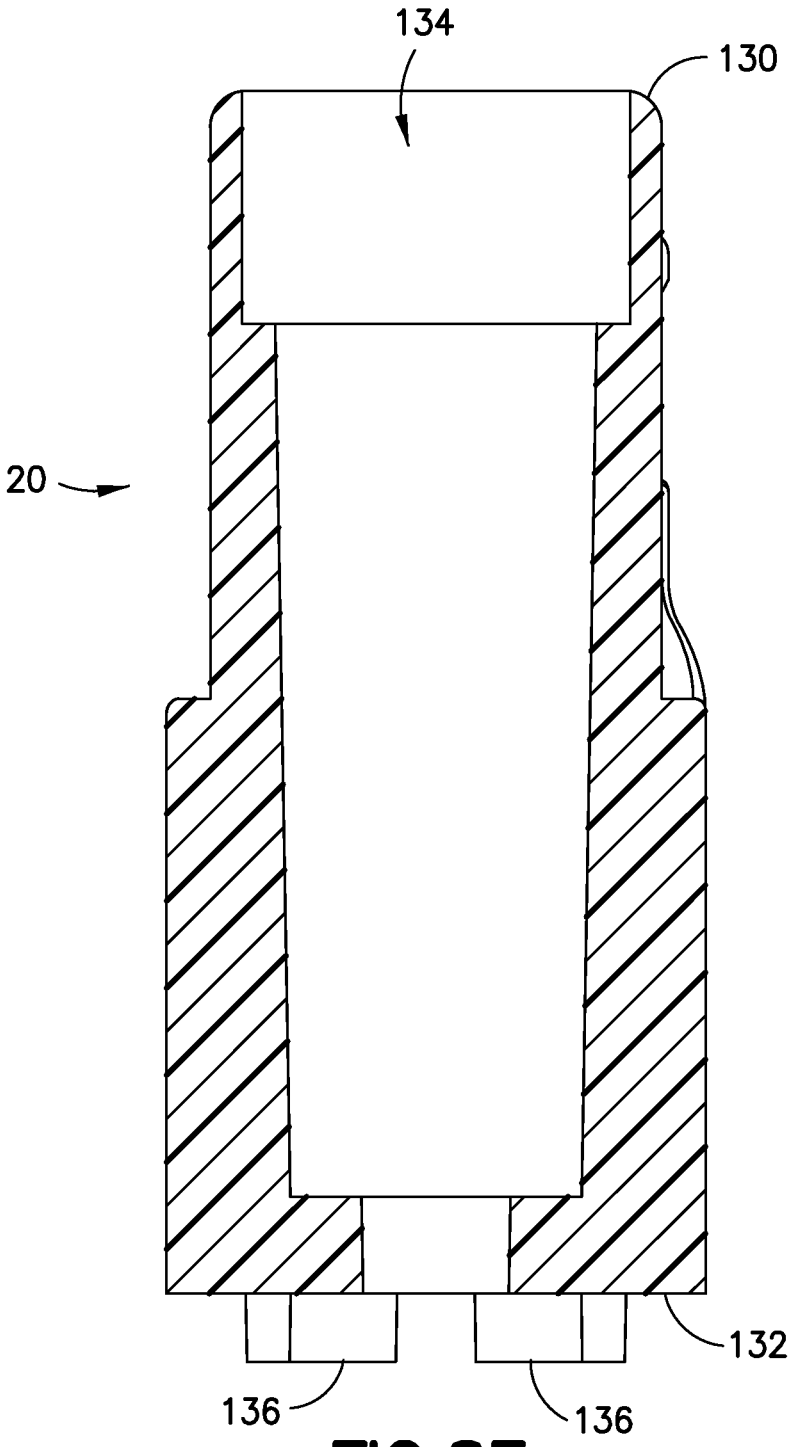
FIG. 8E is a partial-sectional view of the connector of FIG. 8A in accordance with an aspect of the present invention.
Figure 8F:
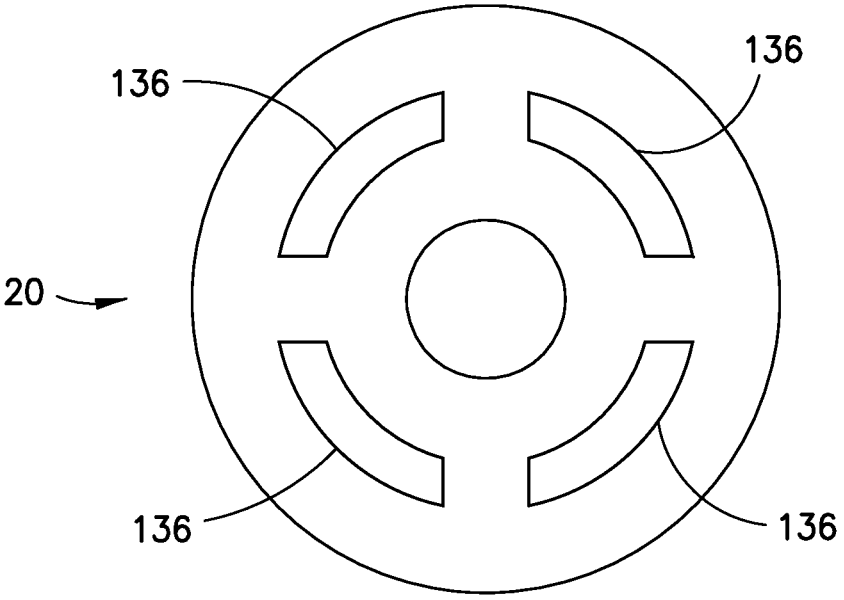
FIG. 8F is a bottom view of a connector in accordance with an aspect of the present invention.
Figure 8G:
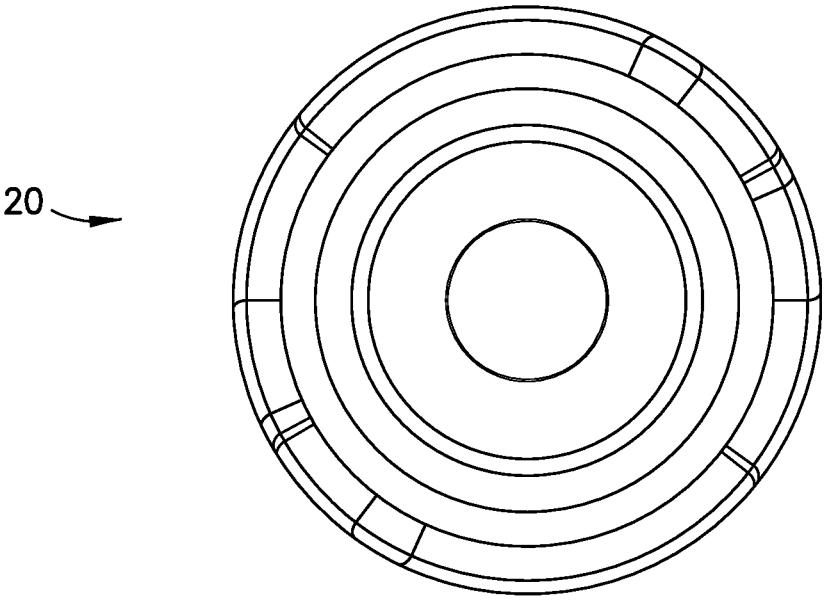
FIG. 8G is a top view of a connector in accordance with an aspect of the present invention.

Referring to FIG. 8A, connector 20 includes a connection element or connection system 140. In one aspect, connection system 140 comprises locking groove 138. Locking groove 138 of connector 20 is engageable with a portion of an injector or injector adapter, e.g., injector 27 gigs. 20 and 21), to secure the injector 27 to connector 20 and vial access device 12. Connection system 140 of connector 20 provides a secured attachment between vial access device 12 and an injector such that significant relative movement between the injector and vial access device 12 is prevented and such that a cannula of the injector is maintained in a leak-proof sealing system throughout the process of engaging the cannula with a vial. Although a specific arrangement for the connector 20 is shown, the connector 20 may be embodied as any other suitable connection arrangement.

Referring to FIGS. 4B and 4C, in one aspect, membrane cavity 134 of connector 20 may contain a pierceable barrier member. In other aspects, other suitable barrier members may be utilized. The pierceable barrier member provides for a liquid and gas tight seal between a piercing member and the pierceable barrier member during fluid transfer to minimize leakage and thereby prevent exposure of hazardous medicaments to a user. The pierceable barrier member provides a self-sealing seal that, with vial access device 12 attached to a vial, provides a leak-proof seal preventing any substance contained within the vial chamber from being exposed to a health care provider reconstituting, transporting, or administering a drug using system 10. In one aspect, the pierceable barrier member comprises a resilient material. For example, the pierceable barrier member is preferably a unitary device molded of any flexible, elastomeric material conventionally used for fabricating gas-proof closures. The pierceable barrier member may be formed of a natural rubber material, polyurethane elastomers, butyl rubbers, or similar materials. It is contemplated that the pierceable barrier member is formed of a material having a Shore A hardness of approximately 10 to 50. It is also envisioned that the pierceable barrier member can have other material hardness values that would provide an appropriate self-sealing material to provide a leak-proof seal with a vial septum of a vial and an injector, thereby preventing any liquid or medication residue from being exposed to a health care provider reconstituting, transporting, or administering a drug using system 10.

Figure 9A:
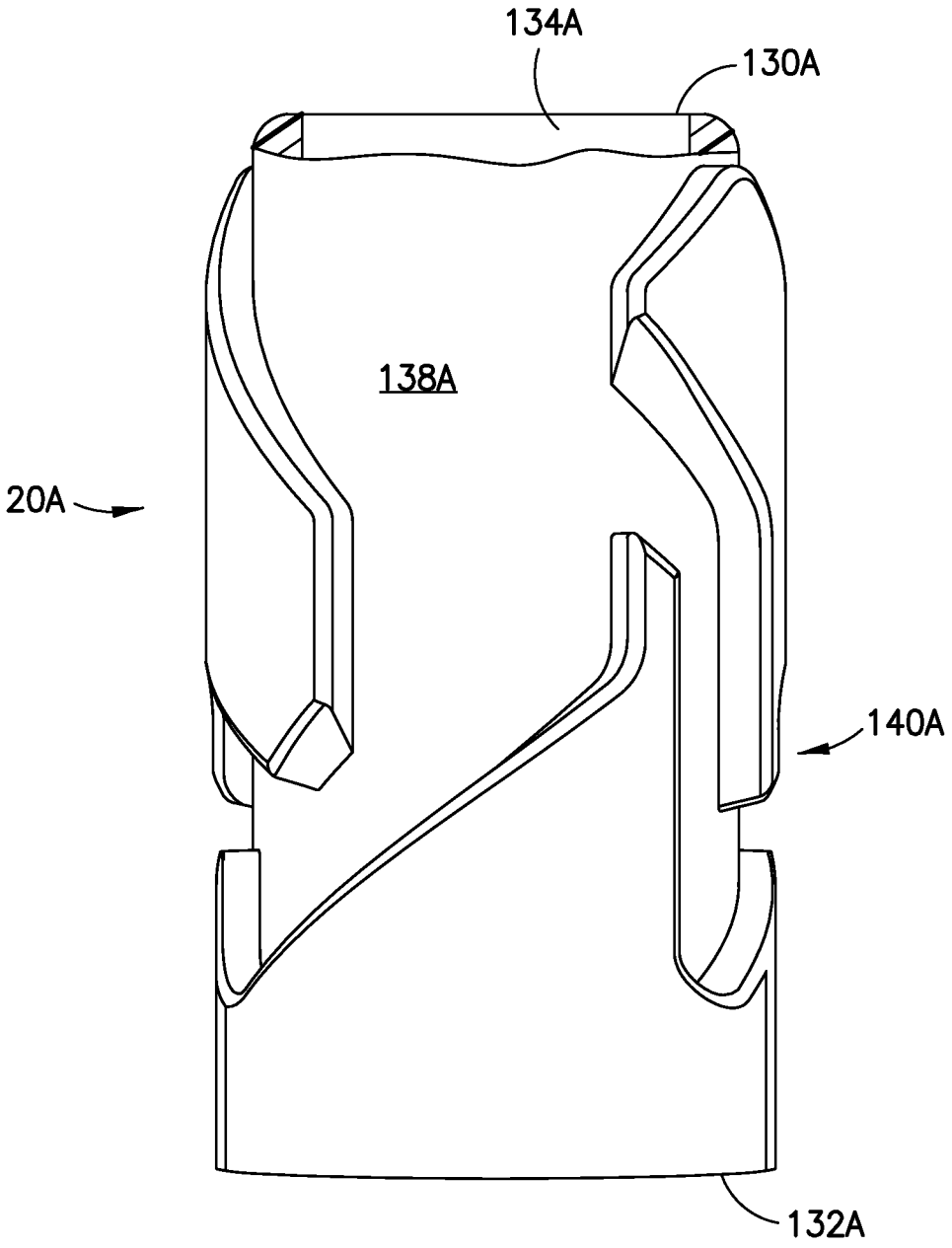
FIG. 9A is a side elevation view of a connector in accordance with another aspect of the present invention.
Figure 9B:
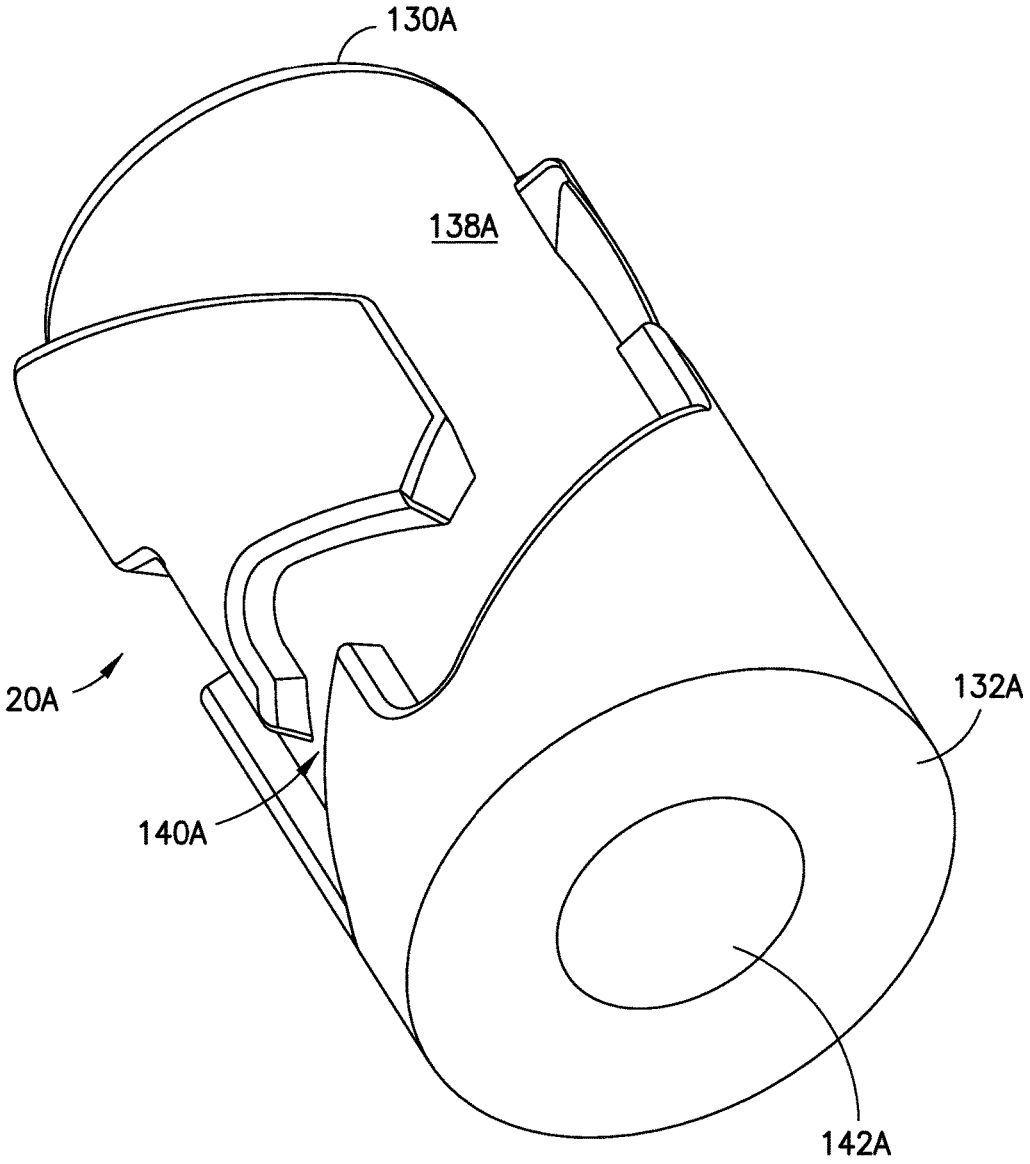
FIG. 9B is a perspective view of a connector in accordance with another aspect of the present invention.

FIGS. 9A and 9B illustrate another exemplary aspect of a connector of the present disclosure. The aspect illustrated in FIGS. 9A and 9B includes similar components to the aspect illustrated in FIGS. 8A-8G, and the similar components are denoted by a reference number followed by the letter A. For the sake of brevity, these similar components and the similar steps of using connector 20A (FIGS. 9A and 9B) will not all be discussed in conjunction with the aspect illustrated in FIGS. 9A and 9B.

Referring to FIGS. 9A and 9B, in one aspect, connector 20A includes a bottom aperture 142. Connector 20A is attachable to inner housing 18 by cavity 114 of inner housing 18 receiving connector 20A and bottom aperture 142 of connector 20A being locked over a protrusion on inner housing 18 to secure connector 20A to inner housing 18 and prevent connector 20A from significant relative movement relative to inner housing 18.

Figure 10:
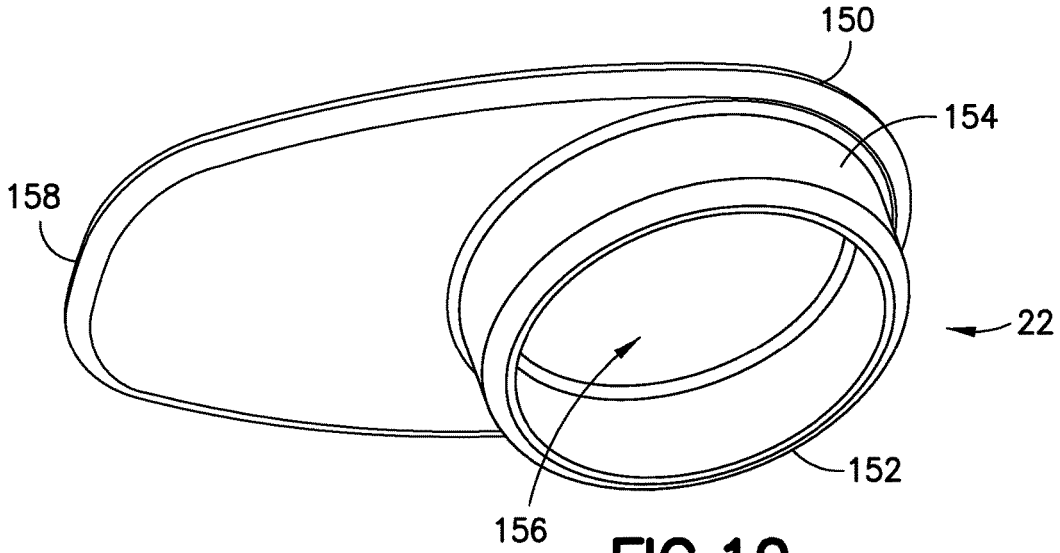
FIG. 10 is a perspective view of a top cap housing in accordance with an aspect of the present invention.

Referring to FIG. 10, in one aspect, top cap housing 22 generally includes a first or proximal end 150; an opposing second or distal end 152; a sidewall 154 extending between first end 150 and second end 152 and defining a connector receiving portion 156; and a handle portion 158. In other aspects, top cap housing 22 comprises other covers which are compatible with a closed system drug transfer device. For example, top cap housing 22 may be embodied as any other suitable cover arrangement.

Referring to FIGS. 4B and 4C, as described above, top cap housing 22 is attachable to first end 100 of inner housing 18 by cavity 114 of inner housing 18 receiving top cap housing 22 by an interference fit between the exterior wall surface of sidewall 154 of top cap housing 22 and the interior wall surface of first region wall 113 as shown in FIGS. 4B and 4C. With connector 20 and top cap housing 22 properly positioned within inner housing 18, first end 130 of connector 20 is received within connector receiving portion 156 of top cap housing 22 as shown in FIGS. 4B and 4C.

With top cap housing 22 properly secured to inner housing 18 as described above, the top cap housing seals vial access device 12, i.e., top cap housing 22 provides a substantially impermeable enclosure with respect to vial access device 12, provides a leak prevention and protection enclosure, protects the contents of vial access device 12, and/or maintains a sealed, sterilized environment within vial access device 12. Top cap housing 22 provides a sufficient seal at a range of temperatures, pressures, and humidity levels.

Referring to FIGS. 1, 4B, 4C, 7, and 19, pressure equalization system 24 includes a pressure equalization housing 160 and an expandable balloon 162 which includes an expansion chamber 164. Pressure equalization housing 160 also includes a flange portion 166. Expandable balloon 162 includes a variable volume. Pressure equalization housing 160 comprises a relatively rigid material and expandable balloon 162 comprises a relatively flexible material. In one aspect, expandable balloon 162 comprises a thin, transparent plastic film that is attached to pressure equalization housing 160 in a gastight manner. In one aspect, expandable balloon 142 is designed as a bellow which is compressible and extendable and thus the volume of the expansion chamber 164 of expandable balloon 162 can thereby be increased and decreased. In one aspect, pressure equalization housing 160 extends radially around inner housing 18 and expandable balloon 162 extends radially around inner housing 18. In one aspect, expandable balloon 162 comprises a toroidal shape. In other aspects, pressure equalization system 24 comprises other pressure equalization systems which are compatible with a closed system drug transfer device.

Pressure equalization housing 160 provides a barrier wall member that protects expandable balloon 162 from being torn during engagement of a cannula with a vial, during transfer of a substance from a vial chamber to a barrel chamber, e.g., a barrel assembly 28 (FIGS. 20-23), via the cannula, and during disengagement of the cannula from the vial. In one aspect, by having expandable balloon 162 extending radially around the entirety of inner housing 18 of vial access device 12, the vial access device 12 is balanced such that a center of mass is positioned at about a longitudinal axis of vial access device 12. In one aspect, expandable balloon 162 extends three-hundred sixty degrees (360°) radially around inner housing 18 of vial access device 12. In one aspect, a portion of expandable balloon 162 is not covered by pressure equalization housing 160. In this manner, expandable balloon 162 is capable of expanding in an axial direction.

As discussed above, pressure equalization housing 160 is received within outer housing 16 such that first shoulder 44 of outer housing 16 provides an engagement surface with flange portion 166 of pressure equalization housing 160 as shown in FIGS. 4B and 4C. In one aspect, pressure equalization housing 160 and outer housing 16 are a single integral component. In another aspect, pressure equalization housing 160 and outer housing 16 are separate components and pressure equalization housing 160 is attachable to outer housing 16 such that significant relative movement between pressure equalization housing 160 and outer housing 16 is prevented.

In one aspect, a pressure normalization channel extends from piercing tip 124 to expandable balloon 162. In this manner, the pressure normalization channel is arranged to provide gas communication between the expandable balloon 162 and the interior of a vial when vial access device 12 is connected to a vial. The pressure normalization channel may be embodied as any suitable pressure normalization channel arrangement. With vial access device 12 connected to a vial, a syringe, cannula assembly, or injector, e.g., injector 27 (FIGS. 20 and 21), may be used to inject fluid into the vial or to withdraw fluid therefrom.

Although a specific arrangement for the pressure equalization system 24 is shown, the pressure equalization system 24 may be embodied as any other suitable pressure equalization system arrangement.

The function and advantages of pressure equalization system 24, according to the present disclosure, will be described in greater detail. When preparing and administering drugs, care has to be taken to minimize, or preferably eliminate, the risk of exposing people, such as medical and pharmacological personnel, to toxic substances. Some drugs must be dissolved or diluted before they are administered, which involves transferring a solvent from one container to a sealed vial containing the drug in powder or liquid form, by means of a needle, for example. Drugs may be inadvertently released into the atmosphere in gas form or by way of aerosolization during the withdrawal of the needle from the vial and while the needle is inside the vial if any differential pressure exists between the interior of the vial and surrounding atmosphere. Vial access device 12 of the present disclosure eliminates this problem by using pressure equalization system 24 of vial access device 12 that may be attached to a vial during the preparation of drugs. The pressure equalization system 24 includes an expandable balloon 162 which is in communication with the interior of a vial which ensures that neither an increased pressure nor a vacuum can occur inside the vial, e.g., first vial 80 (FIGS. 16-19) or second vial 90 (FIGS. 13-15), when gas or liquid is injected into or withdrawn from the vial. In one aspect, the expandable balloon 162 may be filled with cleaned or sterilized air prior to its use to ensure that the contents of the vial do not become contaminated with air-borne particles such as dust, pollen, mold, bacteria, or other undesirable substances.

Referring to FIGS. 16-19, 20, and 21, the vial access device 12 may be secured to a cannula of injector 27 which in turn can be connected to a fluid container, such as barrel assembly 28, and the vial access device 12 can also be assembled via its vial connection elements 52 with a second fluid container, such as a first vial 80. As vial access device 12 is assembled with the first vial 80, the piercing tip 124 of the spike member 122 is pierced through a septum 84 of the first vial 80. First vial 80 may be a standard drug vial of any type having an open head portion covered by a pierceable septum of an elastomeric material. As discussed above, the plurality of vial grip members 54 fixedly connect vial access device 12 to the first vial 80 as the hook protrusions 56 of vial grip members 54 engage the corresponding flange 87 on first vial 80 as shown in FIG. 18. After assembly, a user is able to insert fluid into the first vial 80, or optionally, to retract fluid from the first vial 80.

Figure 19:
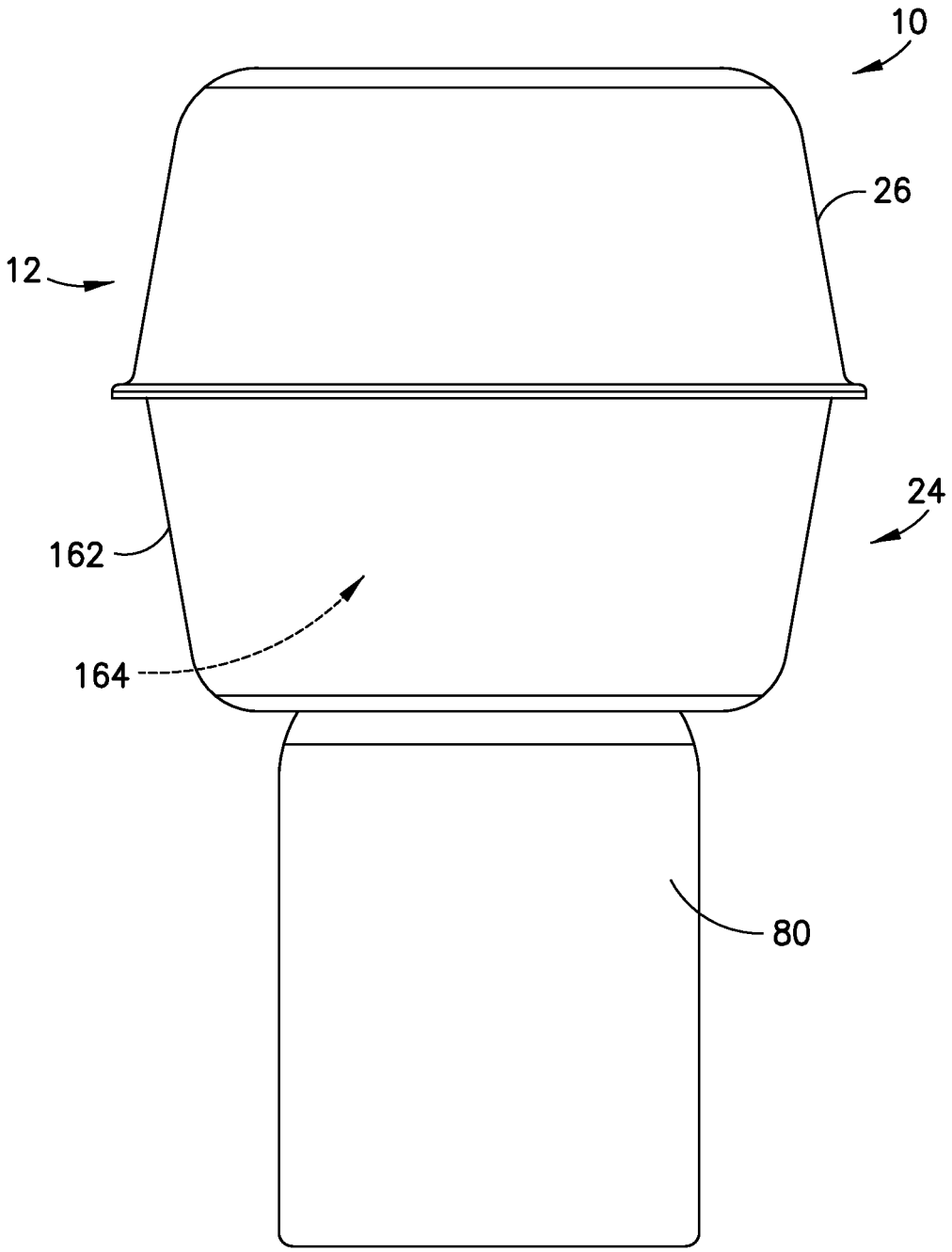
FIG. 19 is a side elevation view of a system having a pressure equalization system connected to a vial in accordance with an aspect of the present invention.
Figure 20:
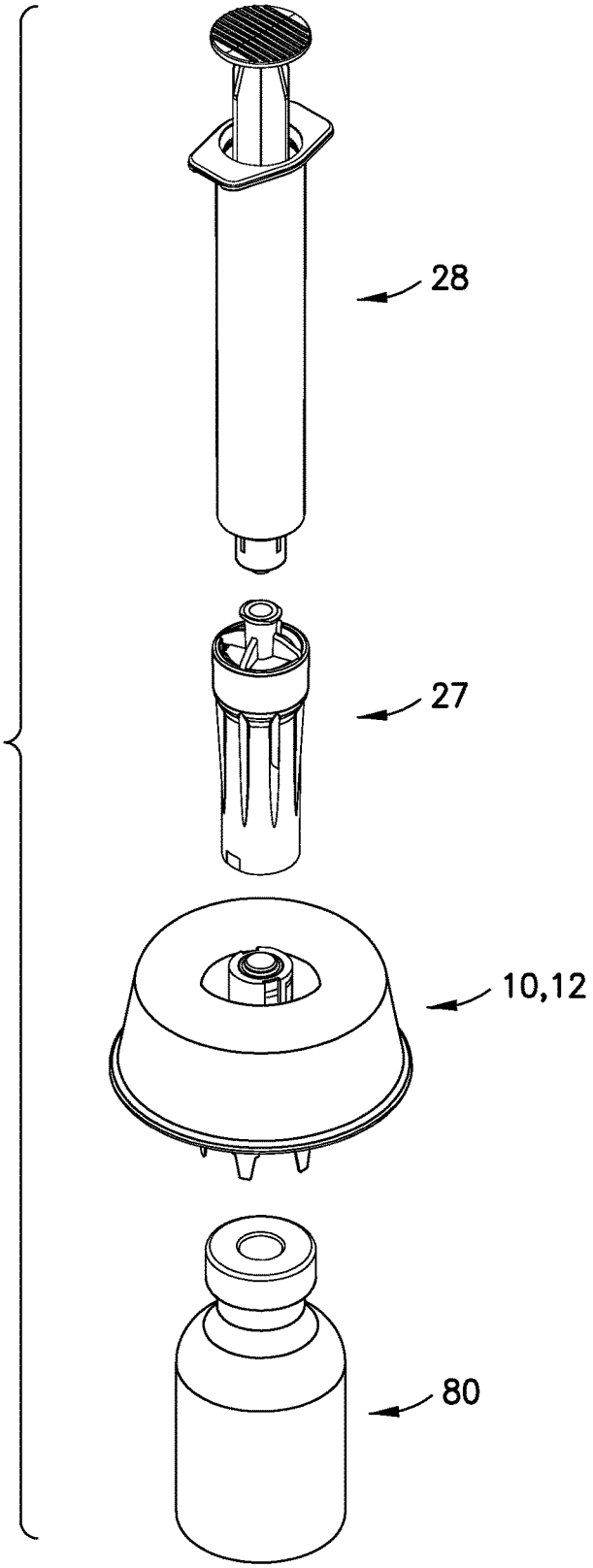
FIG. 20 is an exploded, perspective view of a system in accordance with an aspect of the present invention.
Figure 21:
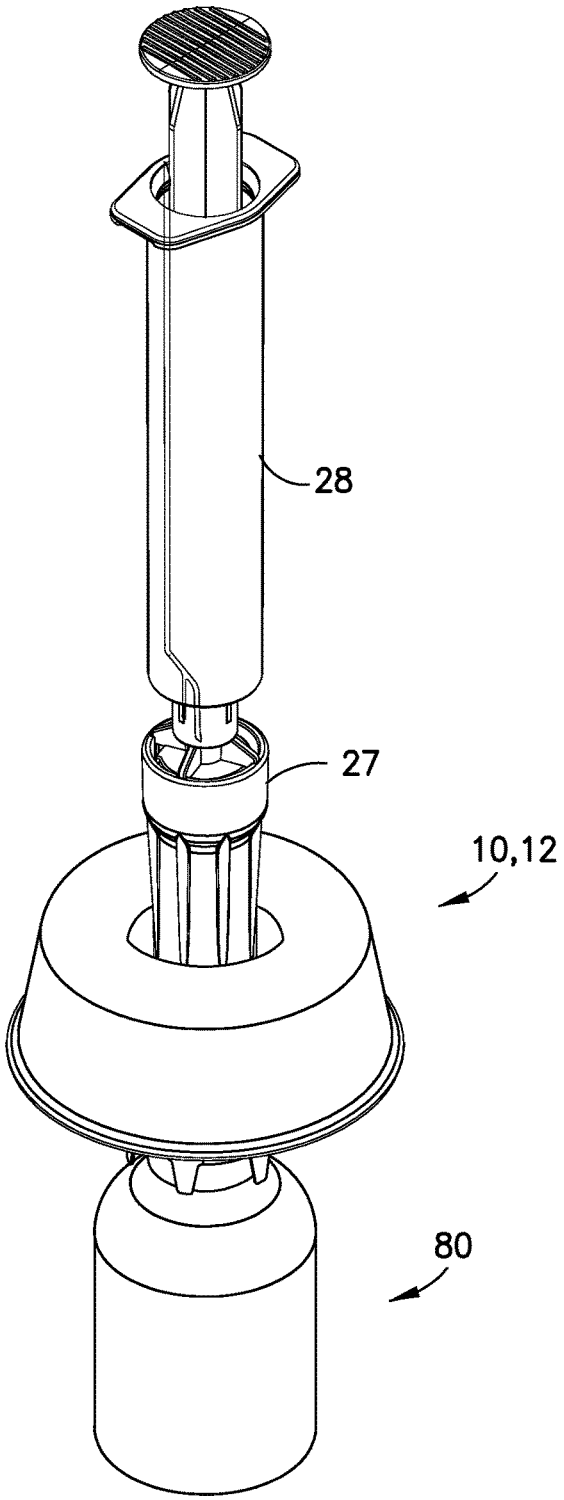
FIG. 21 is an assembled, perspective view of a system in accordance with an aspect of the present invention.
Figure 22:
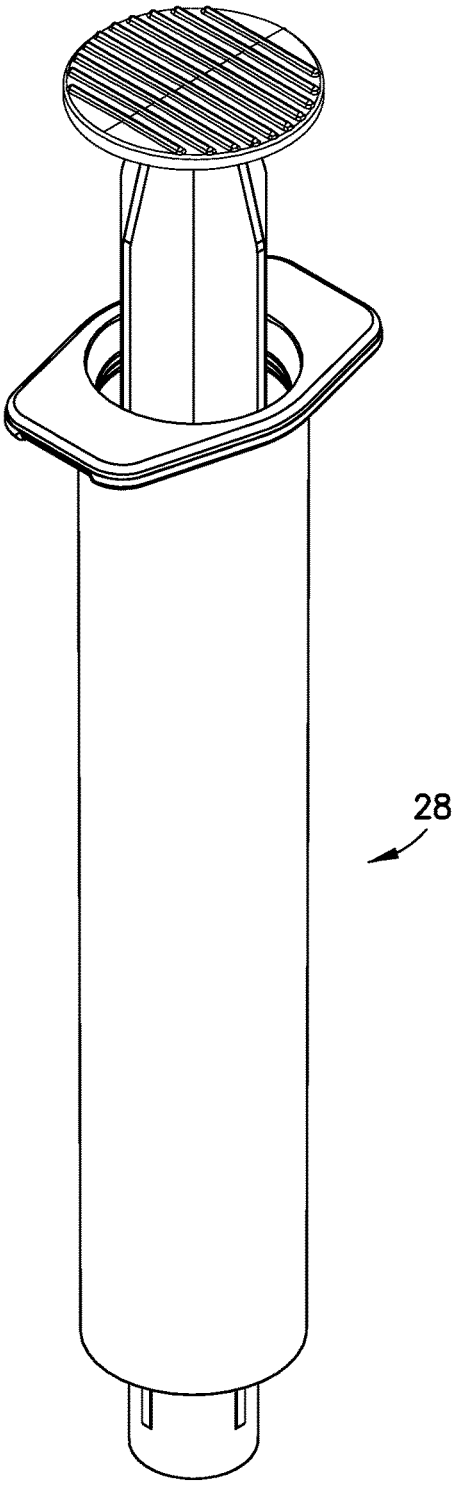
FIG. 22 is a perspective view of a barrel assembly in accordance with an aspect of the present invention.
Figure 23:
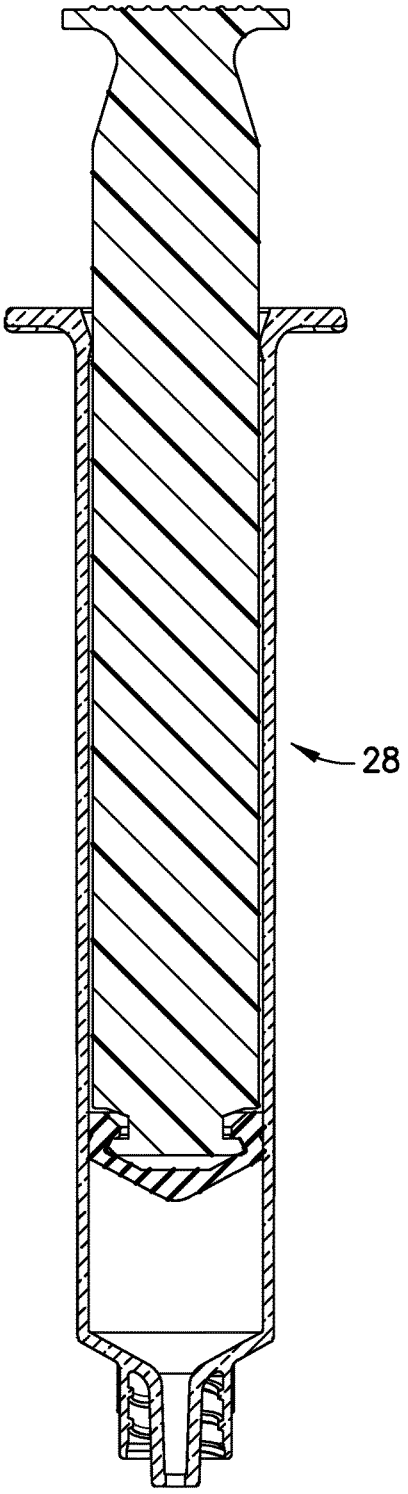
FIG. 23 is a cross-sectional view of the barrel assembly of FIG. 22 in accordance with an aspect of the present invention.
Figure 24:
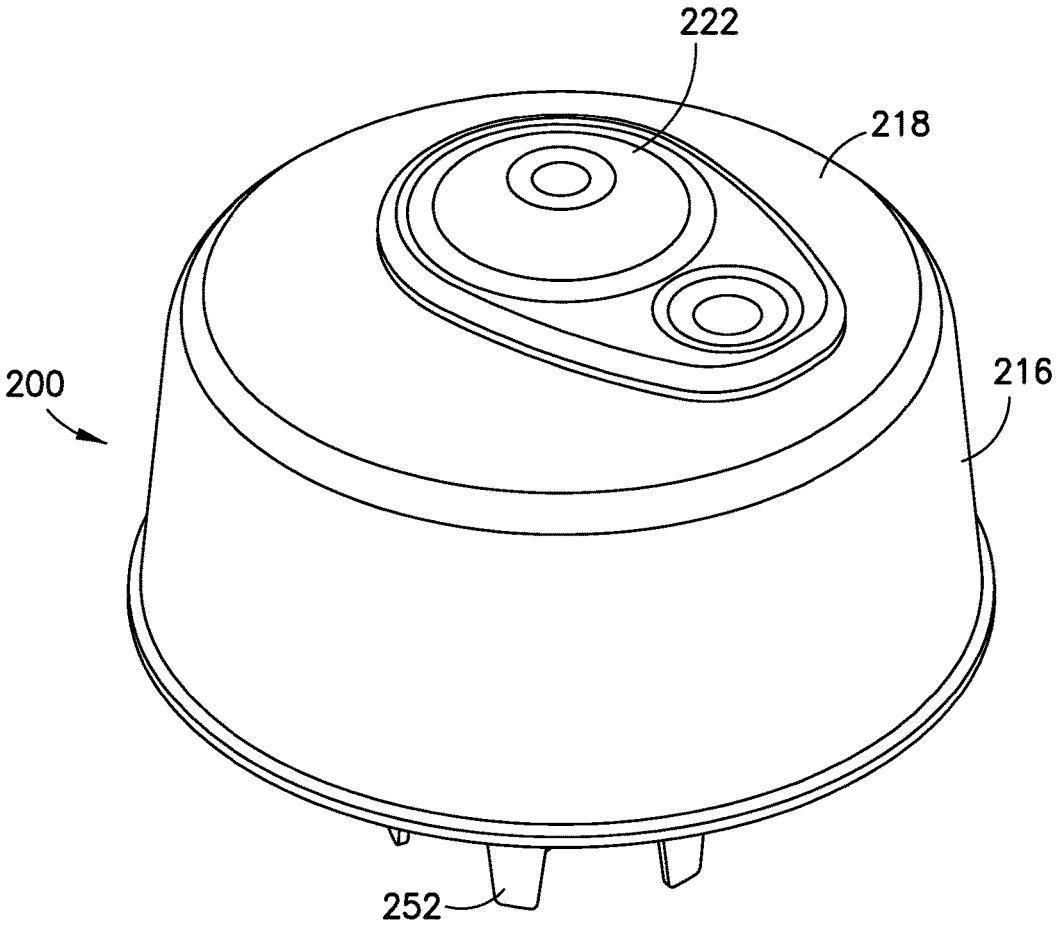
FIG. 24 is a perspective view of a system in accordance with a further aspect of the present invention.

As a fluid is inserted into the first vial 80, using the cannula of injector 27 and barrel assembly 28 (FIGS. 20-23), an overpressure is created inside the first vial 80. The pressure equalization system 24 of vial access device 12 permits pressure equalization between the first vial 80 and the expandable balloon 162. The pressure normalization channel of the pressure equalization system 24 normalizes the pressure inside the first vial 80 by relieving the pressure inside the first vial 80 to the expansion chamber 164 of the expandable balloon 162 as shown in FIG. 19.

Referring to FIGS. 12A-12H, 15, and 18, adapter 14 generally includes a first or proximal end 170; an opposing second or distal end 172; guide channels 174; a vial connection element 176 comprising adapter vial grip members 178, hook protrusions 180, and angled walls 182; and locking members or outer housing engagement portions 184. Adapter 14 is sized and shaped for movement within the elongate aperture 50 of vial access housing 26 and the adapter 14 is transitionable between a first position (FIGS. 13-15) in which the adapter 14 is adjacent the aperture distal end 66 of the vial access housing 26 and the adapter 14 is attachable to a second vial 90 defining a second vial size 91, the second vial size 91 different than the first vial size 81 of first vial 80, and a second position (FIGS. 16-18) in which the adapter 14 is adjacent the aperture proximal end 64 of the vial access housing 26 and the vial connection element 52 of the vial access device 12 is attachable to the first vial 80.

Figure 12A:
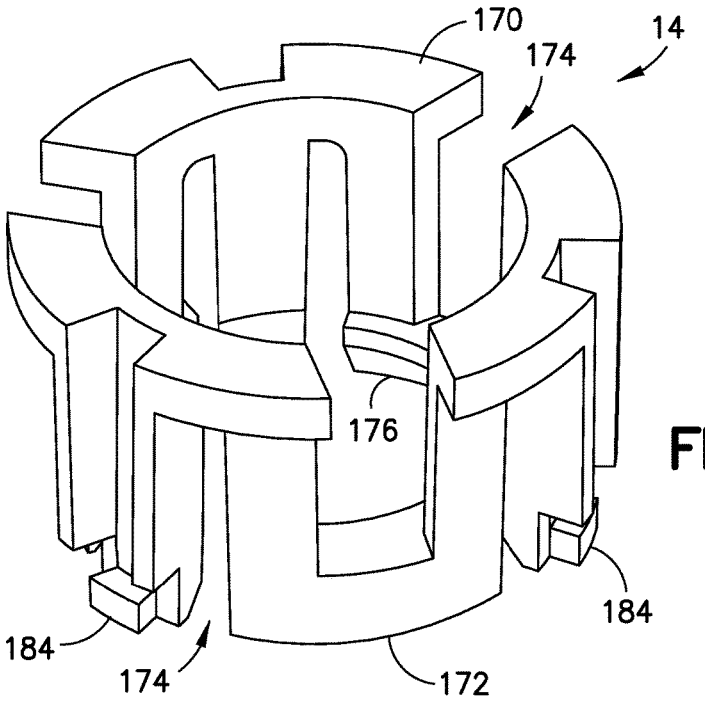
FIG. 12A is a perspective view of an adapter in accordance with an aspect of the present invention.
Figure 12B:
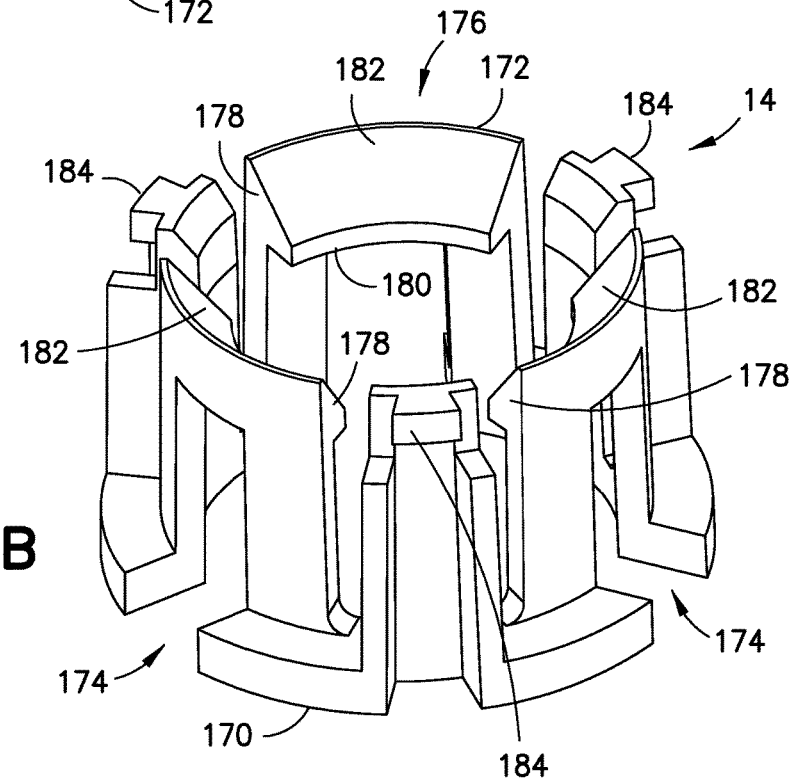
FIG. 12B is another perspective view of an adapter in accordance with an aspect of the present invention.
Figure 12C:
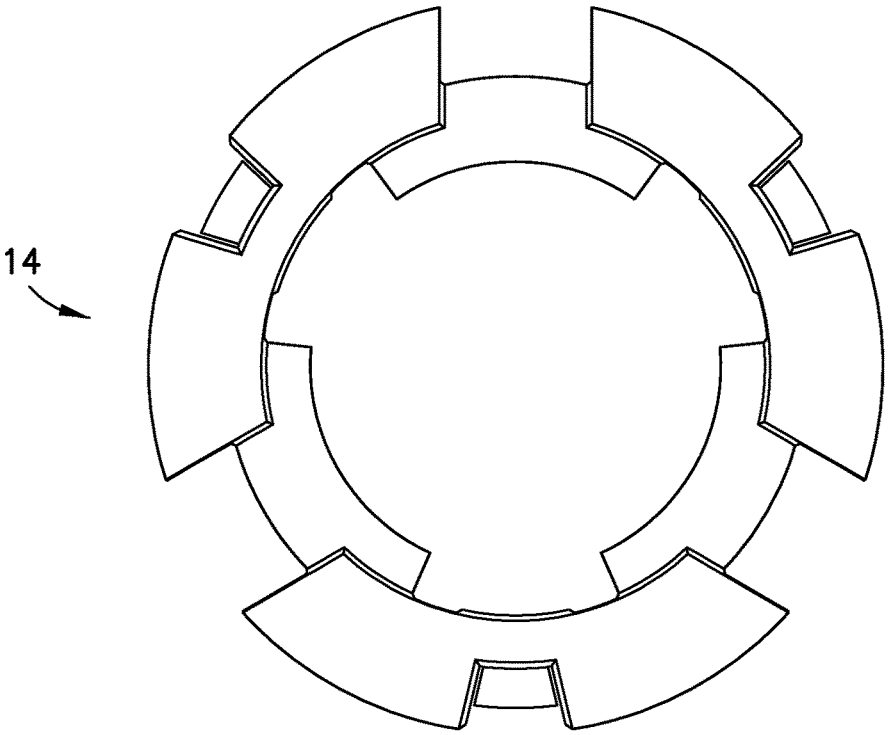
FIG. 12C is a top view of an adapter in accordance with an aspect of the present invention.
Figure 12D:
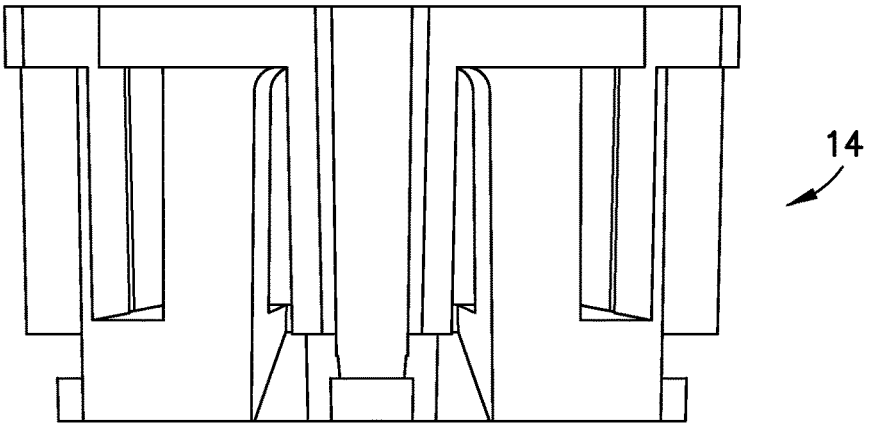
FIG. 12D is a side elevation view of an adapter in accordance with an aspect of the present invention.
Figure 12E:
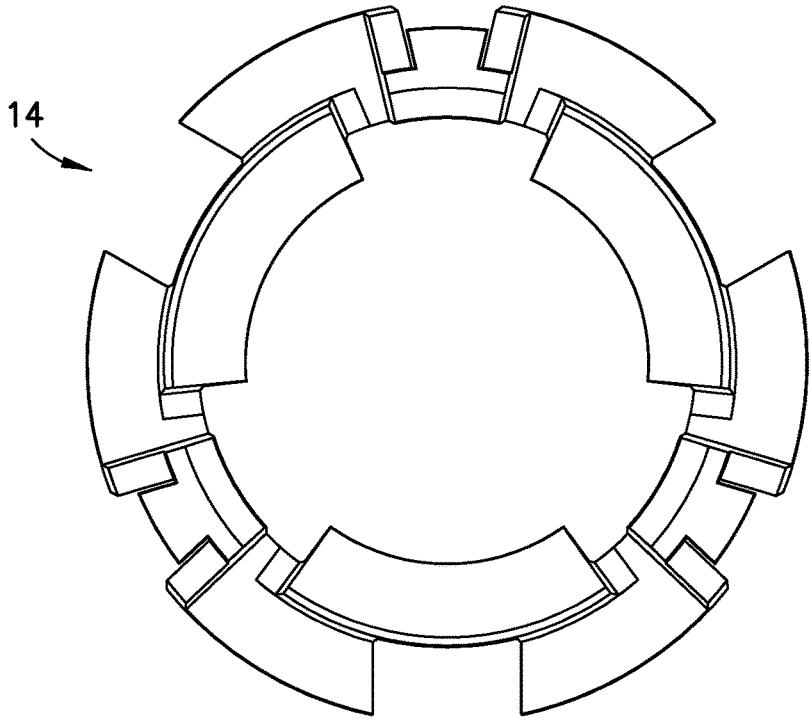
FIG. 12E is a bottom view of an adapter in accordance with an aspect of the present invention.
Figure 12F:
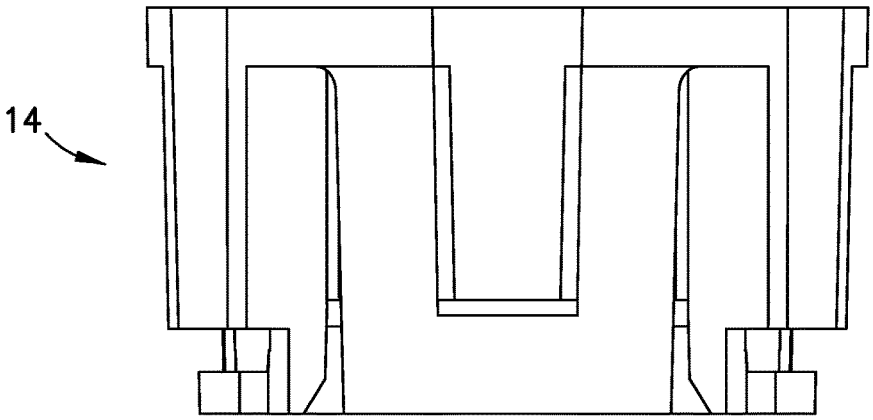
FIG. 12F is another side elevation view of an adapter in accordance with an aspect of the present invention.
Figure 12G:
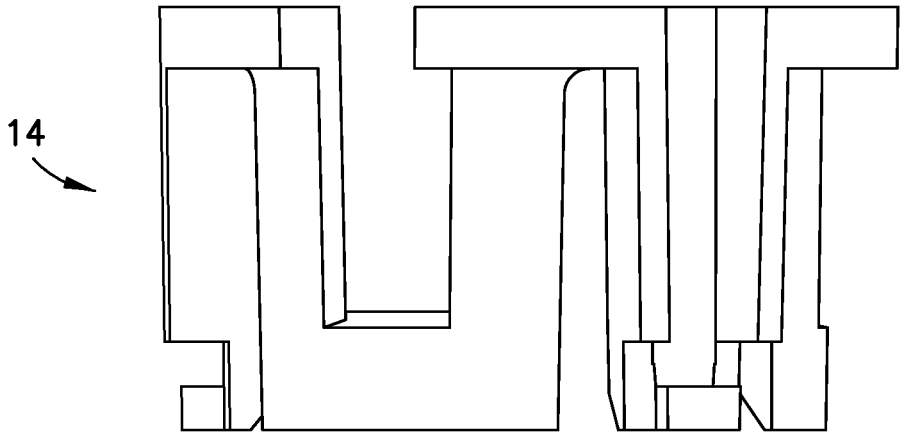
FIG. 12G is another side elevation view of an adapter in accordance with an aspect of the present invention.
Figure 12H:
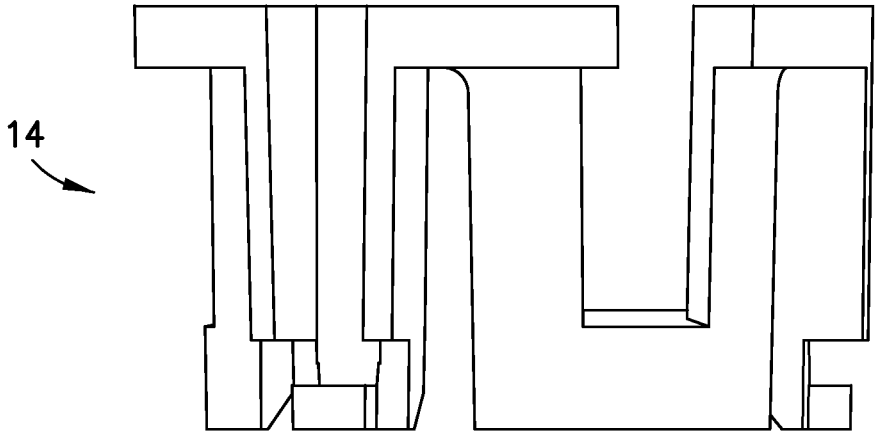
FIG. 12H is another side elevation view of an adapter in accordance with an aspect of the present invention.

Referring to FIGS. 12B and 15, a vial connection element 176 is disposed at second end 172 of adapter 14. In one aspect, vial connection element 176 includes a plurality of adapter vial grip members 178 having hook protrusions 180 and angled walls 182. In one aspect, adapter vial grip members 178 are elastically deformable. Adapter vial grip members 178 are attachable to a second vial 90 to secure vial access device 12 to the second vial 90 via adapter 14. In this manner, vial access device 12 and adapter 14 provide a system 10 that is capable of accommodating a plurality of vials having different sizes, e.g., first vial 80 having first vial size 81 and second vial 90 having second vial size 91. Each adapter vial grip member 178 includes a hook protrusion 180 arranged to engage a corresponding flange 97 on a container such as second vial 90 as shown in FIG. 15. Vial connection element 176 of adapter 14 may be dimensioned to be attached to containers of any size and volume. In other aspects, vial connection element 176 of adapter 14 may include other connection mechanisms for securing adapter 14 and vial access device 12 to second vial 90 such as a threaded portion, a snap fit mechanism, locking tabs, or other similar mechanism. Each adapter vial grip member 178 includes an angled wall 182 arranged to provide a lead-in surface to center and align vial access device 12 on a vial.

As discussed above, vial access device 12 and adapter 14 provide a system 10 that is capable of accommodating a plurality of vials having different sizes, e.g., first vial 80 having first vial size 81 and second vial 90 having second vial size 91. In one aspect, it is envisioned that vial access device 12 and adapter 14 are compatible with a first vial 80 comprising a 20 mm vial and a second vial 90 comprising a 13 mm vial. In another aspect, it is envisioned that vial access device 12 and adapter 14 are compatible with a first vial 80 comprising a 28 mm vial and a second vial 90 comprising a 20 mm vial. In another aspect, it is envisioned that vial access device 12 and adapter 14 are compatible with a first vial 80 comprising a 32 mm vial and a second vial 90 comprising a 28 mm vial. In other aspects, it is envisioned that vial access device 12 and adapter 14 are compatible with a first vial 80 comprising other vial sizes and a second vial 90 comprising other vial sizes, wherein the second vial size is less than the first vial size.

Figure 4D:
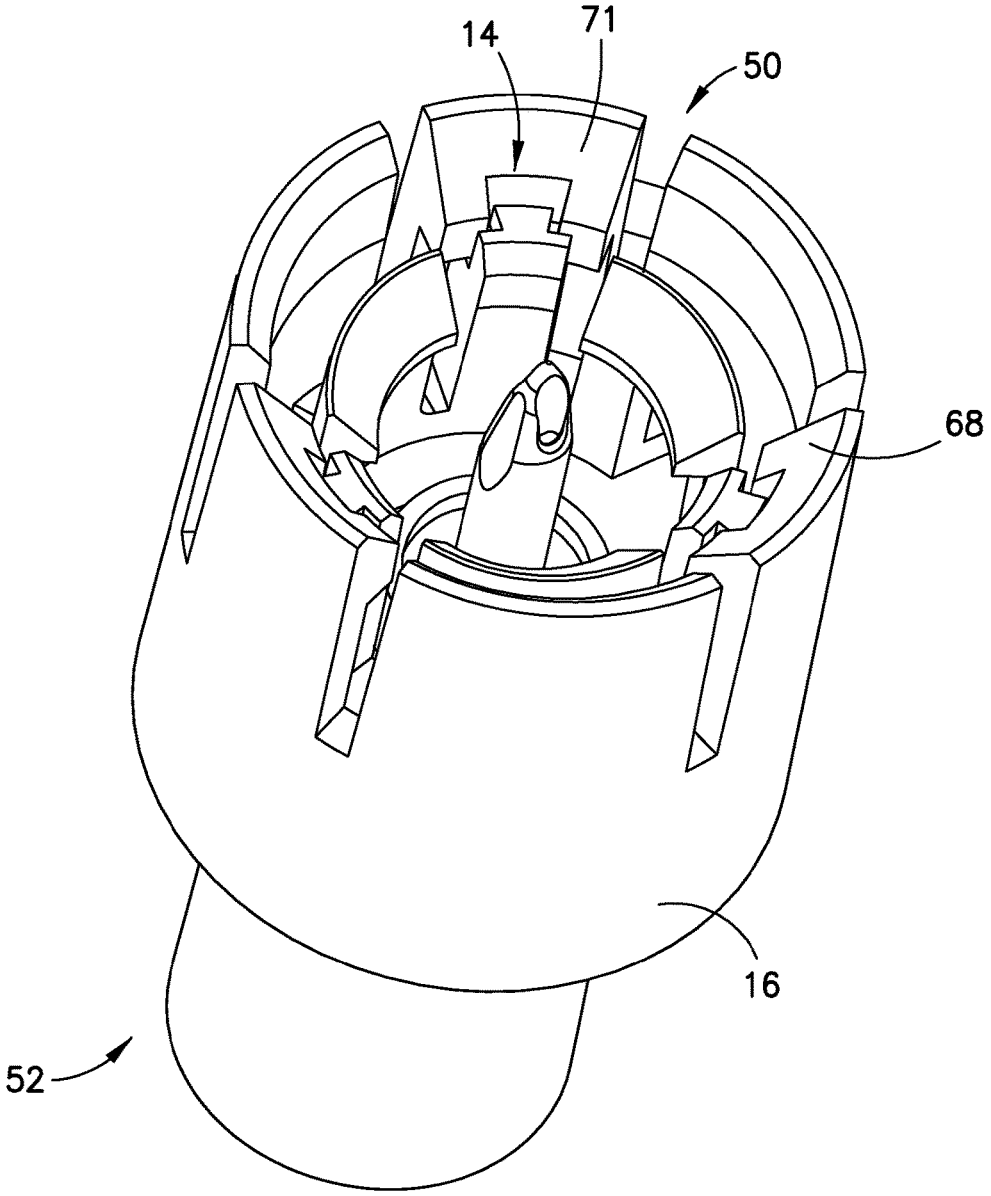
FIG. 4D is a perspective view of an adapter within an elongate aperture of an outer housing of a system in accordance with an aspect of the present invention.

Referring to FIG. 4D, in one aspect, guide channels 174 of adapter 14 are configured to engage corresponding guiding protrusions 71 within elongate aperture 50 of outer housing 16. In this manner, the corresponding guiding surfaces of adapter 14 and outer housing 16 provide a guided, controlled movement of adapter 14 between the first position (FIGS. 13-15) and the second position (FIGS. 16-18) and establish a secure attachment between the adapter 14 and the outer housing 16 as shown in FIGS. 15 and 18.

Referring to FIGS. 4D and 15, locking members or outer housing engagement portions 184 of adapter 14 engage adapter engagement portions 68 which act as a physical barrier to prevent adapter 14 from being removed from within elongate aperture 50. Adapter 14 is sized for movement within elongate aperture 50 of vial access housing 26 and engagement of adapter engagement portions 68 with locking members 184 of adapter 14 prevents adapter 14 from being removed from elongate aperture 50.

Referring to FIGS. 15 and 18, the use of vial access device 12 and adapter 14 to provide a system 10 that is capable of accommodating a plurality of vials having different sizes, e.g., first vial 80 having first vial size 81 and second vial 90 having second vial size 91, will now be described.

Referring to FIG. 15, with the adapter 14 in the first position, the adapter 14 is adjacent the aperture distal end 66 of the vial access housing 26 and the adapter 14 is attachable to the second vial 90 defining the second vial size 91 as described above. With the vial access device 12 attachable to the second vial 90 via the adapter 14, the spike member 122 is in fluid communication With vial chamber 96 of the second vial 90 as shown in FIG. 15. With the vial access device 12 attached to the second vial 90 via the adapter 14, system 10 provides substantially leak-proof sealing and pressure equalization during engagement of a cannula of injector 27 with second vial 90 during transfer of a substance from vial chamber 96 to a barrel chamber of barrel assembly 28 via the cannula, and during disengagement of the cannula from the second vial 90. The leak-proof sealing of the system 10 substantially prevents leakage of both air and liquid during use of the system 10. System 10 is compatible with a needle and syringe assembly for accessing a medication contained within a vial for administering the medication to a patient. System 10 is also compatible to be used with a drug reconstitution system. Furthermore, as a fluid is inserted into the second vial 90, using the cannula of injector 27 and barrel assembly 28 (FIGS. 20-23), an overpressure is created inside the second vial 90. The pressure equalization system 24 of vial access device 12 permits pressure equalization between the second vial 90 and the expandable balloon 162. The pressure normalization channel of the pressure equalization system 24 normalizes the pressure inside the second vial 90 by relieving the pressure inside the second vial 90 to the expansion chamber 164 of the expandable balloon 162 as shown in FIG. 19.

Figure 16:
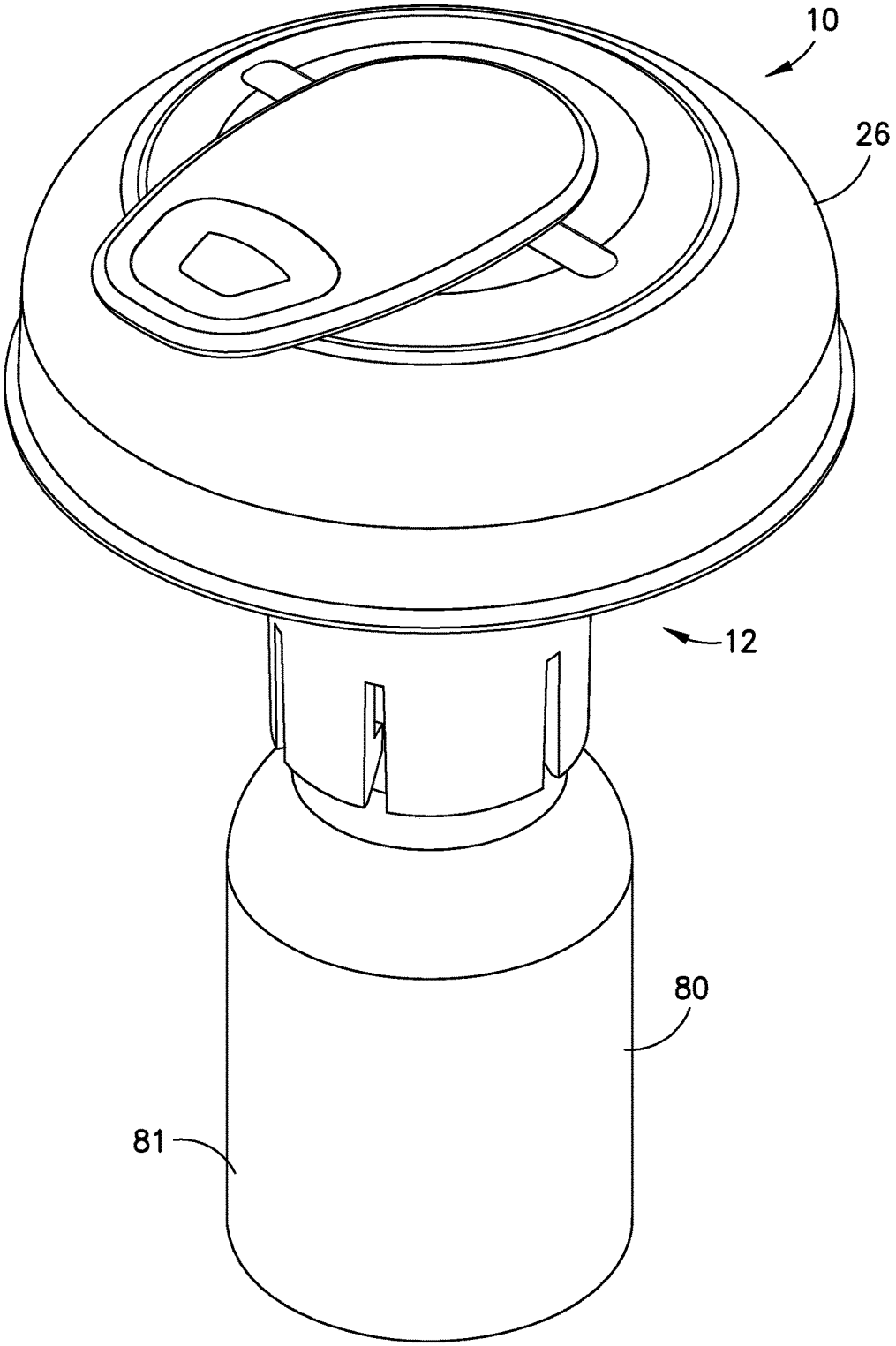
FIG. 16 is a perspective view of a system of the present disclosure connected to a second vial in accordance with an aspect of the present invention.
Figure 17:
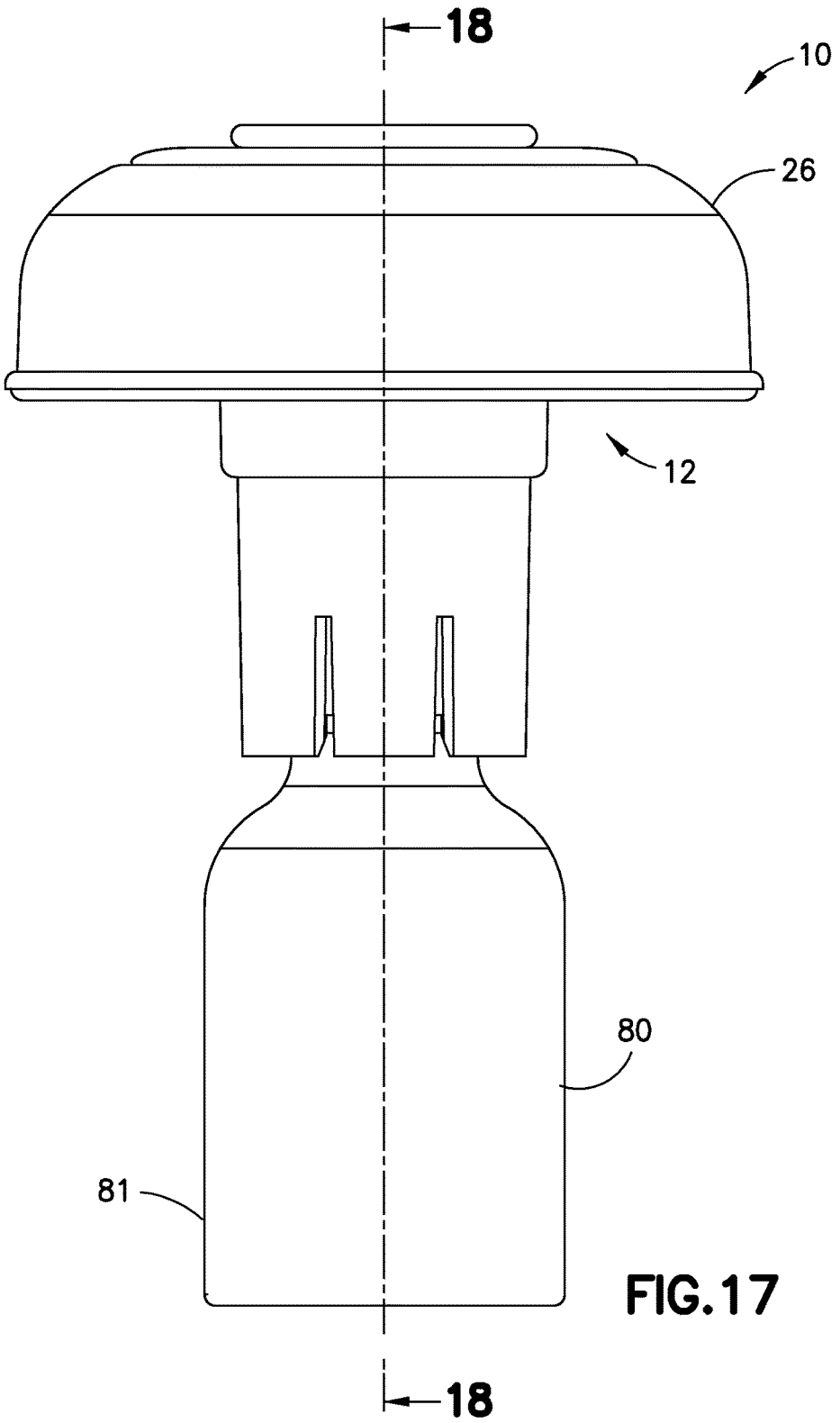
FIG. 17 is a side elevation view of a system of the present disclosure connected to a second vial in accordance with an aspect of the present invention.

As discussed above, adapter 14 is sized and shaped for movement within the elongate aperture 50 of vial access housing 26 and the adapter 14 is transitionable between the first position (FIGS. 13-15) and the second position (FIGS. 16-18).

Referring to FIG. 18, with the adapter 14 in the second position, the adapter 14 is adjacent the aperture proximal end 64 of the vial access housing 26 and the vial connection element 52 of the vial access device 12 is attachable to the first vial 80 as described above. With the adapter 14 in the second position, the adapter 14 is disposed above the vial connection element 52 of the vial access device 12. In this manner, the adapter 14 is out of the way of the vial connection element 52 and the vial connection element 52 is attachable to the first vial 80. With the vial access device 12 attachable to the first vial 80, the spike member 122 is in fluid communication with vial chamber 86 of the first vial 80 as shown in FIG. 18. With the vial access device 12 attached to the first vial 80, system 10 provides substantially leak-proof sealing and pressure equalization during engagement of a cannula of injector 27 with first vial 80, during transfer of a substance from vial chamber 86 to a barrel chamber of barrel assembly 28 via the cannula, and during disengagement of the cannula from the first vial 80. The leak-proof sealing of the system 10 substantially prevents leakage of both air and liquid during use of the system 10. System 10 is compatible with a needle and syringe assembly for accessing a medication contained within a vial for administering the medication to a patient. System 10 is also compatible to be used with a drug reconstitution system. Furthermore, as a fluid is inserted into the first vial 80, using the cannula of injector 27 and barrel assembly 28 (FIGS. 20-23), an overpressure is created inside the first vial 80. The pressure equalization system 24 of vial access device 12 permits pressure equalization between the first vial 80 and the expandable balloon 162. The pressure normalization channel of the pressure equalization system 24 normalizes the pressure inside the first vial 80 by relieving the pressure inside the first vial 80 to the expansion chamber 164 of the expandable balloon 162 as shown in FIG. 19.

Referring to FIGS. 24-27, a further aspect of a vial access device 200 is shown. The vial access device 200 is similar to the vial access device 12 described above and will operate in the same manner. The vial access device 200 also includes an outer housing 216, inner housing 218, connector 220, top cap 222, a pressure equalization system 224, and a vial connection element 252.

The outer housing 216 defines an annular space 226 that receives the pressure equalization system 224. The outer housing 216 also defines an inner space 228 that receives at least a portion of the inner housing 218 and the connector 220. The inner housing 218 includes a body 230 having a curved top surface and a cylindrical portion 232 extending in a longitudinal direction. The body 230 defines a central opening 234 that receives at least a portion of the top cap 222, the connector 220, and the vial connection element 252. The inner housing 218 is secured to the outer housing 216 by a snap-fit connection, although any other suitable securing arrangement may be utilized, such as adhesive, welding, etc. The top cap 222 includes a body 236 that defines a recessed portion 238 that receives a portion of the connector 220. The body 236 also includes an extension portion that defines a gripping surface 240 that is configured to facilitate grasping of the top cap 222 to remove the top cap 222 from the inner housing 218. The gripping surface 240 is shown as a recessed area of the body 230, although any other suitable arrangement may be utilized, such as a textured surface, a protrusion, dimples, etc. The top cap 222 is secured to the inner housing 218 via a snap-fit connection, although any other suitable securing arrangement may be utilized. The pressure equalization system 224 includes a toroidal balloon 242 positioned within annular space 226 of the outer housing 216. As discussed above in connection with the pressure equalization system 24, the balloon 242 is configured to expand and contract to change the volume defined by the balloon 242 and the outer housing 216. In particular, the balloon 242 is configured to expand axially outward from the annular space 226.

The connector 220 is positioned within inner space 228 of the outer housing 216 and the central opening 234 of the inner housing 218. As discussed above in connection with connector 20, the connector 220 is configured to mate with a mating connector or component. The connector 220 includes a body 244 defining a central passageway 246. A flange 248 extends radially outward from the body 244 of the connector 220. A membrane or septum 250 is positioned and secured at a proximal end of the connector 220 and closes the central passageway 246. The flange 248 abuts a ledge 254 defined by the outer housing 216 and defines an annular filter space 256 that receives an annular filter 258. The flange 248 may be secured to the outer housing 216 via snap-fit connection, although any other suitable securing arrangement may be utilized. The filter 258 is hydrophobic filter that prevents liquid flow, but allows air to flow through during operations of the pressure equalization system 224.

Referring again FIGS. 24-27, the vial connection element 252 is similar to the vial connection element 52 described above. The vial connection element 252 includes a body 260 having vial grip members 262 extending from the 260. The vial connection element 252 is configured to be secured to a vial thereby securing the vial access device 200 to the vial. The body 260 of the vial connection element 252 is cylindrical and received within the central passageway 246 of the connector 220. The body 260 defines a central passageway 264 that is Aaligned with the central passageway 246 of the connector 220. The vial connection element 252 includes a spike member 266 that is configured to puncture a septum of vial as discussed above in connection with system 10. The spike member 262 defines a fluid passageway 268 in fluid communication with the central passageways 246, 264 of the connector 220 and the vial connection element 252. The spike member 262 also defines a vent passageway 270 in fluid communication with the filter space 256 and the annular space 226 of the outer housing 216. The fluid passageway 268 is configured to facilitate the transfer of fluids to and from a vial to a mating device connected to the connector 220. The vent passageway 270 is configured to cooperate with the pressure equalization system 224, as discussed above in connection with system 10, to prevent a vial from being pressurized or depressurized during the transfer of contents to and from the vial. The filter 258 prevents the passage of liquids into the filter space 256 and into the annular space 226.

Figure 25:
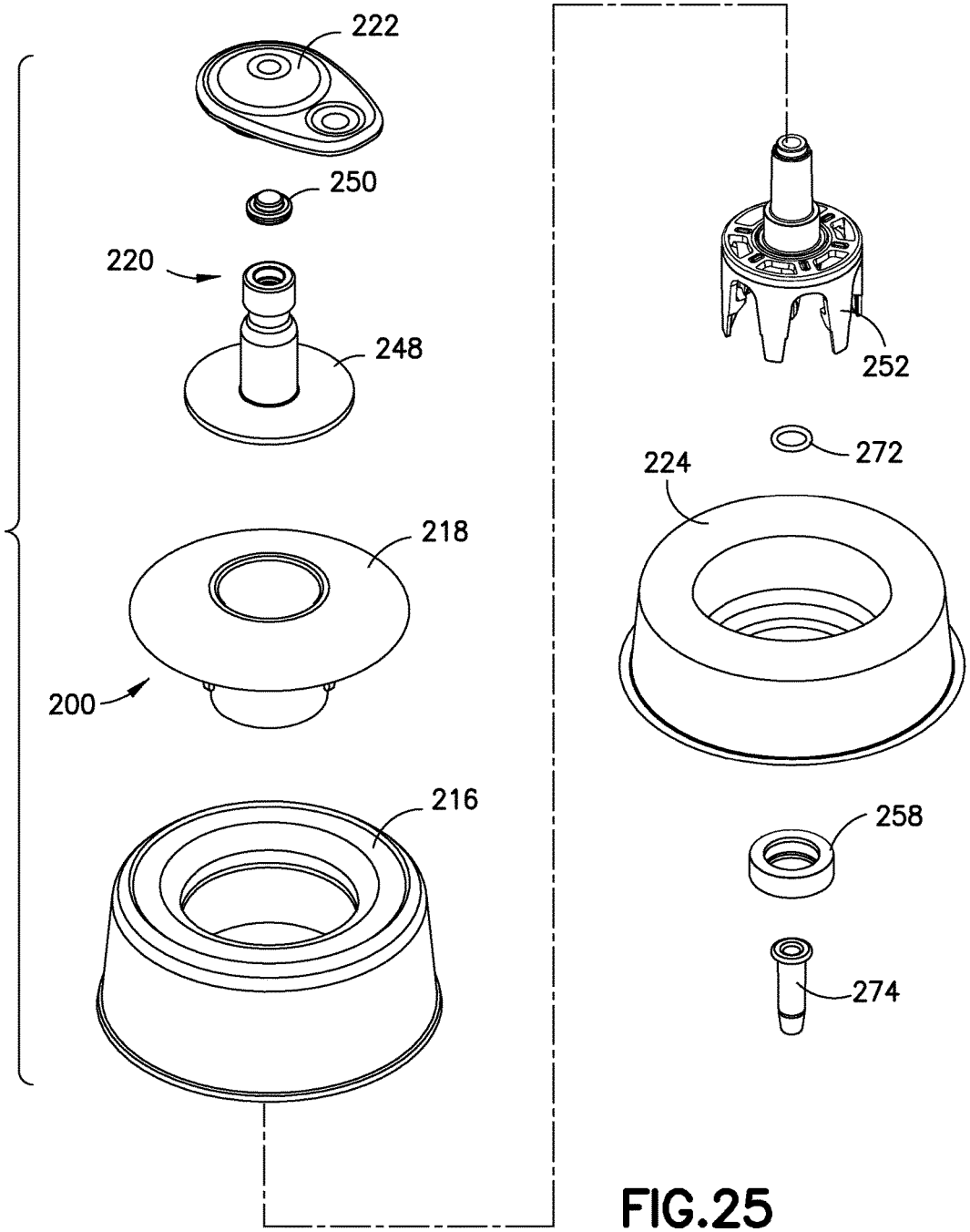
FIG. 25 is an exploded perspective view of the system of FIG. 24 in accordance with an aspect of the present invention.
Figure 26:
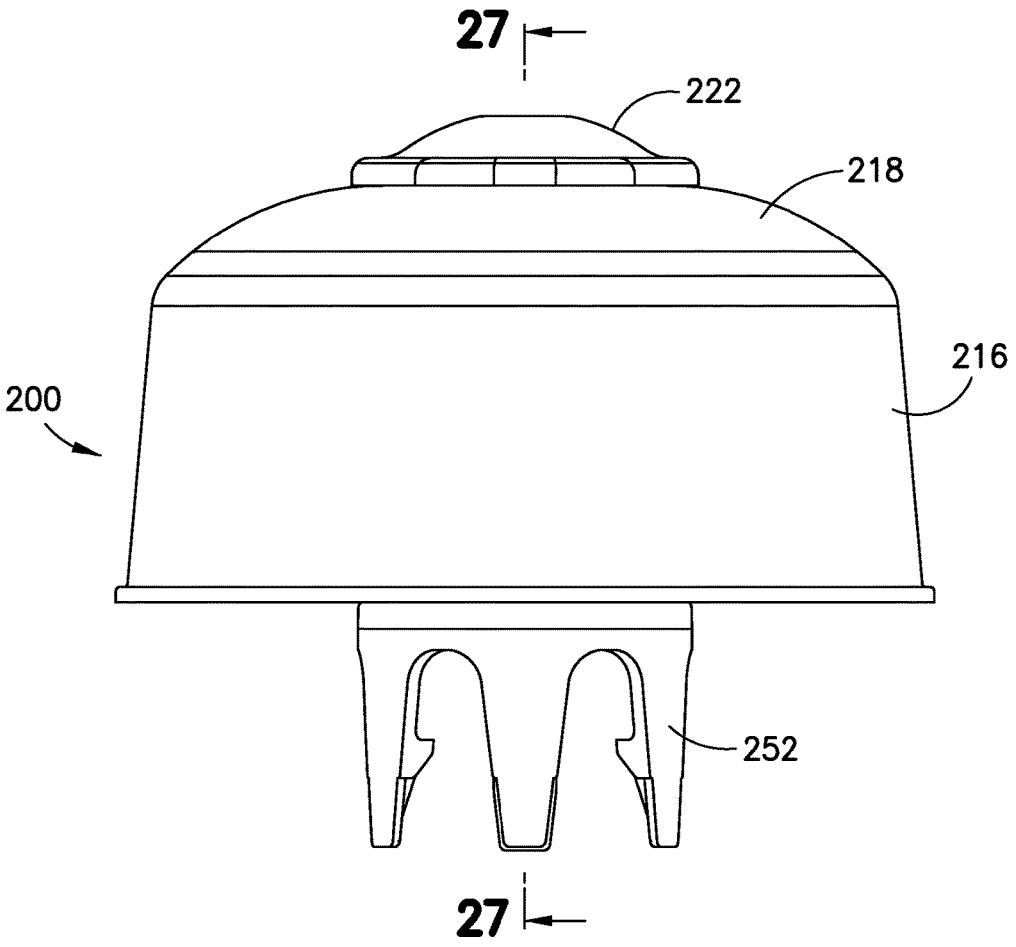
FIG. 26 is a front view of the system of FIG. 24 in accordance with an aspect of the present invention.
Figure 27:
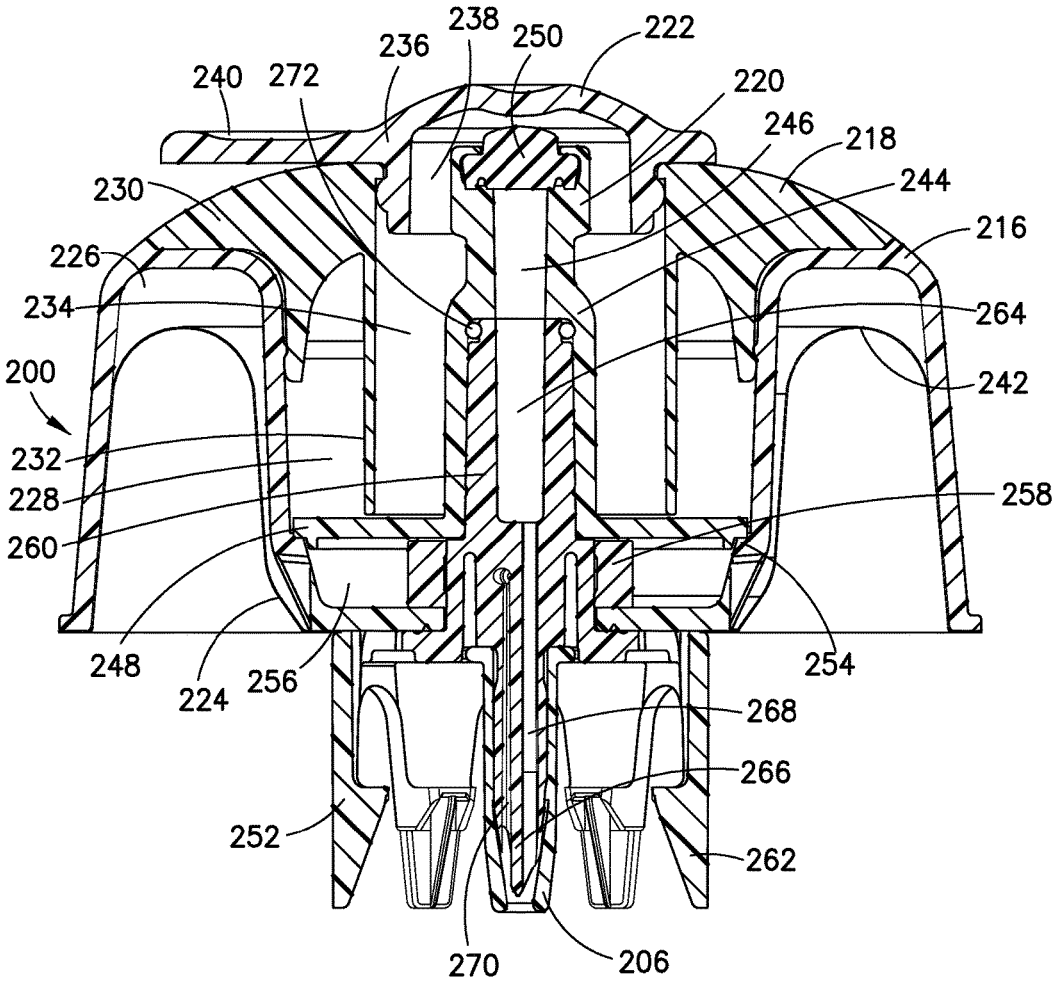
FIG. 27 is a cross-sectional view taken along line 27-27 in FIG. 26 in accordance with an aspect of the present invention.
Figure 28:
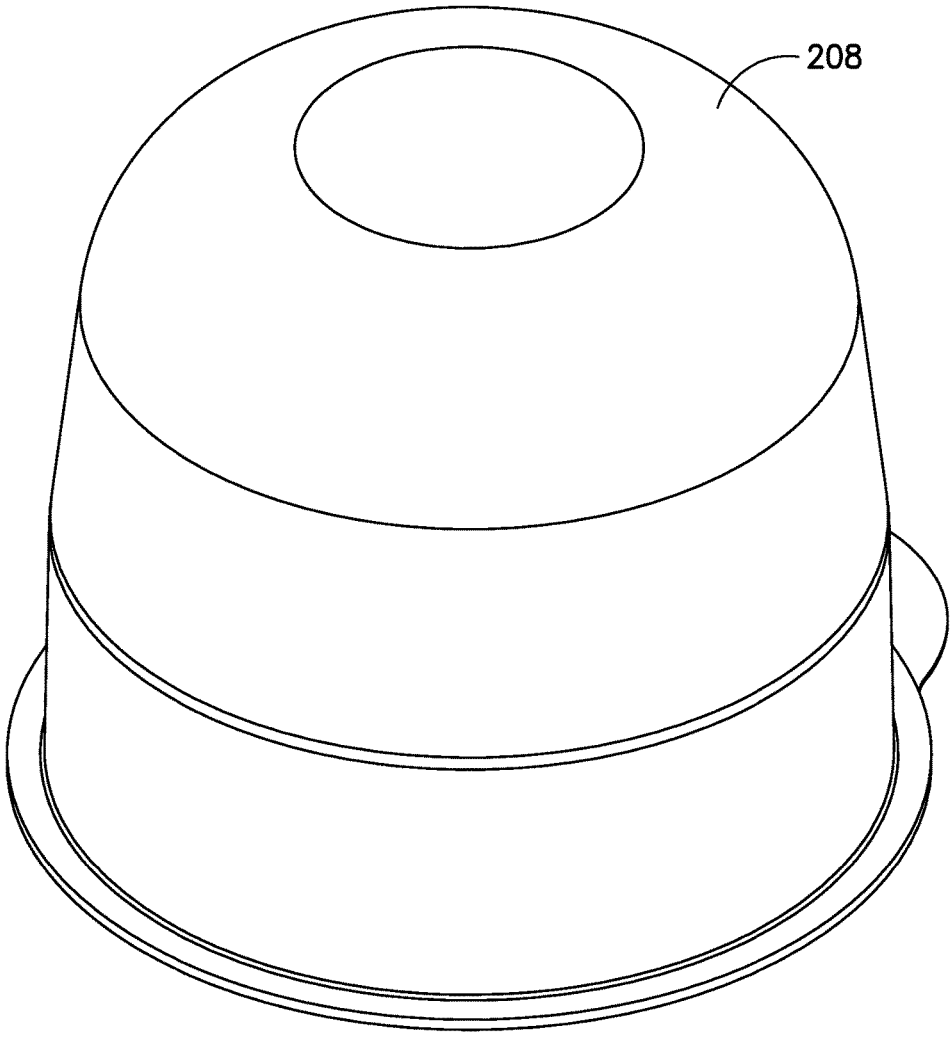
FIG. 28 is a perspective view of the system of FIG. 24 provided with a packaging member in accordance with an aspect of the present invention.
Figure 29:
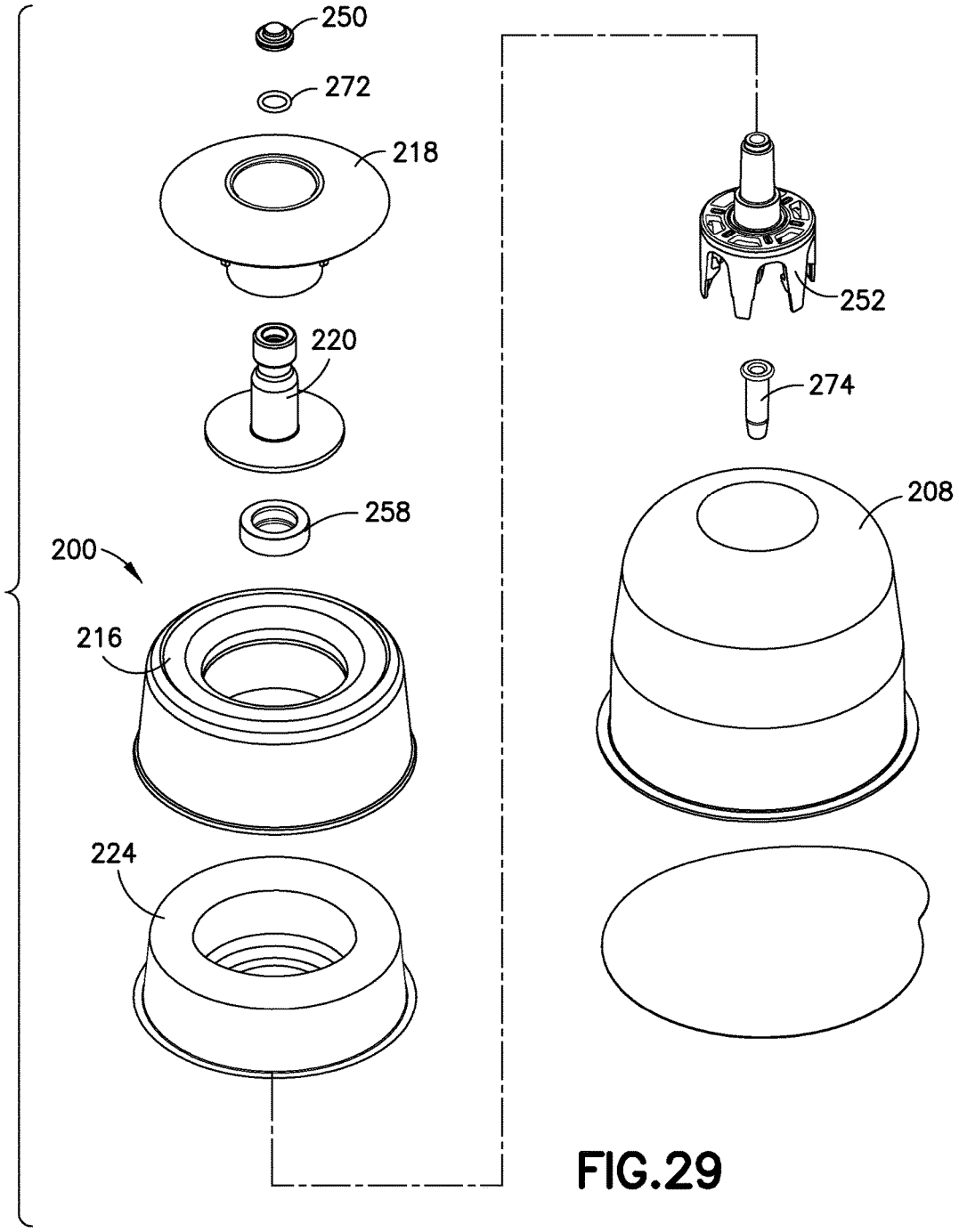
FIG. 29 is an exploded perspective view of the system of FIG. 24 provided with a packaging member in accordance with an aspect of the present invention.
Figure 30:
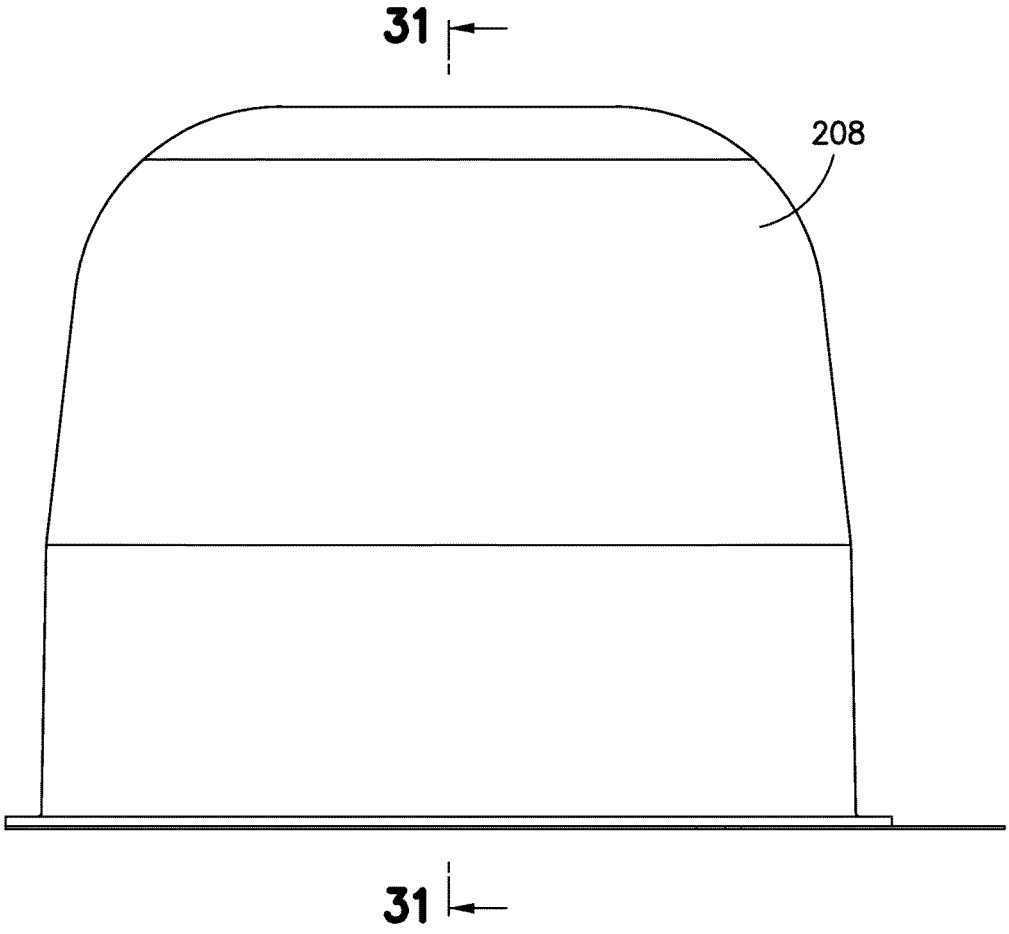
FIG. 30 is a front view of the system of FIG. 24 provided with a packaging member in accordance with an aspect of the present invention.

Referring to FIGS. 25 and 27, an O-ring 272 may be positioned between the connector 220 and the vial connection element 252 where the connector 220 and the vial connection element 252 are joined and where the central passageways 246, 264 come into alignment. The vial access device 200 also includes a sleeve member 274 positioned over the spike member 266, which prevents leakage during fluid transfer when longer openings are used for the spike member 266 to optimize evacuation of the vial.

Although a specific arrangement for the connector 220 is shown, the connector 220 may be embodied as any other suitable connection arrangement.

Figure 31:
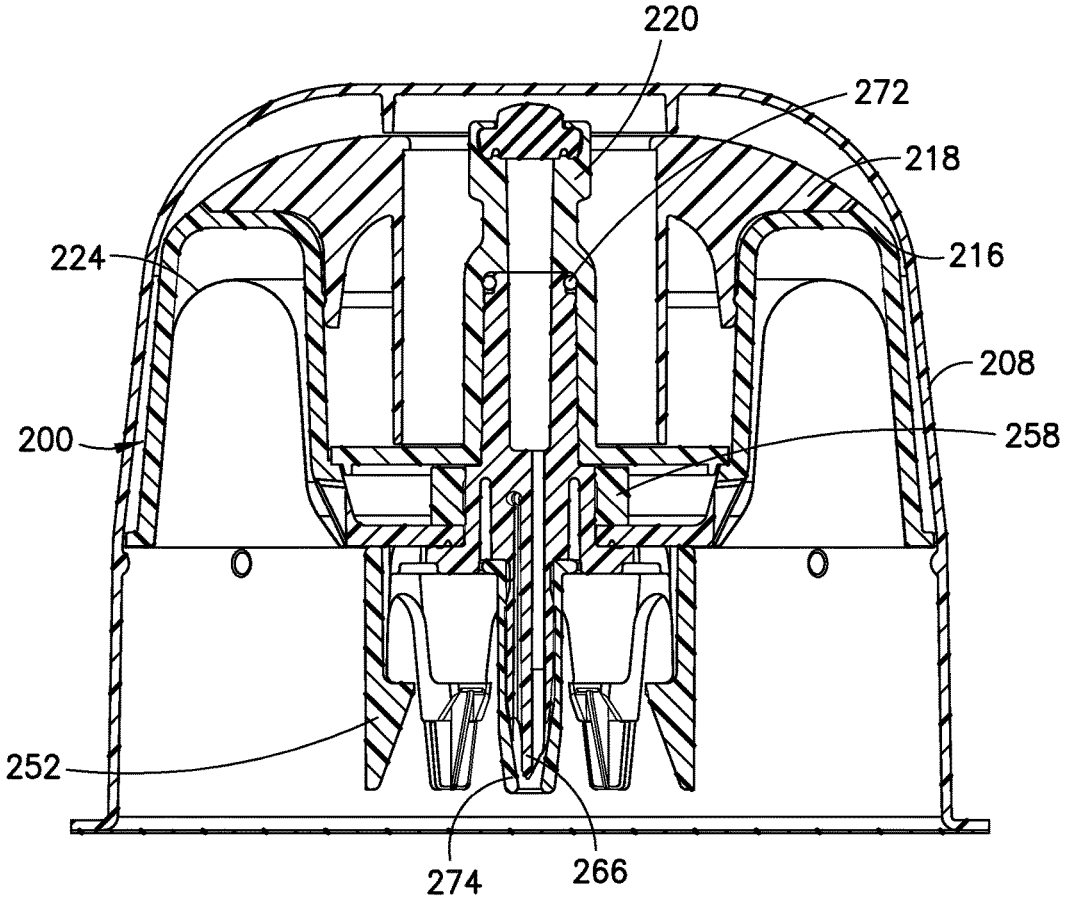
FIG. 31 is a cross-sectional view taken along line 31-31 in FIG. 30 in accordance with an aspect of the present invention.
Figure 32:
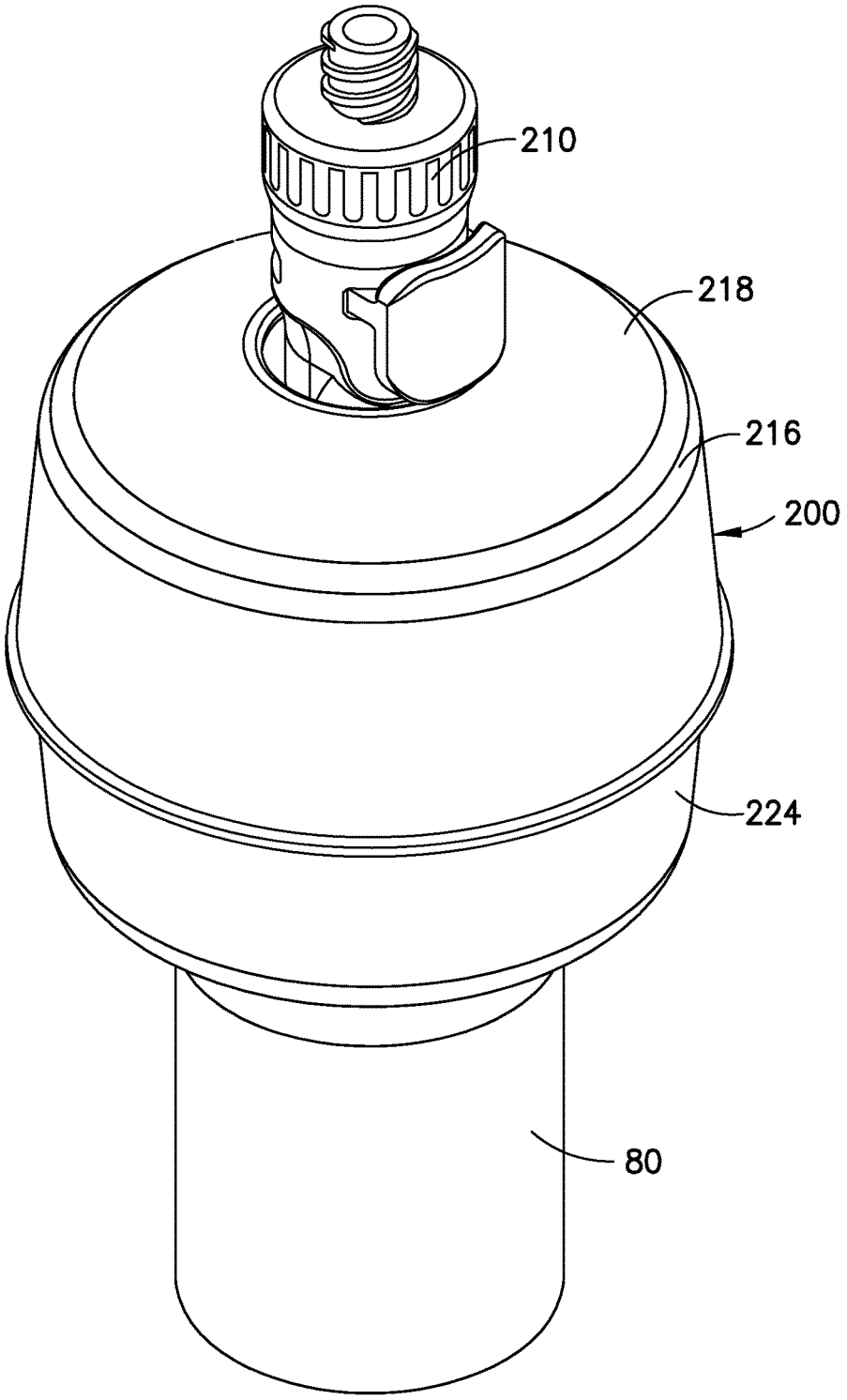
FIG. 32 is a perspective view of the system of FIG. 24 showing the system connected to a vial and a syringe adapter in accordance with an aspect of the present invention.
Figure 33:
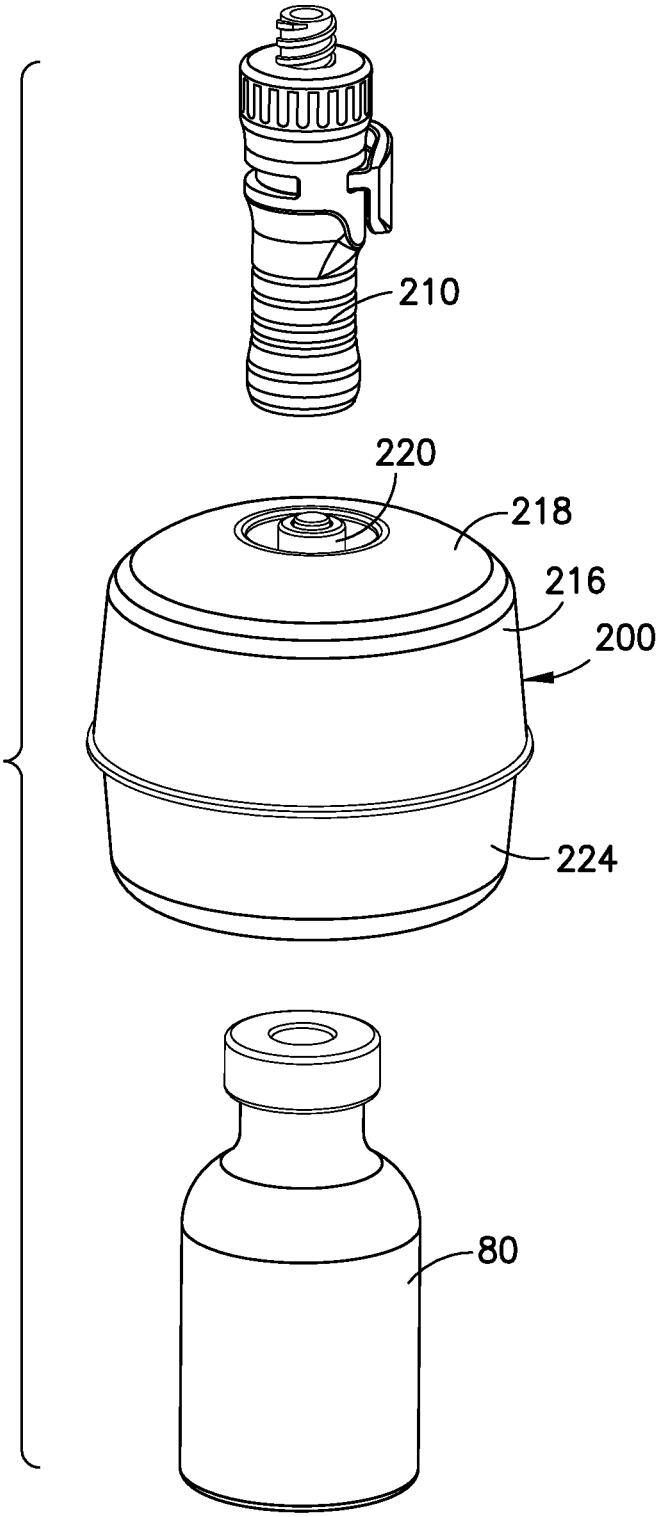
FIG. 33 is an exploded perspective view of the system of FIG. 24 showing the system along with a vial and a syringe adapter in accordance with an aspect of the present invention.
Figure 34:
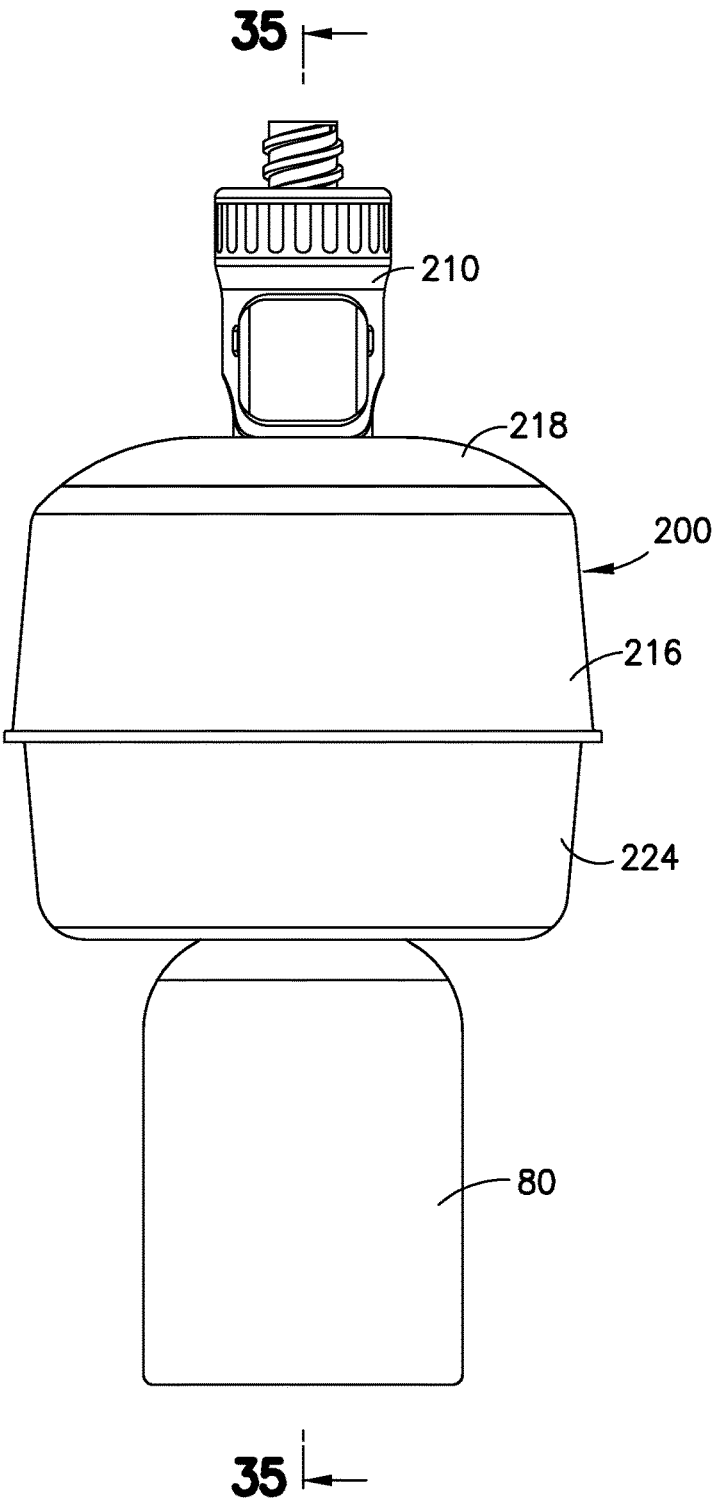
FIG. 34 is a front view of the system of FIG. 24 showing the system connected to a vial and a syringe adapter in accordance with an aspect of the present invention.
Figure 35:
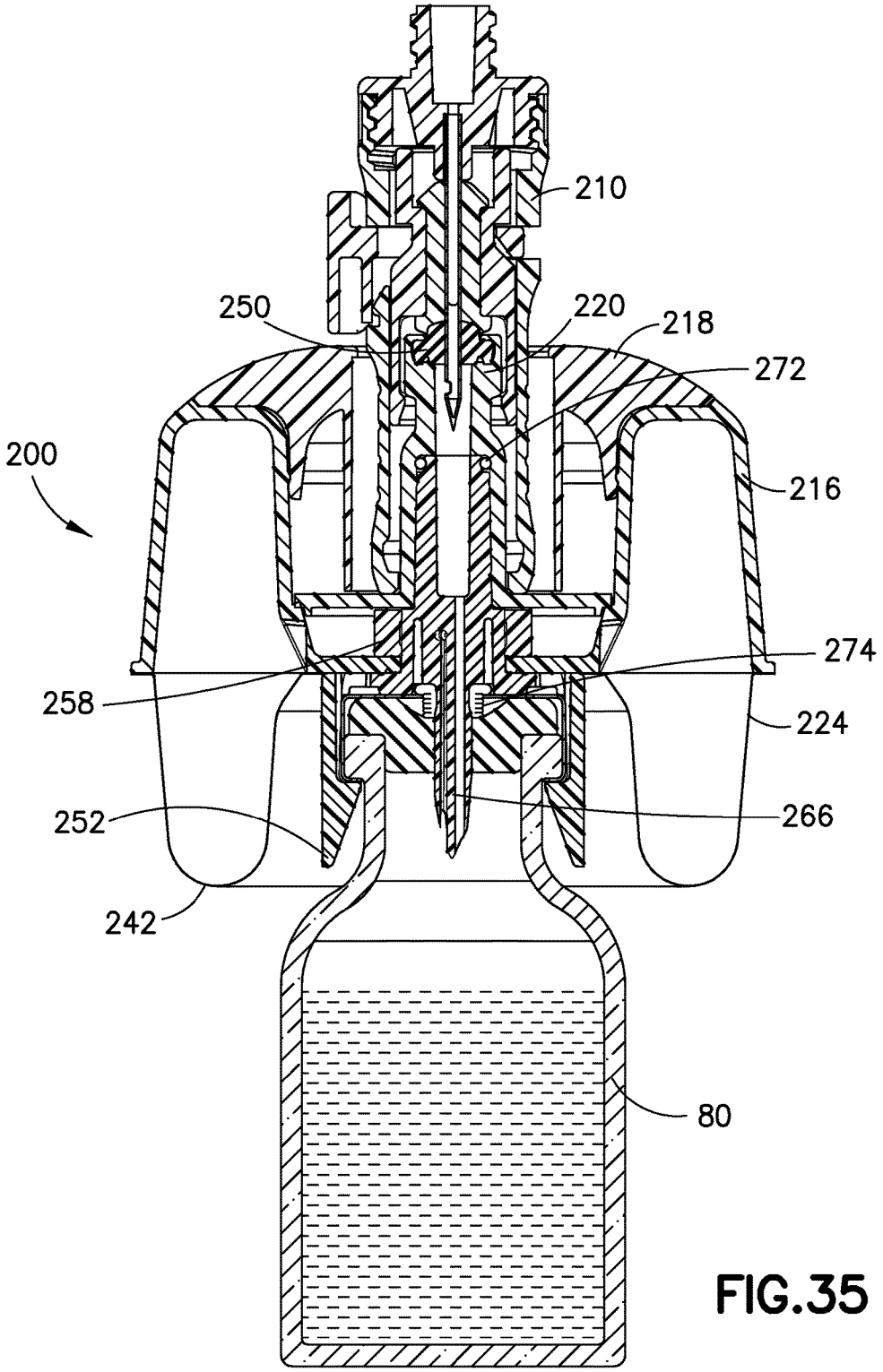
FIG. 35 is a cross-sectional view taken along line 35-35 in FIG. 34 showing the system connected to a vial and a syringe adapter in accordance with an aspect of the present invention.

Referring to FIGS. 28-31, the vial access device 200 may be provided with a packaging arrangement 208. The packaging arrangement 208 holds the vial access device 200 and maintains sterility prior to use, but can also be used to hold the vial access device 200 while connecting the vial access device 200 onto a container, such as a vial. FIG. 31 shows a configuration without the top cap 222 and where a portion of the packaging arrangement 208 engages the inner housing 218.

Referring to FIGS. 32-35, the vial access device 200 is shown in use with a syringe adapter 210 and the vial 80. The syringe adapter 210 may be the syringe adapter and system noted above in connection with connector 20. The syringe adapter 210 cooperates with the connector 220 to facilitate the sealed transfer of substances between the vial 80 and a syringe (not shown) connected to the syringe adapter 210.

Figure 36:
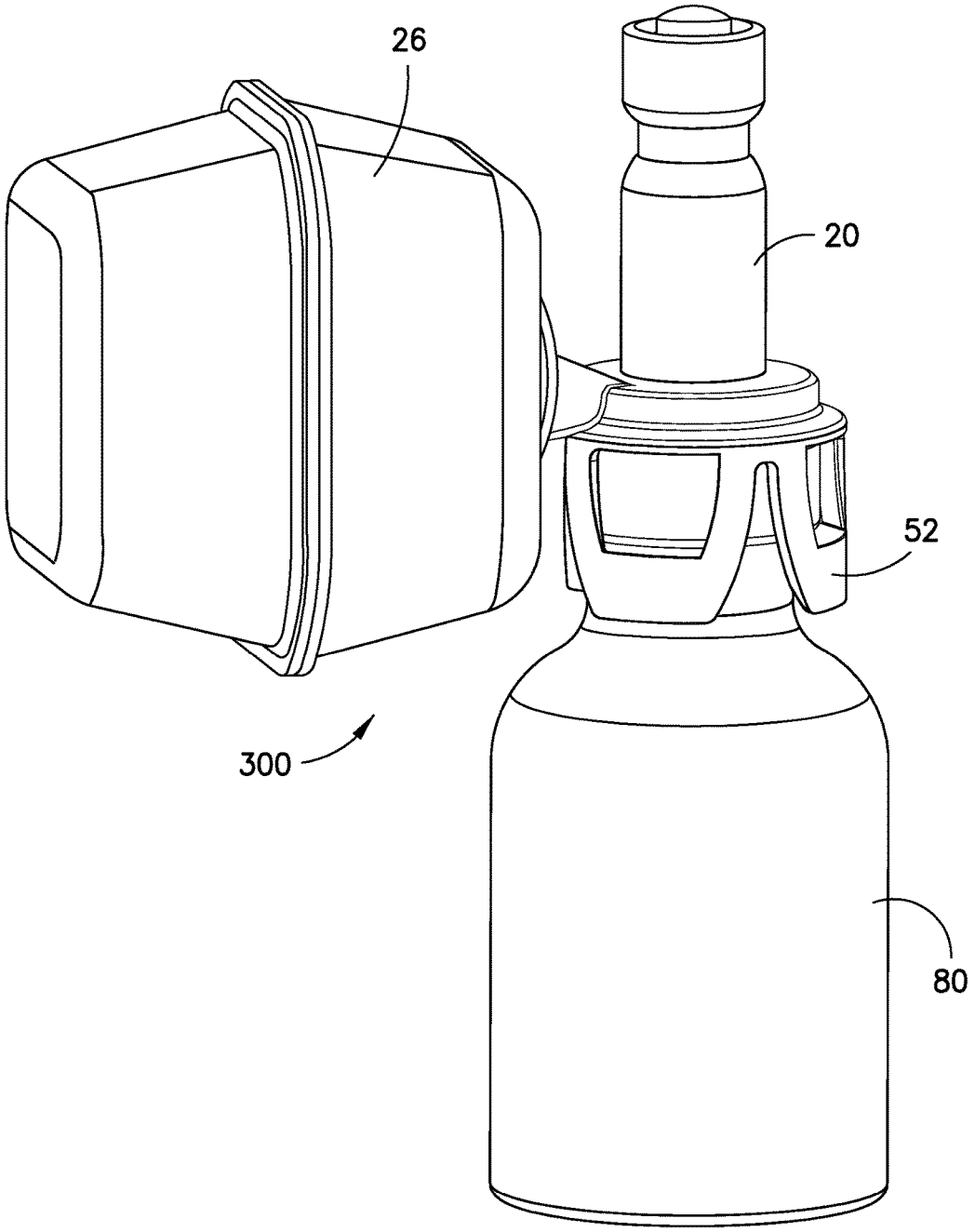
FIG. 36 is a perspective view of a vial adapter in accordance with a further aspect of the present invention, showing the vial adapter secured to a vial in an expanded state.
Figure 37:
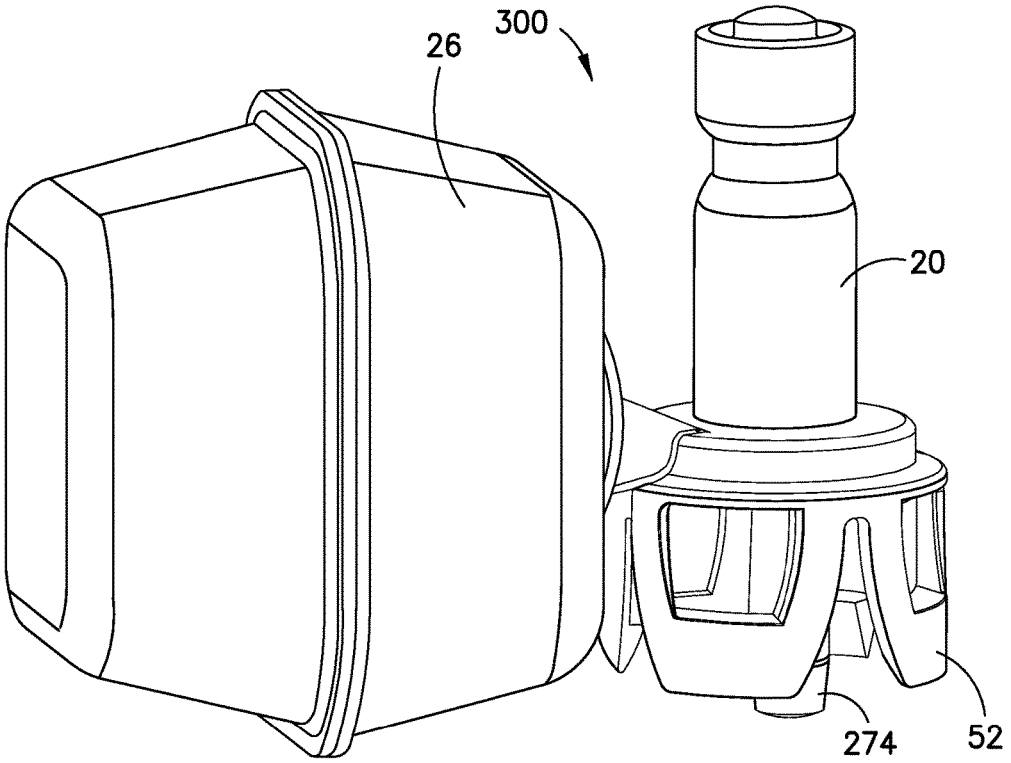
FIG. 37 is a perspective view of the vial adapter of FIG. 36 showing the vial adapter in an expanded state in accordance with an aspect of the present invention.
Figure 38:
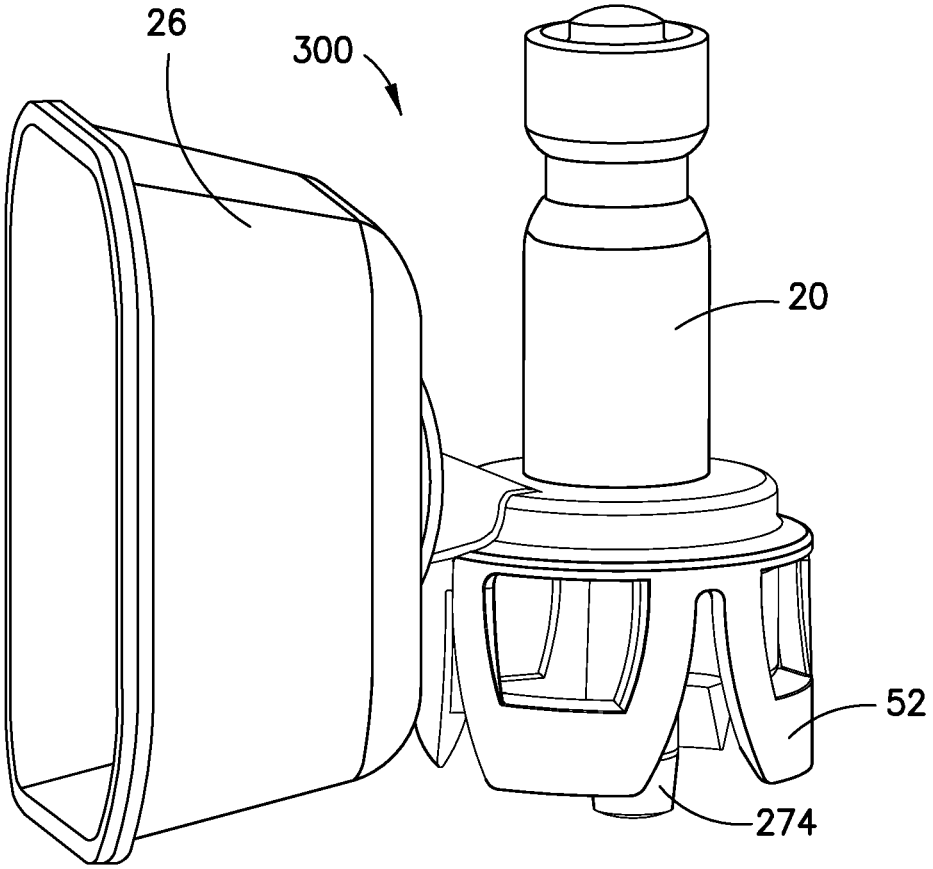
FIG. 38 is a perspective view of the vial adapter of FIG. 36 showing the vial adapter in an unexpanded state in accordance with an aspect of the present invention.

Referring to FIGS. 36-38, another aspect of a vial access device 300 is shown. The vial access device 300 is similar to the vial access device 12 described above and will operate in the same manner. The vial access device 300 includes a connector 20, a pressure equalization system 24, a connection element 52, and a spike member 122. The vial access device 300 also includes the sleeve member 274 discussed above in connection with the vial access device 200. The pressure equalization system 24 shown in FIGS. 36-38 is generally rectangular.

Figure 39:
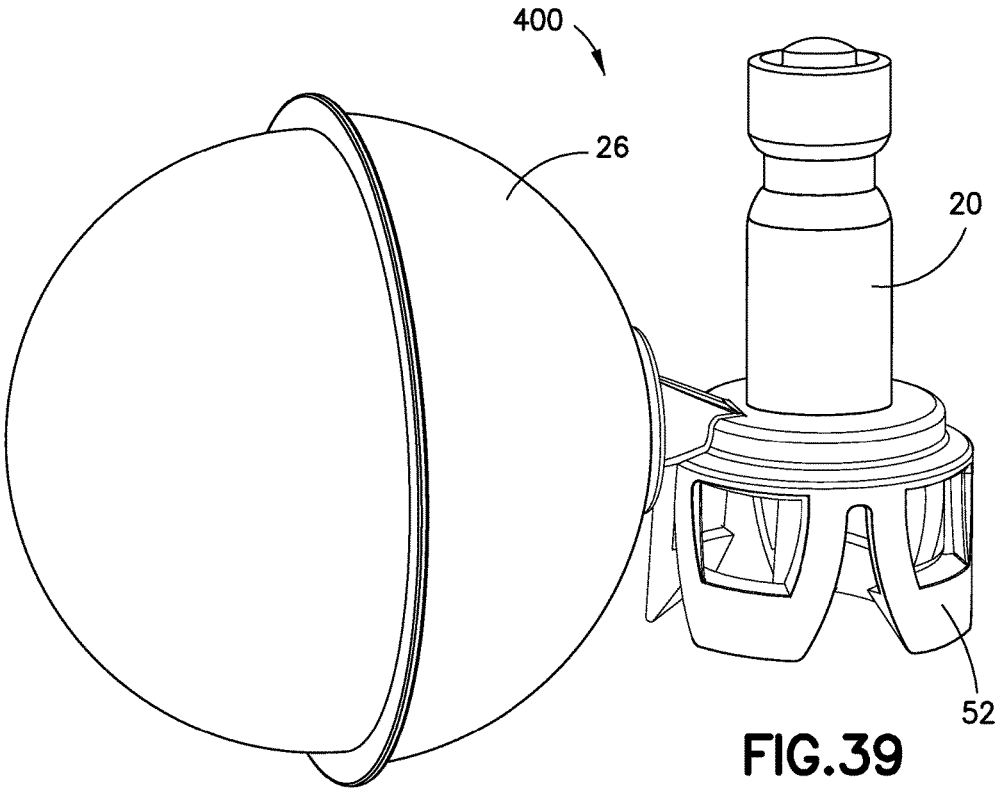
FIG. 39 is a perspective view of a vial adapter in accordance with an aspect of the present invention, showing the vial adapter in an expanded state.
Figure 40:
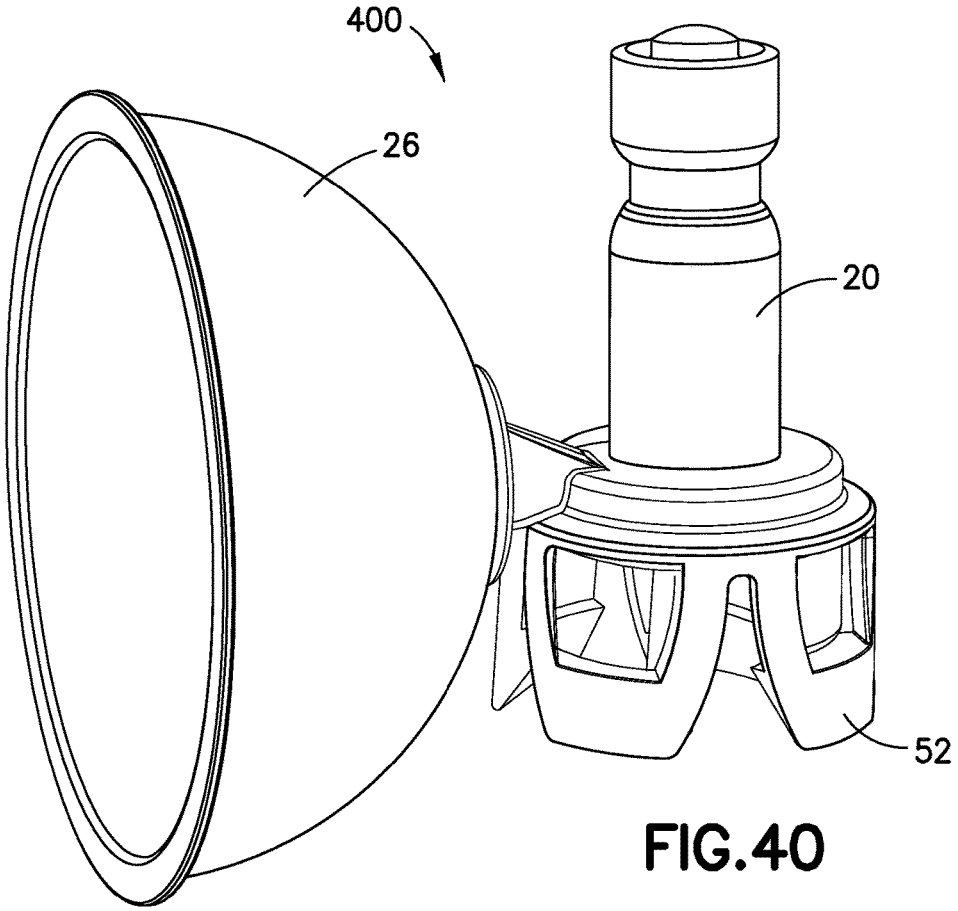
FIG. 40 is a perspective view of the vial adapter of FIG. 39 showing the vial adapter in an unexpanded state in accordance with an aspect of the present invention.

Referring to FIGS. 39 and 40, another aspect of a vial access device 400 is shown. The vial access device 400 is similar to the vial access device 300 described above and will operate in the same manner as described in connection with vial access device 12. The vial access device 400 has a pressure equalization system that is substantially spherical.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A vial access device comprising:

an outer housing defining an annular space and an inner space;

an inner housing having a body defining a central opening, at least a portion of the inner housing positioned within the inner space of the outer housing;

a connector configured to engage a mating connector, the connector having a body defining a central passageway and a flange that extends radially outward from the body, the flange and the outer housing defining a filter space, the filter space in fluid communication with the annular space;

a pressure equalization system positioned within the annular space of the outer housing, the pressure equalization system configured to change a volume of space defined by the annular space and the pressure equalization system;

a vial connection element configured to be secured to a vial, the vial connection element having a body and a spike member extending from the body, the spike member defining a fluid passageway and a vent passageway, the fluid passageway in fluid communication with the central passageway of the connector, the vent passageway in fluid communication with the filter space and the annular space; and a filter positioned in the filter space.

2. The vial access device of claim 1, further comprising a top cap having a body secured to the inner housing, the body of the top cap defining a recessed portion that receives a portion of the connector.

3. The vial access device of claim 2, wherein the top cap includes a gripping surface configured to allow a user to remove the top cap from the inner housing.

4. The vial access device of claim 1, wherein the body of the vial connection element defines a central passageway, the body of the vial connection element received within the central passageway of the connector with the central passageway of the vial connection element aligned with the central passageway of the connector.

5. The vial access device of claim 4, further comprising an O-ring positioned between the vial connection element and the connector.

6. The vial access device of claim 1, wherein the flange of the connector abuts a ledge defined by the outer housing, the ledge extending radially inward into the inner space of the outer housing.

7. The vial access device of claim 1, wherein the inner housing has a top surface having a shape that conforms to an outer surface of the outer housing.

8. The vial access device of claim 1, wherein the body of the inner housing has a cylindrical portion extending axially into the inner space of the outer housing.

9. The vial access device of claim 1, further comprising a membrane positioned on the connector adjacent to the central passageway of the connector.

10. The vial access device of claim 1, wherein the pressure equalization system comprises a toroidal balloon configured to expand axially outer of outward from the annular space of the outer housing.

11. The vial access device of claim 1, wherein the filter is annular.

12. The vial access device of claim 1, wherein the filter comprises a hydrophobic filter.

* * * * *